US012606978B2

(12) United States Patent
Swilley

(10) Patent No.: US 12,606,978 B2
(45) Date of Patent: Apr. 21, 2026

(54) EXPANDABLE SHIM SYSTEMS AND METHODS

(71) Applicant: Swilley Solutions, LLC, Valdosta, GA (US)

(72) Inventor: Timothy Swilley, Valdosta, GA (US)

(73) Assignee: SWILLEY SOLUTIONS, LLC, Valdosta, GA (US)

( * ) Notice: Subject to any disclaimer, the term of this patent is extended or adjusted under 35 U.S.C. 154(b) by 0 days.

(21) Appl. No.: 19/073,611

(22) Filed: Mar. 7, 2025

(65) Prior Publication Data

US 2025/0207348 A1 Jun. 26, 2025

Related U.S. Application Data

(63) Continuation of application No. 18/966,837, filed on Dec. 3, 2024, now abandoned.

(60) Provisional application No. 63/672,943, filed on Jul. 18, 2024, provisional application No. 63/605,860, filed on Dec. 4, 2023.

(51) Int. Cl.
*E02F 3/36* (2006.01)

(52) U.S. Cl.
CPC ..... *E02F 3/3604* (2013.01)

(58) Field of Classification Search
CPC ..... F16B 5/0642; F16B 43/009; B62K 21/16; E02F 3/3604
See application file for complete search history.

(56) References Cited

U.S. PATENT DOCUMENTS 3,417,802 A 12/1968 Oldenkott
4,433,879 A * 2/1984 Morris ..... F16B 5/0642 411/535
4,813,163 A 3/1989 Livingston et al.
5,090,855 A 2/1992 Sydney
(Continued)

FOREIGN PATENT DOCUMENTS

AU 2016274242 B2 12/2016
BR 112013026174 A2 9/2019
(Continued)

OTHER PUBLICATIONS

J.C. Gupta and Sons, Heico Lock Wedge-Lock Washers, https://www.jcfasteners.com/products/locking-elements/wedge-lock-washer/, printed Jan. 27, 2025.
(Continued)

*Primary Examiner* — Lee A Holly
(74) *Attorney, Agent, or Firm* — FOX ROTHSCHILD LLP

(57) ABSTRACT

This document discloses an adjustable shim system. The adjustable shim system a first member defining an opening for receiving a shaft The first member can have a first side defining an outside surface and a second side generally opposite the first side and at least one wedge extending from the second side. The adjustable shim system can further include a second member having a first side defining an outside surface and a second side generally opposite the first side and at least one wedge extending from the second side. The adjustable shim system can further include a fastener engaged with the first member and the second member, the fastener being configured to selectively fix the outside surface of the first member relative to the outside surface of the second member.

30 Claims, 49 Drawing Sheets

(56) References Cited

U.S. PATENT DOCUMENTS

| | | | | |
|---|---|---|---|---|
| 5,286,119 | A | 2/1994 | Fischer | |
| 5,474,409 | A | 12/1995 | Sydney | |
| 5,622,378 | A | 4/1997 | Schlosser et al. | |
| 6,379,075 | B1 | 4/2002 | Shamblin et al. | |
| 6,561,717 | B1 | 5/2003 | Martinez et al. | |
| 9,011,060 | B2 | 4/2015 | Hyatt | |
| 2008/0075556 | A1 | 3/2008 | Smith | |
| 2010/0135748 | A1 | 6/2010 | Bucknell et al. | |
| 2011/0318140 | A1* | 12/2011 | Chang | B62K 21/16 411/535 |
| 2015/0328803 | A1 | 11/2015 | Hill | |
| 2023/0313830 | A1 | 10/2023 | Tulloch | |

FOREIGN PATENT DOCUMENTS

| | | | | | |
|---|---|---|---|---|---|
| GB | 2553548 | A | * | 3/2018 | F16B 43/009 |
| WO | 2012146261 | A1 | | 11/2012 | |
| WO | 2023110466 | A1 | | 6/2023 | |

OTHER PUBLICATIONS

International Search Report dated Mar. 25, 2025 in counterpart Patent Cooperation Treaty patent application No. PCT/US2024/058246.

* cited by examiner

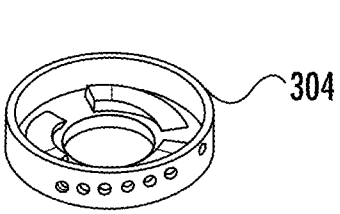
FIG. 19C
FIG. 19D
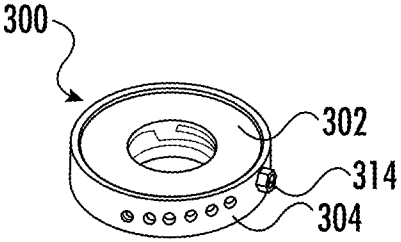
FIG. 19G
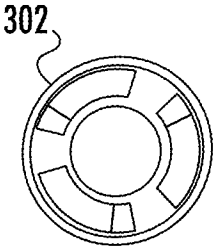
FIG. 19A
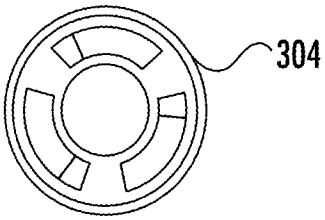
FIG. 19B
FIG. 19E
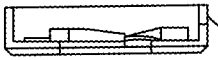
FIG. 19F
FIG. 19H
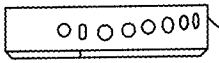
FIG. 19I

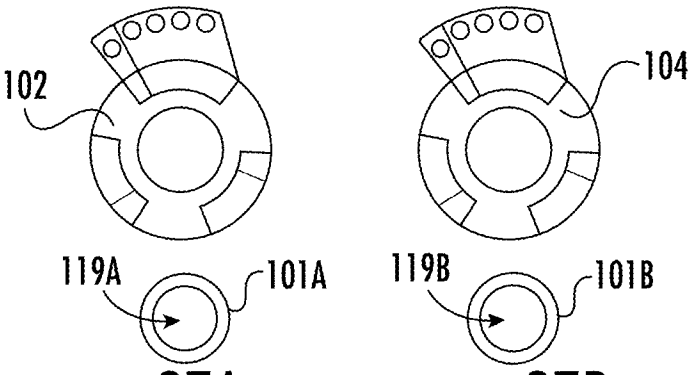
FIG. 37A
FIG. 37B
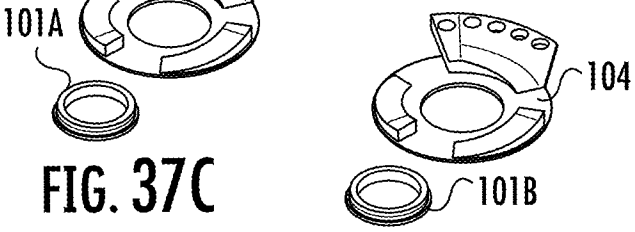
FIG. 37C
FIG. 37D
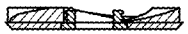
FIG. 37E
FIG. 37F
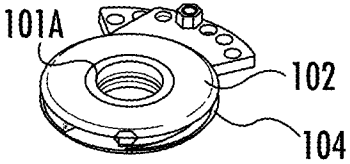
FIG. 37G
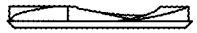
FIG. 37H
FIG. 37I

EXPANDABLE SHIM SYSTEMS AND METHODS

RELATED APPLICATIONS AND CLAIM OF PRIORITY

This patent document is a continuation of U.S. Nonprovisional patent application Ser. No. 18/966,837, filed on Dec. 3, 2024, which claims priority to U.S. Provisional Patent Application No. 63/605,860, filed Dec. 4, 2023, and U.S. Provisional Patent Application No. 63/672,943, filed Jul. 18, 2024, and the entirety of the disclosures of each of the foregoing applications are fully incorporated into this document by reference.

FIELD

The present disclosure generally relates to an expandable shim systems and methods for use with, for example, with construction equipment and other equipment where controlled lateral spacing of an item on a pin, shaft, or beam is desired.

BACKGROUND

The field of heavy machinery, particularly excavators, has long grappled with challenges in quickly and efficiently attaching and adjusting components such as a bucket to a pin on the arm of an excavator. Traditional methods involve removing the bucket or thumbs from the excavator in a shop using heavy lifting equipment and installing non-adjustable shims or washers on the pin to fill the space created by wear on the part. The process is cumbersome, time-consuming, and often inadequate regarding precision and stability.

The excavator arm, comprising a boom, stick, and attachment (typically a bucket), is controlled by hydraulic cylinders operated from the cab. The operator extends and contracts these cylinders to pivot parts of the arm at connection points, enabling the raising and lowering of the arm, its extension, and the curling and uncurling of the attachment, for example, a bucket or thumb.

While sometimes only one cylinder is used, complex movements can involve engaging multiple cylinders simultaneously. The operator can achieve fluid and precise arm movements by varying the timing and force applied to different cylinders. For instance, during trenching, simultaneous and specific adjustments of the boom, stick, and bucket cylinders allow for coordinated actions like scooping.

The hydraulic cylinders enable the arm to dig with exact measurements, accurately place or spread materials, or load equipment. The bucket cylinder, uniquely connected through linkage, controls the bucket's loading and dumping actions. Adjusting the bucket's angle during digging and holding a load is also crucial for efficiency.

Linkages on the excavator's arm are heavy-duty connectors that facilitate specific movements of the attachments, linking the stick and attachment while allowing precise movements. Additionally, an excavator's thumb works with the bucket, acting as a grappling device for securing objects like large stones or logs, enhancing the arm's movement capabilities.

Unfortunately, the excavator bucket becomes loose through use and wear on the connecting parts. The loose fitting between the excavator coupling, the bucket bracket, and the thumb causes the bucket to rattle along the pins and bushings. Operators should avoid exerting unnecessary force on the joints and prolong the life of heavy equipment machines and attachments by shimming the connection of the pins and bushings between the bucket and the excavator arm to remove the gaps between the excavator and the bucket linkage to keep everything tight.

If an excavator bucket or thumb wobbles, it indicates the need for shimming. Shimming reduces premature wear between the coupler and the end of the stick by preventing side-to-side movement and also improves control, especially when the excavator stops swinging. Loose side-to-side movement is detrimental. The movement allows grease to escape through gaps between the shaft fittings and permits dirt to enter the gaps. The remaining inadequate grease and dirt accelerate wear, leading to complications and downtime. The traditional method of shimming the gaps in the attachment of a bucket to an excavator's arm involves several steps. The tools used include a hammer and drift for removing the pin and a flex bar and ratchet for detaching the wedge coupler.

The bucket is removed by first taking off the wedge coupler. The roll pin that retains the pin is then accessed and removed. A mechanic measures gaps requiring a shim for the correct shim thickness. Shims are placed on both sides of the coupler for even distribution. Shims are added as needed to ensure a tight fit. The pin is then realigned with the bucket or thumbs and driven back in, securing the shims. A roll pin, or a spring pin, is used to hold the shims in place. The inserted spring pin expands outward to maintain its position. The coupler and thumb are adjusted to align with the excavator's stick. Once the shimming is complete, the roll pin is driven back in, and the excavator is greased. This process ensures that the bucket is securely attached to the arm and shimmed, reducing movement and wear and improving the excavator's operational control.

The process is time-consuming and a burden. Because the process is difficult, operators often use excavator buckets beyond the time for their repair while in poor operating conditions.

Given the above, a continued need exists for a device and method to improve the means to shim the space created by wear in the attachment of parts such as the excavator bucket or thumbs on heavy equipment such as an excavator.

SUMMARY

In one aspect, the disclosed technology relates to a shim system. The shim system can be configured for receipt of a shaft. The shim system can include a first plate defining an opening for receiving the shaft and having an inside surface and an outside surface, the inside surface having a plurality of equally spaced wedges extending therefrom, a second plate defining an opening for receiving the shaft and having an inside surface and an outside surface, the inside surface having a plurality of equally spaced wedges extending therefrom, and a fastener engaged with the first plate and the second plate, the fastener being configured to selectively fix the first plate relative to the second plate. Each of the plurality of wedges of the first plate can contact a corresponding one of the plurality of wedges of the second plate. The plurality of wedges of the first plate and the plurality of wedges of the second plate can be sized and positioned such that relative rotation between the first plate and the second plate changes the distance between the outside surface of the first plate relative to the outside surface of the second plate.

In some embodiments, the first plate further includes a first cylindrical sidewall, the first cylindrical side wall can form a cavity, and the plurality of wedges of the first plate can be disposed within the cavity. The first cylindrical side wall can further include a plurality of holes, and the fastener can extend through a first of the plurality of holes. In some embodiments, the second plate can further include a second cylindrical sidewall, the second cylindrical side wall can includes a second aperture, and the fastener can engage the second aperture. The second aperture can extend into one wedge of the plurality of wedges of the second plate. The first cylindrical side wall can include a groove and the fastener can extend through the groove.

In some embodiments, each of the first plate and second plate can be generally circular. The opening of each of the first plate and second plate can further include a center aperture configured to receive the shaft. The plurality of wedges of each of the first plate and second plate can be curved around the center aperture. The plurality of wedges of the first plate can oppose the plurality of wedges of the second plate.

In some embodiments, one of the plurality of wedges of the first plate includes a first protruding wedge that extends beyond an outer periphery of the first plate. One of the plurality of wedges of the second plate can include a second protruding wedge that extends beyond an outer periphery of the second plate. The first protruding wedge can include a first aperture, the second protruding wedge can include a second aperture, and the fastener can extend through the first aperture and second aperture. The first protruding wedge can include a plurality of apertures, and the fastener can extend through one of the plurality of apertures.

In various embodiments, the plurality of wedges of the first plate are equally spaced about the inside surface of the first plate and the plurality of wedges of the second plate are equally spaced about the inside surface of the second plate.

In another aspect, the disclosed technology relates to a method for adjusting an excavator bucket attachment. The method can include providing a shim system comprising a shim set having a first plate having a first outer surface and a second plate having a second outer surface, rotating the first plate relative to the second plate to vary the distance between the first outer surface and the second outer surface, and inserting a fastener into the shim to secure the shim in a first desired position. The method can further include removing the fastener from the shim set, rotating first plate relative to the second plate to change the distance between the first outer surface and the second outer surface, and reinserting the fastener into the shim to secure the shim in a second desired position.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description.

FIG. 19A is top view of another example plate of a third embodiment of an expandable shim in accordance with the present disclosure.

FIG. 19B is top view of second example plate of the third embodiment of an expandable shim.

FIG. 19C is a perspective view of the example plate of the third embodiment of an expandable shim of FIG. 19A.

FIG. 19D is a perspective view of the second example plate of the third embodiment of an expandable shim of FIG. 19B.

FIG. 19E is a cross-sectional side view of the example plate of the third embodiment of an expandable shim of FIG. 19A.

FIG. 19F is a cross-sectional side view of the second example plate of the third embodiment of an expandable shim of FIG. 19B.

FIG. 19G is a perspective view of example assembled expandable shim according to the third embodiment.

FIG. 19H is another side view of the example plate of the third embodiment of an expandable shim of FIG. 19A.

FIG. 19I is another side view of the second example plate of the third embodiment of an expandable shim of FIG. 19B.

FIG. 37A is top view of another example plate and bushing of a fifth embodiment of an expandable shim.

FIG. 37B is top view of second example plate and bushing of the fifth embodiment of an expandable shim.

FIG. 37C is a perspective view of the example plate and bushing of the fifth embodiment of an expandable shim of FIG. 39A.

FIG. 37D is a perspective view of the second example plate and bushing of the fifth embodiment of an expandable shim of FIG. 39B.

FIG. 37E is a cross-sectional side view of the example plate of the fifth embodiment of an expandable shim of FIG. 39A.

FIG. 37F is a cross-sectional side view of the second example plate of the fifth embodiment of an expandable shim of FIG. 39B.

FIG. 37G is a perspective view of example assembled expandable shim according to the fifth embodiment.

FIG. 37H is a side view of the example plate of the fifth embodiment of an expandable shim of FIG. 25A.

FIG. 37I is a side view of the second example plate of the fifth embodiment of an expandable shim of FIG. 25B.

DETAILED DESCRIPTION

Figure 1:
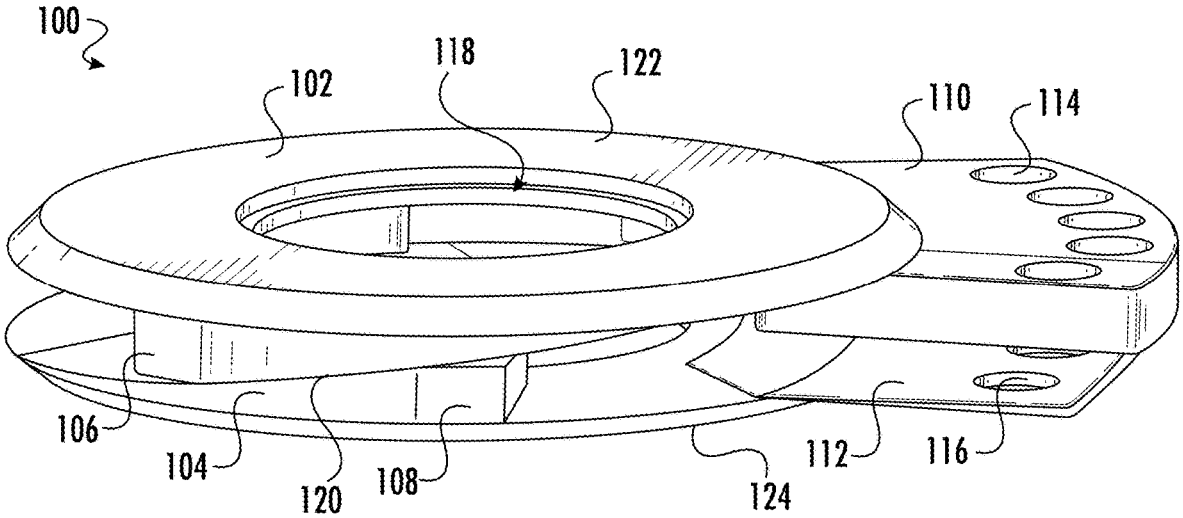
FIG. 1 is a side perspective view of an example expandable shim in accordance with the present disclosure.
Figure 2:
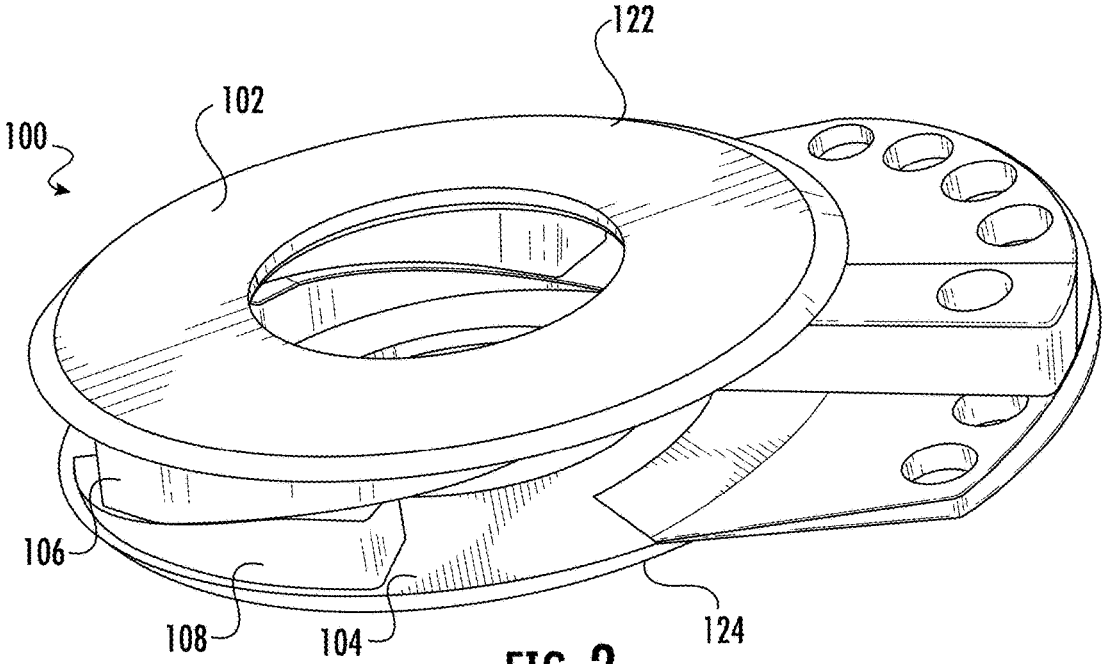
FIG. 2 is a perspective view of the expandable shim of FIG. 1.

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

Certain relationships between features of the disclosed embodiments are described herein using the term "substantially" or "substantially equal". As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" indicates that the orthogonal relationship is not a strict relationship and does not exclude functionally similar variations therefrom.

The present disclosure relates to an adjustable expanding shim, an expandable shim apparatus, a shim set, and an expandable shim system and methods designed to facilitate the adjustable shimming of excavator buckets and thumbs on excavators. The expandable shim can be used to shim the connection of a bucket (or other attachment) to an excavator's arm, enhancing the connection's stability and efficiency. The expandable shim can be pre-installed on the excavator and be adjusted without requiring the disassembly of a bucket or thumbs from the excavator.

The expandable shim apparatus includes an expandable shim formed of a pair of plates forming a pack installed during the attachment of a bucket or thumbs to an excavator, also referred to herein as an "expander shimpack." With the expander shimpack installed during the assembly of the bucket, thumbs, and excavator, shimming to restore loose fitting of the excavator stick to the pin holding the bucket or thumbs can occur on the job site, i.e., in the field rather than requiring the excavator to be transported back to the shop.

This expander shimpack uniquely features two plates having opposing sets of corresponding wedges. When the wedges are placed in contact with one another and the plates are rotated relative to each other, the lateral distance between the outer surfaces of the plates will change, thereby laterally expanding or contracting the expander shimpack. The wedges may include surface texturing, notches, or steps to increase the gripping power between the wedges and decrease the likelihood of relative slipping between the wedges. Such surface texturing can be especially advantageous in embodiments incorporating a locking slot in lieu of individual bolt holes, as explained in greater detail below. In some embodiments, one set of wedges can be larger and protrude beyond the plate's circumference or periphery. The larger wedges can include bolt holes for receipt of a locking bolt to secure the shimpack in a desired adjustment position (corresponding to a desired overall thickness of the shimpack). In such embodiments, the two plates of the shimpack can be essentially mirror images of each other. This can permit multiple locking holes to align at each adjustment position, thus permitting a user to install multiple locking bolts to provide greater locking force and increased durability of the shimpack. Interchangeable bushings in the plates' central opening allow the installation of the same expander shimpack on excavators having varying pin sizes. This novel configuration expandable shim apparatus allows for an efficient, secure, and adjustable method for shimming excavator buckets and thumbs by expanding the thickness of the expander shim.

The expandable shim is adjustable through locking bolt holes. The holes in the various disclosed embodiments allow for a locking bolt to secure the shim in a desired position. This feature offers an adjustable and secure method for shimming excavator components. These features provide an adjustable, secure, and easy-to-use solution for shimming excavator buckets and thumbs. The design of the expandable shim not only simplifies the shimming process but also enhances operational efficiency and safety in heavy machinery. The expandable shim could be used in other scenarios to shim various equipment components, such as skid loaders, various tractor attachments, lawn mowers, or other applications where items or implements require relatively precise lateral placement on a shaft, pin, beam, etc.

The expandable shims disclosed herein can be constructed out of various suitable materials capable of withstanding the loads the shim will experience when used on heavy equipment, such as steel, aluminum, or various other metal alloys. In some embodiments, when the shim is to be used in applications experiencing lower operating forces, the shim could be made of other materials such as plastic, brass, etc. Various processes could be used to construct the shims based on the chosen material. These processes include, but are not limited to welding, machining, casting, 3D printing, or others and combinations thereof (such as welding together two machined components).

The expandable shims disclosed herein can be of various sizes, dependent on the desired use case of the shim. As an example, the circular plates of the shim could have a diameter of about 3 inches to about 24 inches, or about 6 inches to about 12 inches. The internal apertures of the plates could have a diameter of about 1 inch to about 18 inches, or about 3 inches to about 6 inches. The plates (not included the wedges) could have a thickness of about 0.25 inches to about 1 inch. The overall thickness of the shim could be about 0.5 inches to about 4 inches, or about 1 inch to about 2 inches. These dimensions are provided by way of example, and a person of ordinary skill in the art would understand that expandable shims could be made larger or smaller, depending on the desired application.

The construction of the expanding adjustable shim includes two primary elements, namely, the first and second circular plates. These plates can be constructed from a robust metal (such as steel, as described above) and form the foundation of the adjustable shim. On each plate are wedges, which play a role in the adjustability and stability of the shim. For this description, the adjustable shim expands the width of the wedge when installed on the excavator arm. The width (or thickness) is the horizontal measurement between the outside faces of the two plates. The wedges are distributed evenly around the plates, providing structural support.

The adjustable shim can include a flat surface at the end of each wedge and strategically placed adjustment holes (which in some embodiments can be integrated into the wedges) for enhanced functionality. The flat surfaces aid in alignment and operation and provide a clear stopping point at the place of maximum width of the shim. The adjustment holes accommodate bolts or other suitable fasteners (such as a pin) for a secure and adjustable connection. One of the adjustment holes can be radially offset from the other adjustment holes. This can prevent a user from misaligning the shimpack and incorrectly locking the two plates together (specifically, offsetting the adjustment hole corresponding to the flat surface locking position prevents the offset hole from being locked to a hole in the slope portion of the opposing protruding locking wedge). Preventing such misalignment can prevent the forces applied by the locking bolt from distorting the protruding locking wedge due to non-matching slopes of the locking wedges.

In some implementations, the shim includes a beveled edge on the outside edge of the outside diameter of each circular plate. The beveled edge can be configured to receive an O-ring during the installation of the shim. During the installation of the expander shimpack, the installer installs the O-ring between the beveled edge of the respective plate and the adjacent beveled edge of the knuckle of the excavator stick, whereby the O-ring enhances grease retention in the fitting and prevents the entry of dirt.

The operational mechanism and application of the adjustable shim are integral to its effectiveness in excavator operations. The adjustable shim device provides an improved shim device and method used with an excavator, specifically for shimming a bucket to an excavator arm, also known as the excavator stick. A coupler on the arm, designed to connect with a bucket connector, houses a pin for securing the bucket. An excavator thumb attaches to the ends of the pin and works in conjunction with the bucket for enhanced functionality. The adjustability of the protruding wedges via the bolts through the holes of the shim allows for precise fitting and shimming between the excavator arm and the bucket and thumb, which is crucial for minimizing wear and enhancing operational precision.

In various disclosed embodiments, the discrete holes of the shim plates may be replaced with a continuous slot to allows for variable shim width adjustment, providing greater flexibility and precision in fitting the shim to the excavator arm. Surface texturing or steps in the wedges can provide additional locking force to hold the wedges in a desired position in embodiments employing a continuous slot. In some embodiments, the tapered surface of each metal wedge can include a helix surface taper. This design ensures complete contact between the opposing faces of the metal wedges, providing a more secure and stable fit. The helical taper permits full contact between the sets of wedges throughout rotation of the plates. Specifically, the helix surface taper means that the wedges are inclined in multiple directions helically around the center aperture of the shim plate. Stated differently, in addition to being curved around the center aperture and tapering in a radial direction around the circumference of the circular center aperture, the wedge may also taper from inside to outside (the wedge may be thicker at its outer edge and get thinner towards the center of the plate). Thus, at a certain angular position about the center aperture, a wedge may be thicker at its outer edge and thinner at its inner edge (or vice-versa).

Each of the embodiments of the expandable shim disclosed herein includes at least two plates each having at least one wedge. More desirably, each plate can include a plurality of wedges. For example, as shown throughout the figures, the plates can include three wedges. Of course, while the figures depict plates with three wedges, plates with one, two, four, or more wedges are possible. When plates include a plurality of wedges, the wedges can be equally sized and equally spaced radially on the plate. For example, as shown in the figures with plates having three wedges, the starting and ending edges of the wedges can be spaced 120 degrees apart from each other. As another example, plates could include two wedges spaced 18 degrees apart or four wedges spaced 90 degrees apart. The symmetry and equal sizing of the wedges facilitates even load distribution throughout the shim and ensures that the outer surfaces of each plate remain parallel to each other when the shim is in use.

EXAMPLES

The disclosed technology is next described by means of the following examples. The use of these and other examples anywhere in the specification is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification and can be made without departing from its spirit and scope. The invention is therefore to be limited only by the terms of the claims, along with the full scope of equivalents to which the claims are entitled.

FIGS. 1-9 illustrate a first embodiment of adjustable shim 100. Adjustable shim 100 includes a first plate 102 and a second plate 104. As shown in the figures, plates 102, 104 can have a circular or semi-circular shape. Each plate includes an aperture 118. Aperture 118 can be configured to receive a pin, for example, a pin of an excavator stick. Aperture 118 permits shim 100 to be installed on a machine such as an excavator (not shown). As described in greater detail below, shim 100 can be used with one or more bushings to facilitate installation on pins having a different size or shape than aperture 118. For example, a bushing could be used to permit shim 100 to be installed on a pin having a diameter smaller than the diameter of aperture 118. Each plate 102, 104 has an outside surface 122, 124 and an inside surface 103, 105. The inside surfaces include at least one wedge 106, 108. When the adjustable shim is in use, the inside surfaces 103, 105 will face each other and wedge 106 will contact wedge 108. The relative positioning of wedges (i.e., the relative rotational positioning of the plates 102, 104) will control the thickness of shim 100. The thickness of shim 100 can be the distance from outer surface 122 of plate 102 to outer surface 124 of plate 104. Put differently, the plurality of wedges of the first plate and the plurality of wedges of the second plate can be sized and positioned such that relative rotation between the first plate and the second plate changes the distance between the outside surface of the first plate and the outside surface of the second plate.

Figure 3:
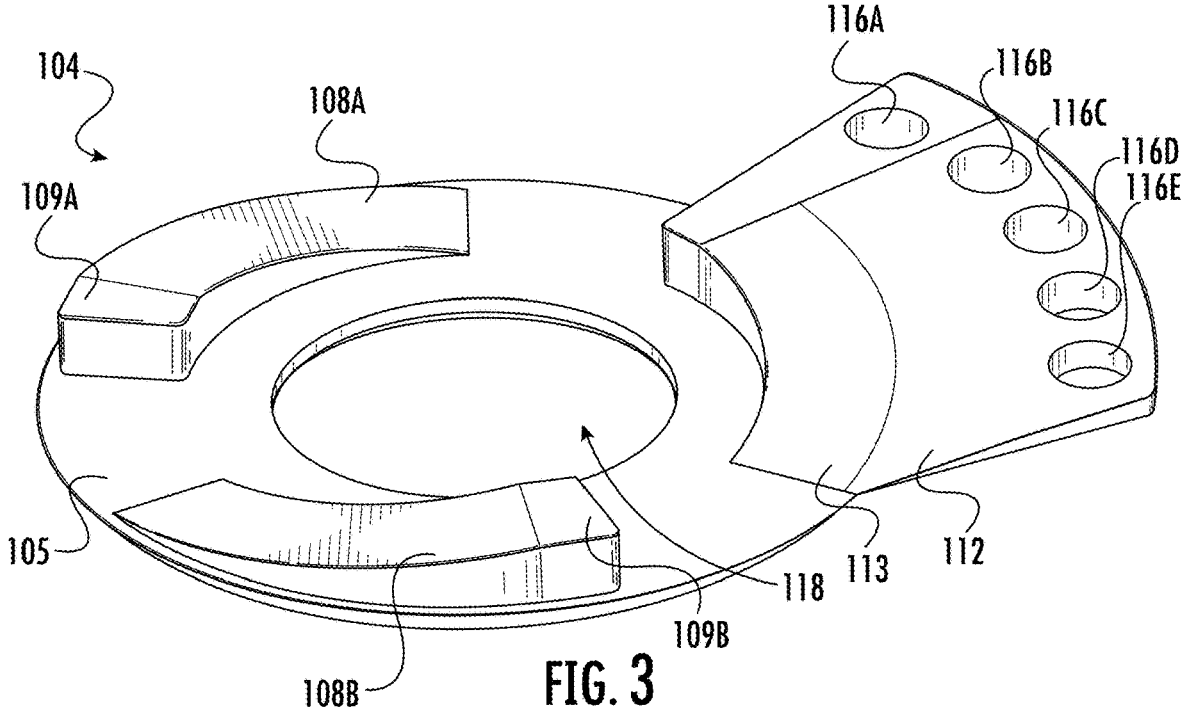
FIG. 3 is a perspective view of a plate of the expandable shim of FIG. 1.
Figure 4:
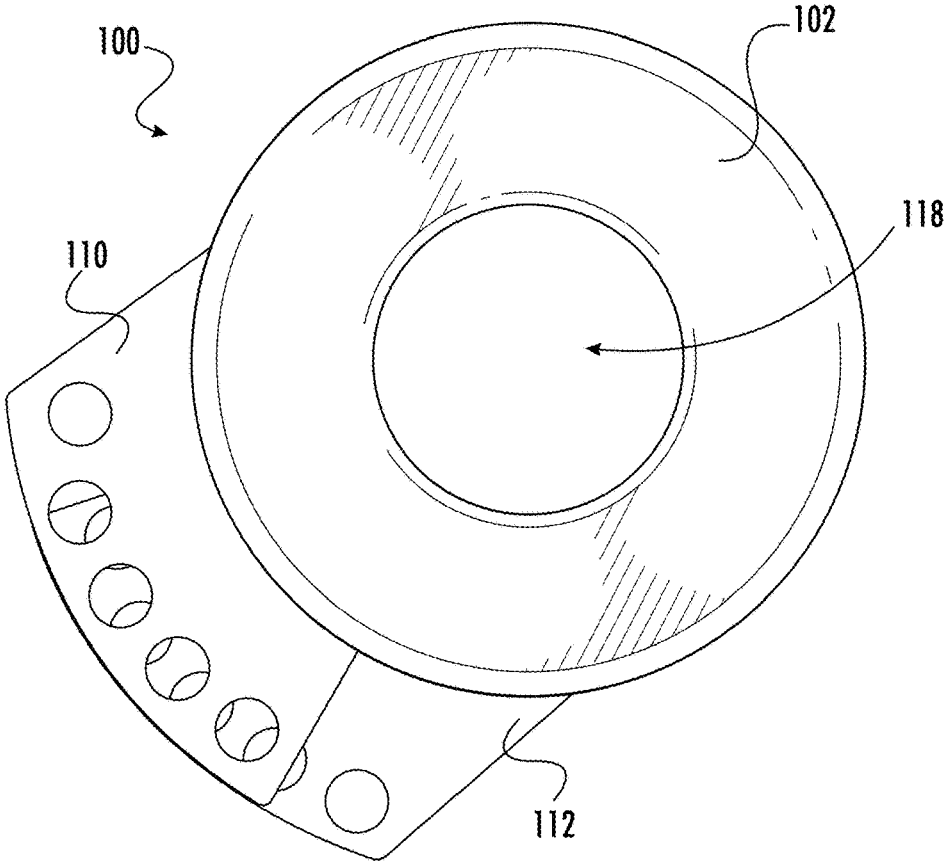
FIG. 4 is a top view of the expandable shim of FIG. 1.
Figure 5:
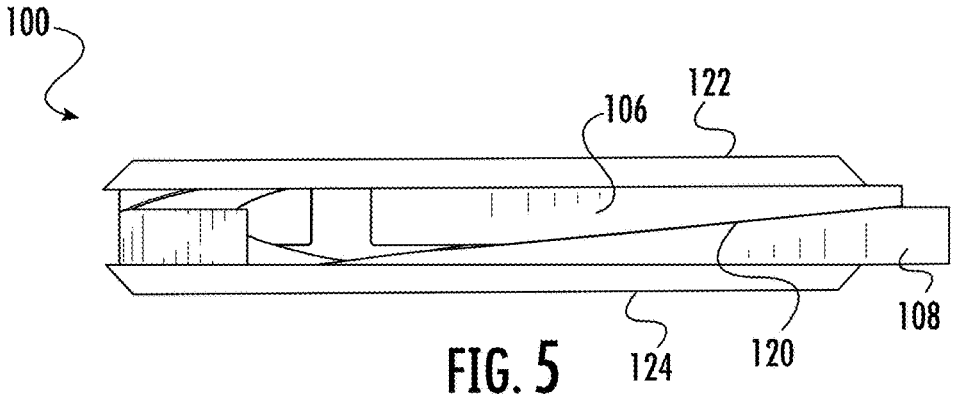
FIG. 5 is a side view of the expandable shim of FIG. 1.
Figure 7:
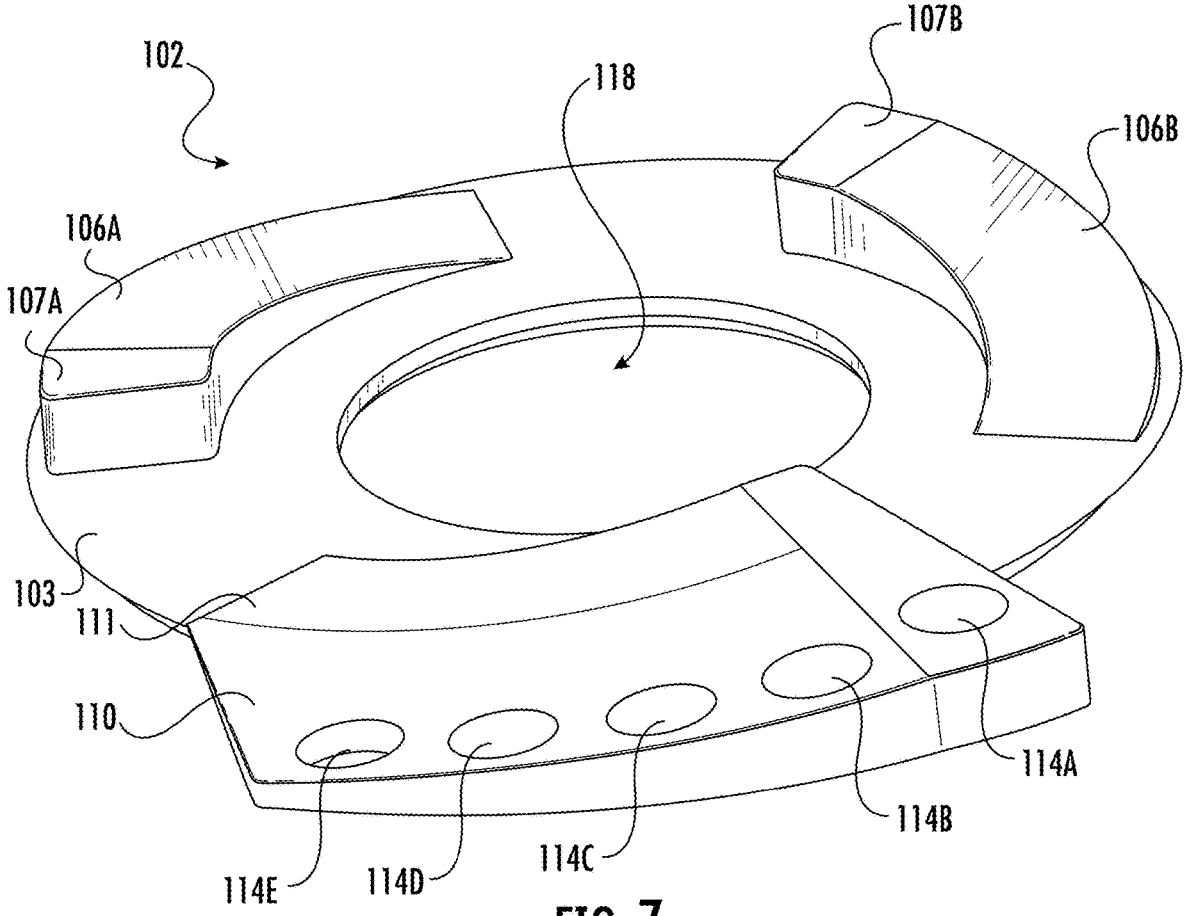
FIG. 7 is a perspective view of a second plate of the expandable shim of FIG. 1.
Figure 8:
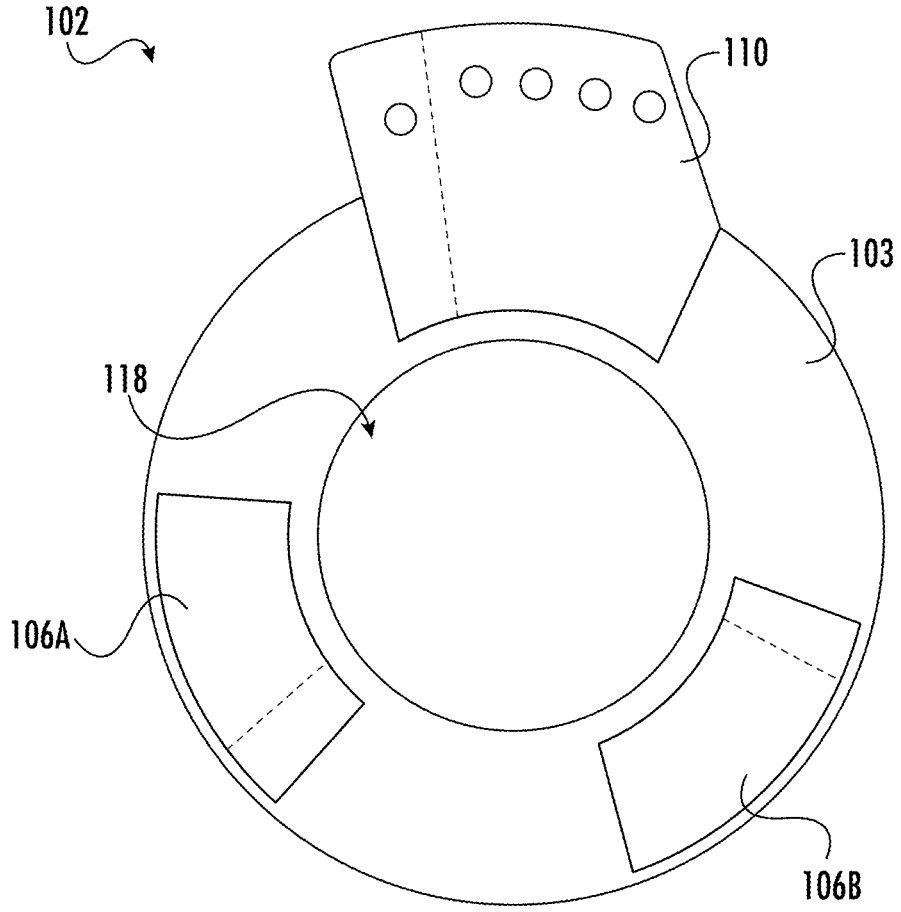
FIG. 8 is a top view of the plate of the expandable shim of FIG. 7.
Figure 9:
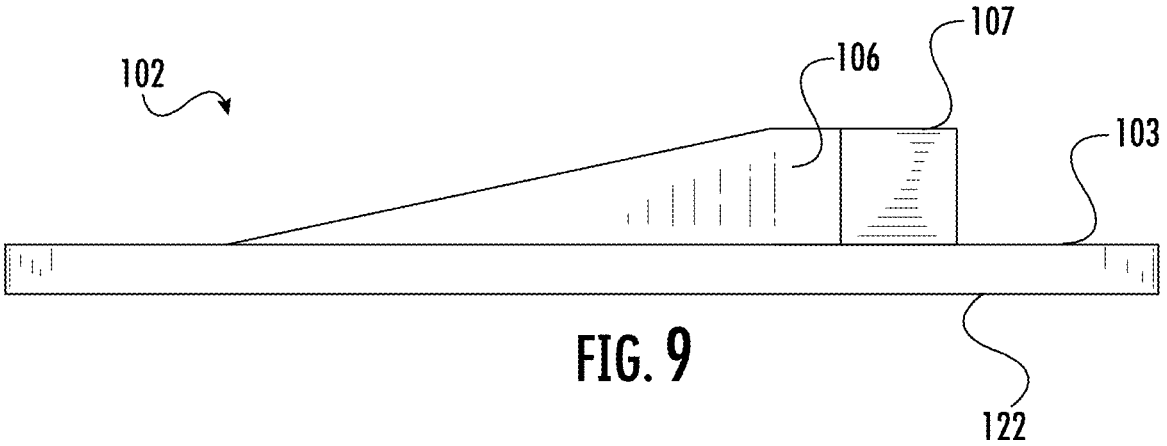
FIG. 9 is a side view of the plate of the expandable shim of FIG. 7.

Each plate 102, 104 can include a plurality of wedges. For example, as shown in FIGS. 3 and 7, plates can include three wedges 106A-B, 111 and 108A-B, 113. Of course, while the figures depict plates with 3 wedges, plates with one, two, four, or more wedges could be constructed. When plates include a plurality of wedges, the wedges can be equally sized and equally spaced radially on the plate. For example, as shown in the figures with plates having three wedges, the starting and ending edges of the wedges can be spaced 120 degrees apart from each other. As another example, plates could include two wedges spaced 180 degrees apart or four wedges spaced 90 degrees apart. The symmetry and equal sizing of the wedges facilitates even load distribution throughout the shim and ensures that the outer surfaces 122, 124 remain parallel to each other when the shim 100 is in use.

The inclined planes of the opposing wedges contact each other, for example, along contact area 120. Using the orientation depicted in FIGS. 1 and 2, as the top plate (plate 102) is rotated clockwise, the shim will expand as contact point 120 decreases in size and its center point move rightward. Put differently, the thicket parts of both wedges will be contacting each other as plate 102 moves clockwise with respect to plate 104. The opposite is also true: as plate 102 moves counterclockwise with respect to plate 104, contact point 120 will become larger and move leftward, which will decrease the thickness of shim 100. The shim will reach its maximum expansion point (maximum thickness) when flat wedge surfaces 107, 109 of plates 102, 104 are in contact with one another. The shim will be at its minimum thickness when flat wedge surface 109 of plate 104 contacts inside surface 103 of plate 102 (and opposing flat wedge surface 107 of plate 102 contacts inside surface 105 of plate 104). Flat wedge surfaces 107, 109 at the end of the wedges provide robust bearing support when the adjustable shim 100 is fully expanded or fully contracted. This design ensures a stable and even distribution of forces, enhancing the shim's durability under operational stresses.

Figure 6:
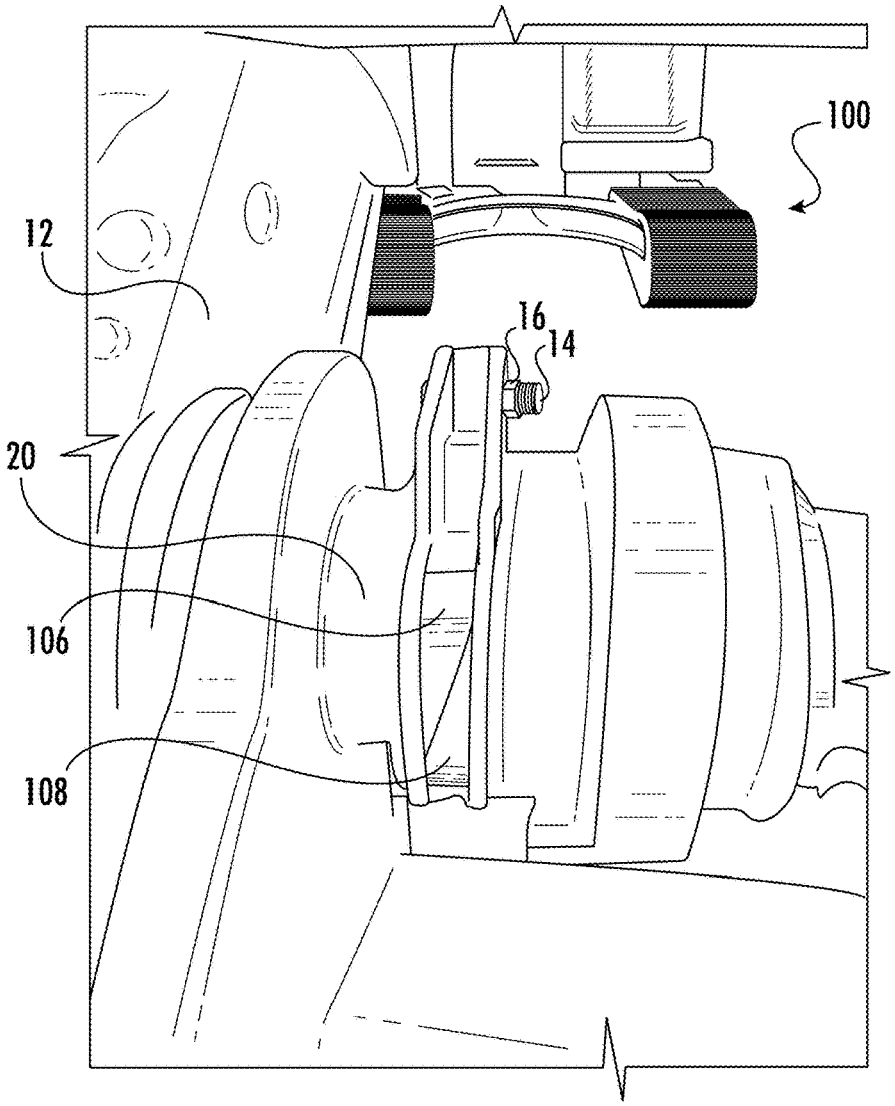
FIG. 6 is an illustration depicting the expandable shim of FIG. 1 installed on an excavator.
Figure 11:
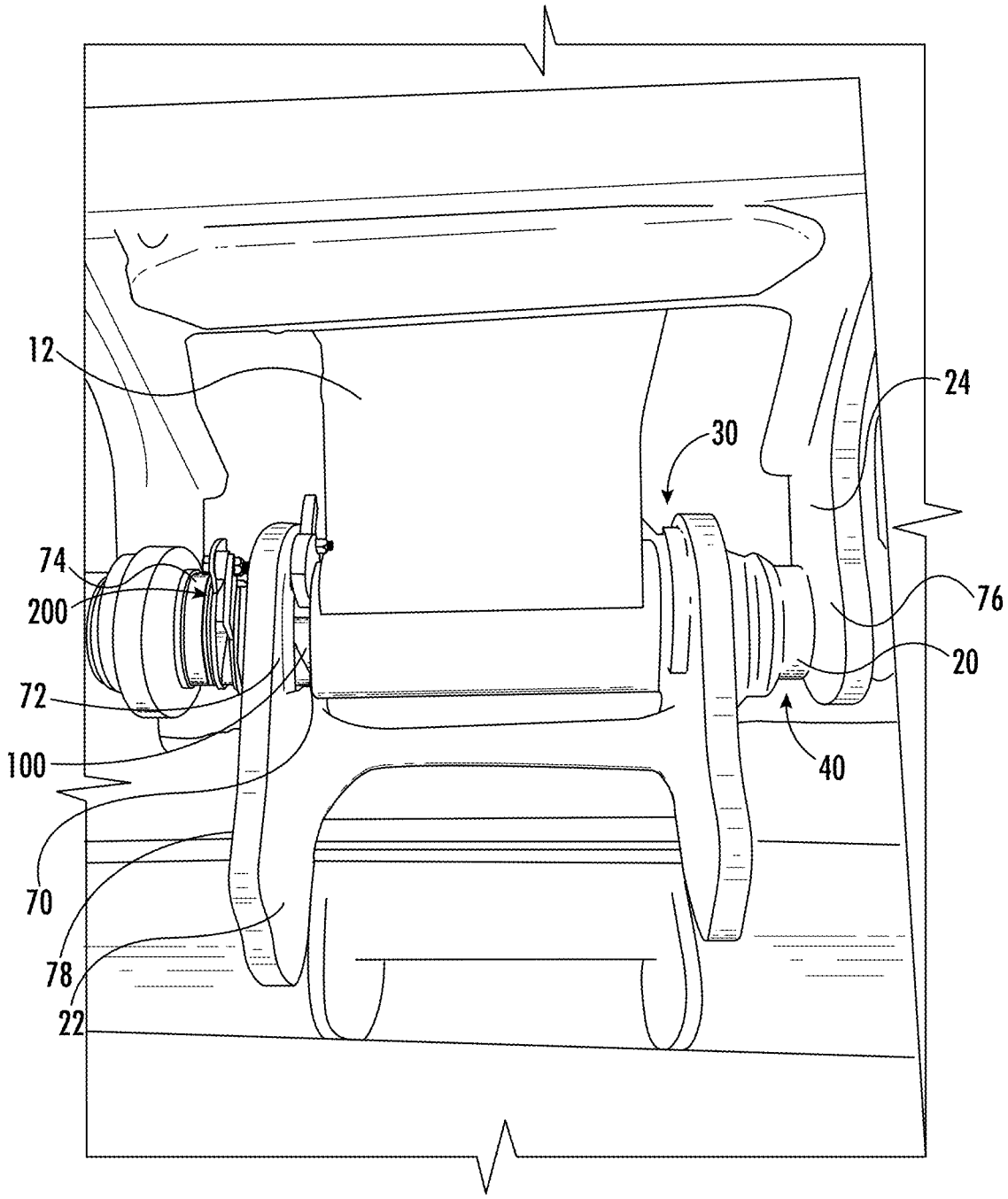
FIG. 11 is an illustration depicting two different embodiments of example expandable shims installed on an excavator.
Figure 12A:
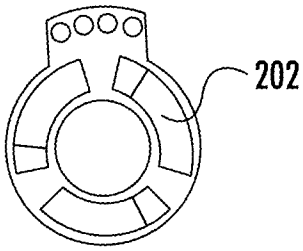
FIG. 12A is top view of another example plate of a second embodiment of an expandable shim.
Figure 12B:
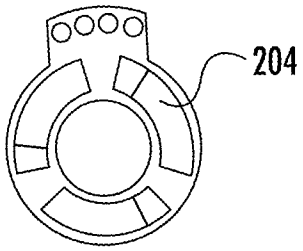
FIG. 12B is top view of second example plate of the second embodiment of an expandable shim.
Figure 12C:
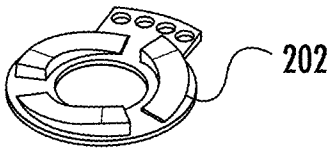
FIG. 12C is a perspective view of the example plate of the second embodiment of an expandable shim of FIG. 12A.
Figure 12D:
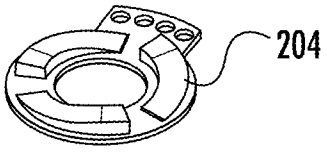
FIG. 12D is a perspective view of the second example plate of the second embodiment of an expandable shim of FIG. 12B.
Figure 12E:
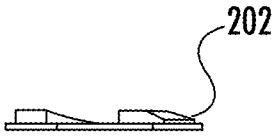
FIG. 12E is a side view of the example plate of the second embodiment of an expandable shim of FIG. 12A.
Figure 12F:
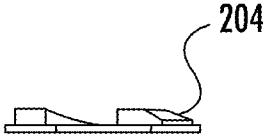
FIG. 12F is a side view of the second example plate of the second embodiment of an expandable shim of FIG. 12B.
Figure 12G:
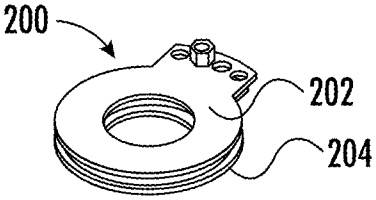
FIG. 12G is a perspective view of example assembled expandable shim according to the second embodiment.
Figure 12H:
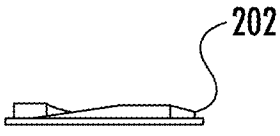
FIG. 12H is another side view of the example plate of the second embodiment of an expandable shim of FIG. 12A.
Figure 12I:
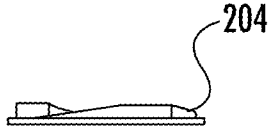
FIG. 12I is another side view of the second example plate of the second embodiment of an expandable shim of FIG. 12B.
Figure 12J:
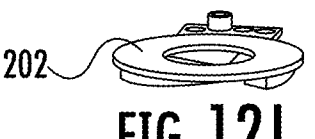
FIG. 12J is perspective view of the example plate of the second embodiment of an expandable shim of FIG. 12A and a bolt.
Figure 12K:
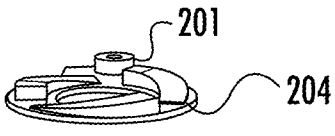
FIG. 12K is perspective view of the example plate of the second embodiment of an expandable shim of FIG. 1B and a spacer.
Figure 13B:
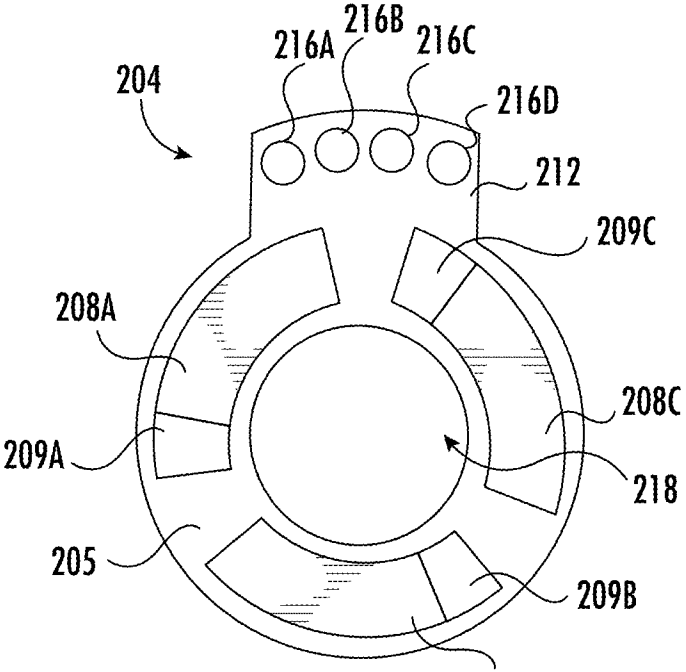
FIG. 13B is an enlarged version of FIG. 12B.
Figure 13A:
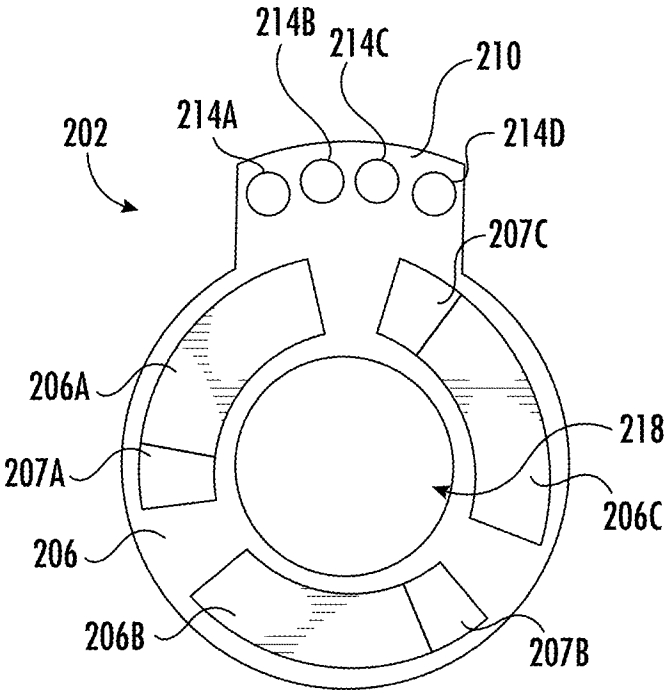
FIG. 13A is an enlarged version of FIG. 12A.
Figure 14B:
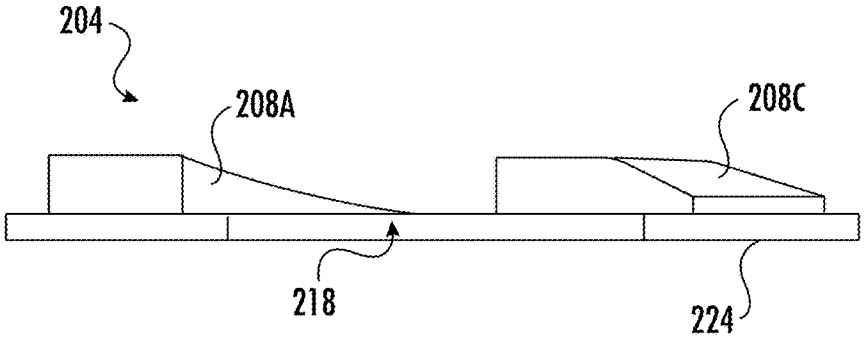
FIG. 14B is an enlarged version of FIG. 12F.
Figure 14A:
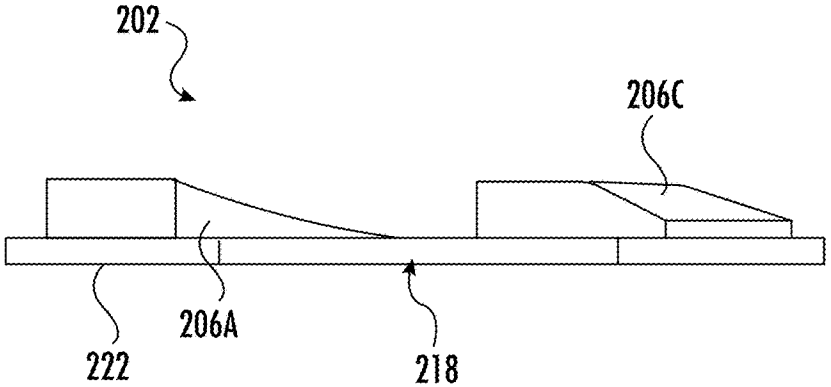
FIG. 14A is an enlarged version of FIG. 12E.
Figure 15B:
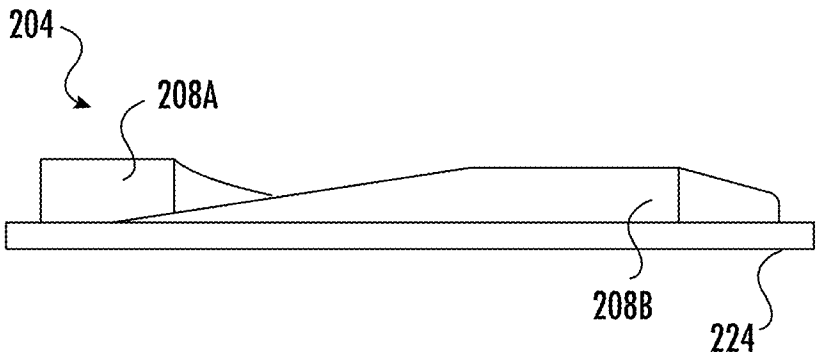
FIG. 15B is an enlarged version of FIG. 12I.
Figure 15A:
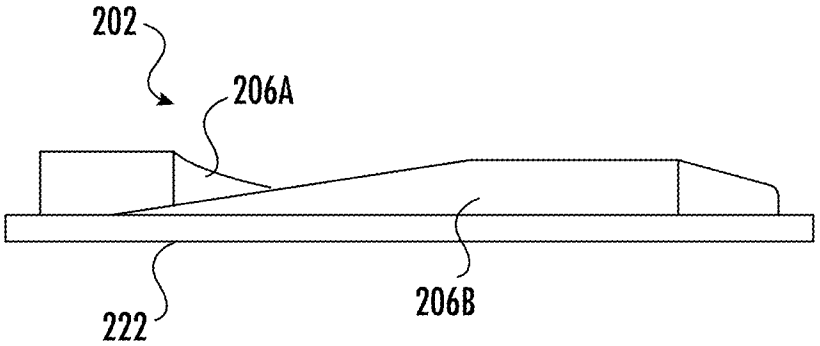
FIG. 15A is an enlarged version of FIG. 12H.
Figures 16A, 16B:
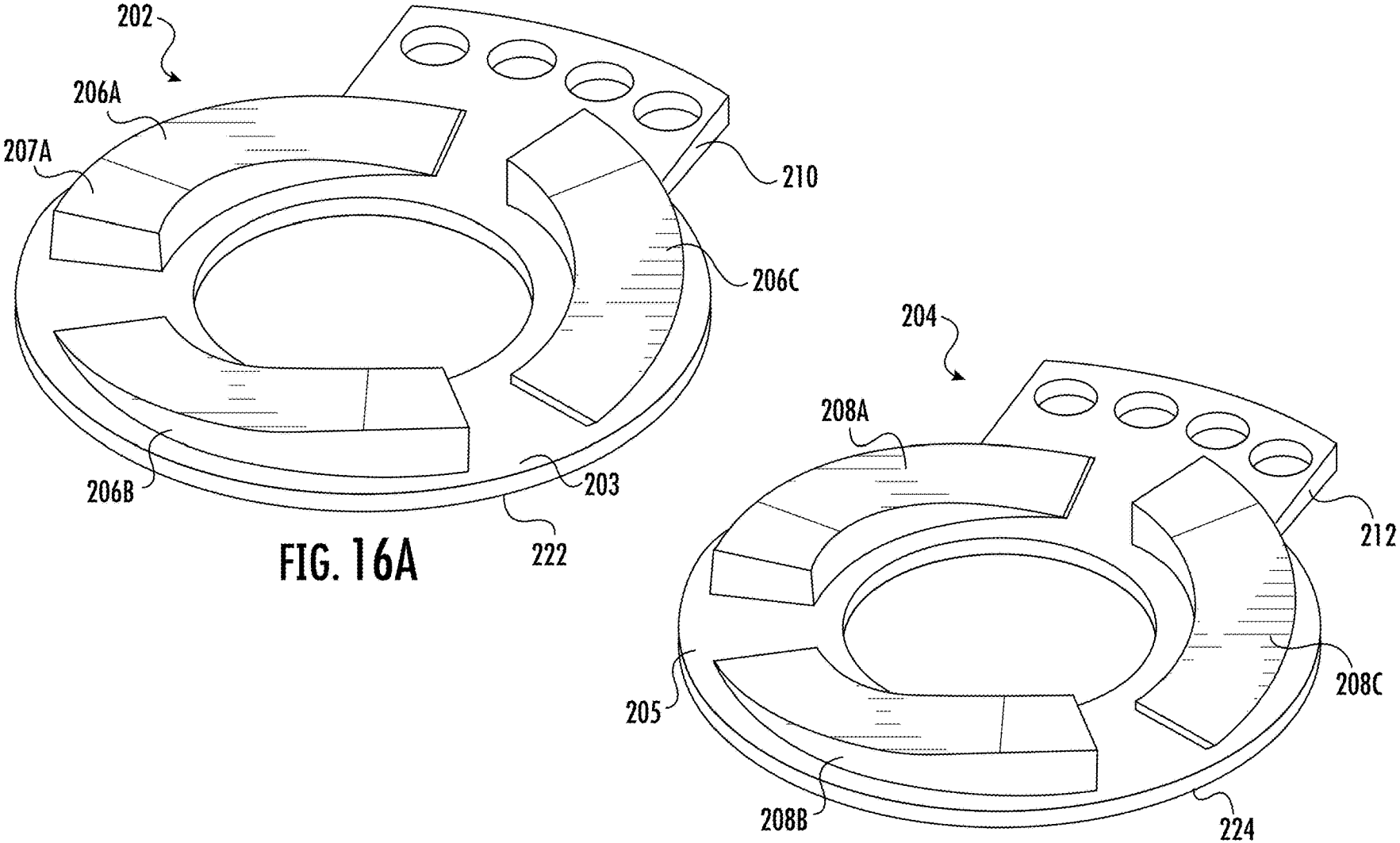
FIG. 16A is an enlarged version of FIG. 12C.
FIG. 16B is an enlarged version of FIG. 12D.
Figure 17B:
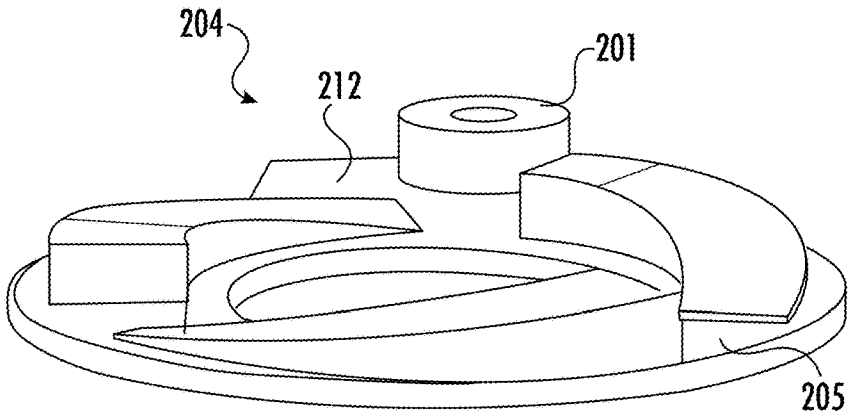
FIG. 17B is an enlarged version of FIG. 12K.
Figure 17A:
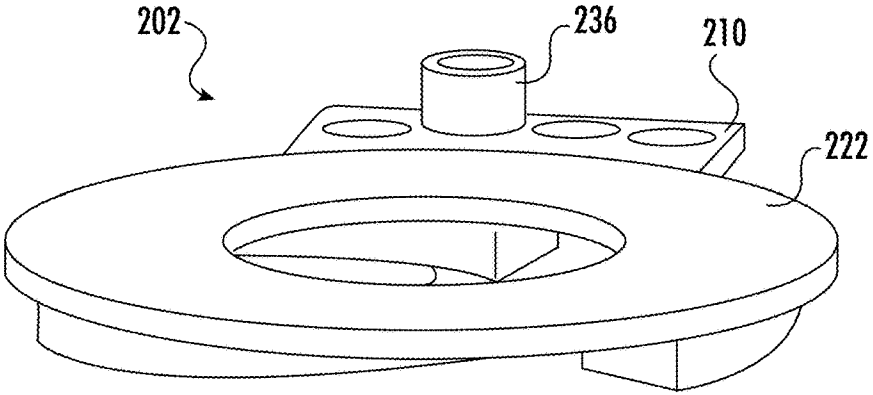
FIG. 17A is an enlarged version of FIG. 12J.
Figure 18:
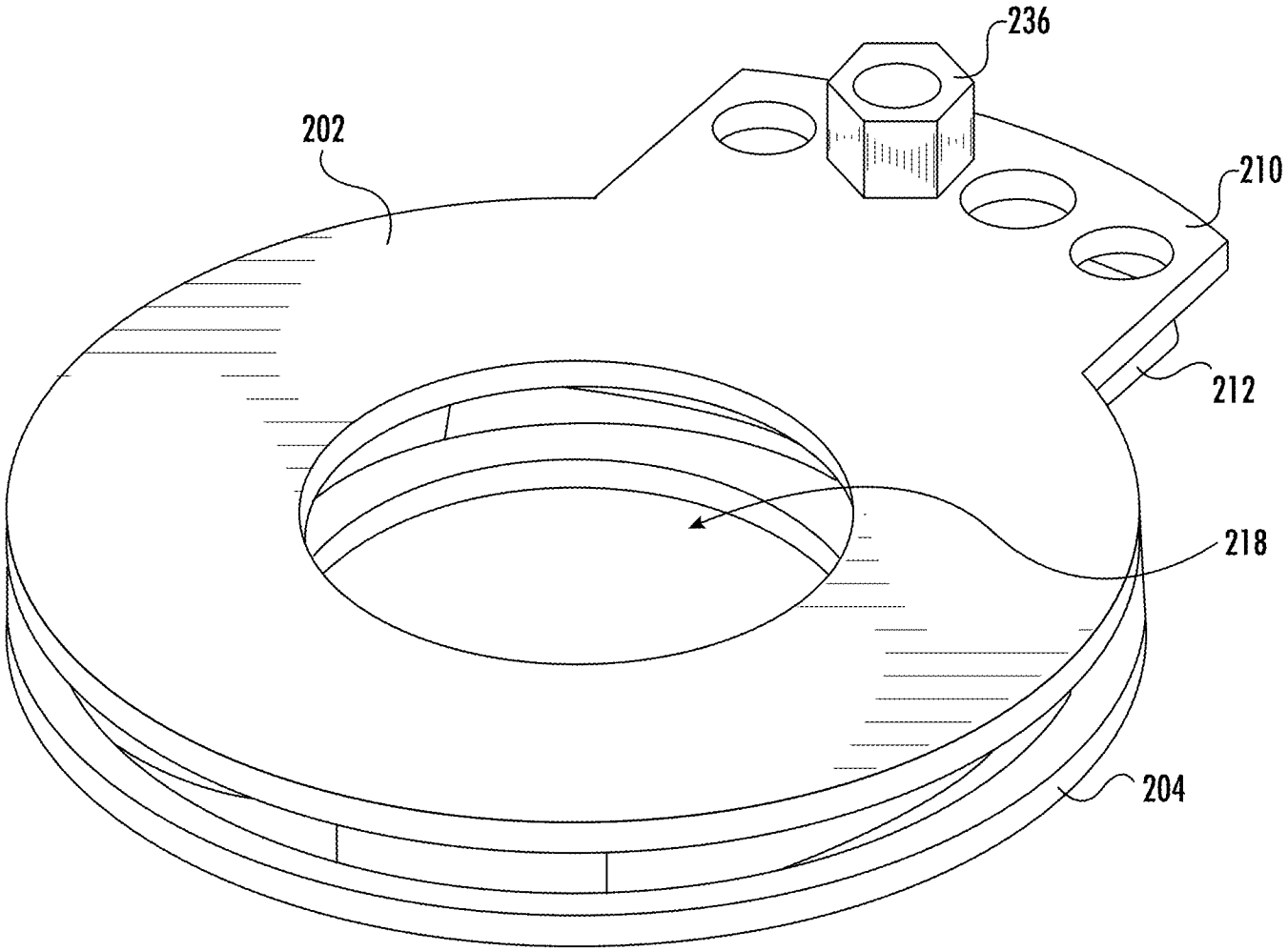
FIG. 18 is an enlarged version of FIG. 12G.
Figure 20B:
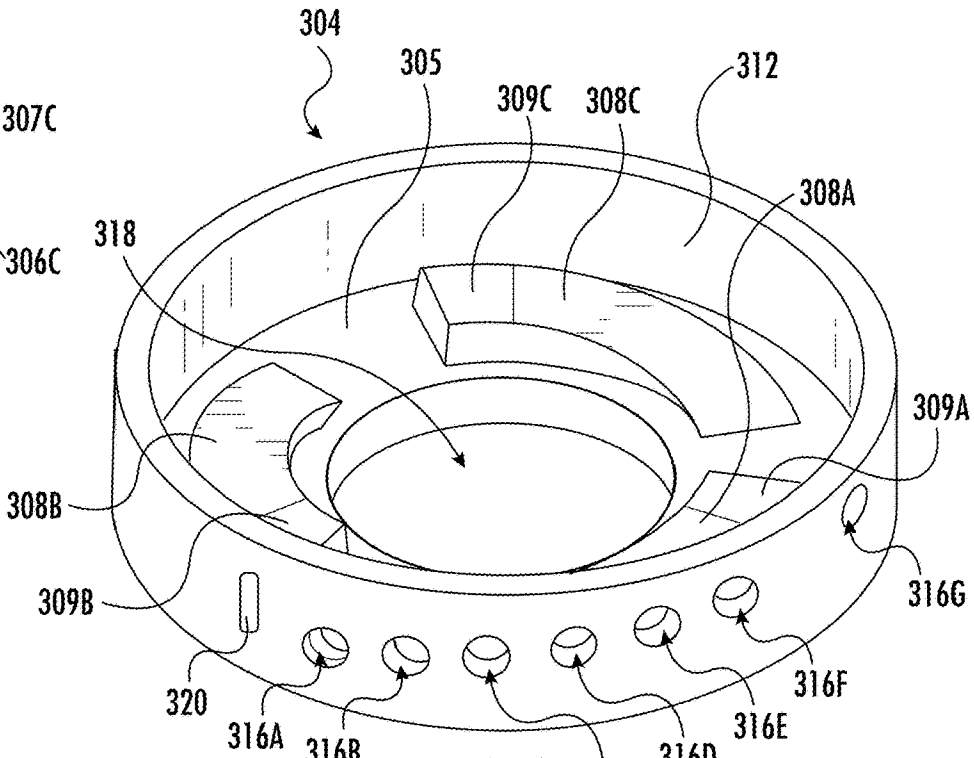
FIG. 20B is an enlarged version of FIG. 19D.
Figure 20A:
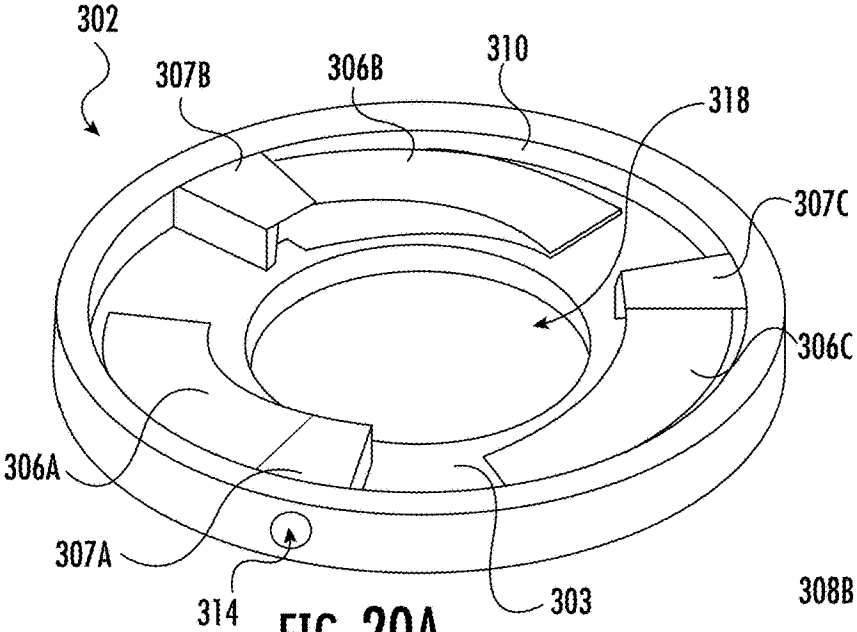
FIG. 20A is an enlarged version of FIG. 19C.

As illustrated in, for example, FIGS. 6 and 11, shim 100 be installed on an excavator 10. Excavator 10 includes a stick or arm 12 including a shaft or pin 20 on which shim 100 can be mounted. Shim 100 can be positioned to take up space on the pin 20 between, for example, stick 12 and a bucket, thumb, or other attachment. For example, outside surfaces of shim 100 can contact outside surface 70 of stick 12 (at or near where pin 20 connects to stick 12) and inside surface 72 of bucket 22. As another example, outside surfaces of shim 100 can contact outside surface 78 of bucket 22 and a spacer or bushing 74 associated with thumb 24. Outside surfaces of shim 100 could also contact inside surface 76 of thumb 24. Shim 100 can also be positioned, for example, between attachments. Shim 100 can further include a bolt, pin, clip, screw, or other fastener 14. The bolt can engage the first plate 102 and second plate 104. The bolt can limit relative rotation between the two plates and fix them together. The relative rotation between the plates can set the thickness of shim 100. A nut 16 can be used to secure bolt 14. The multiple holes in the plates permit the bolt to be moved to facilitate adjustment of the shim and change its thickness depending on the user's application.

Figure 10:
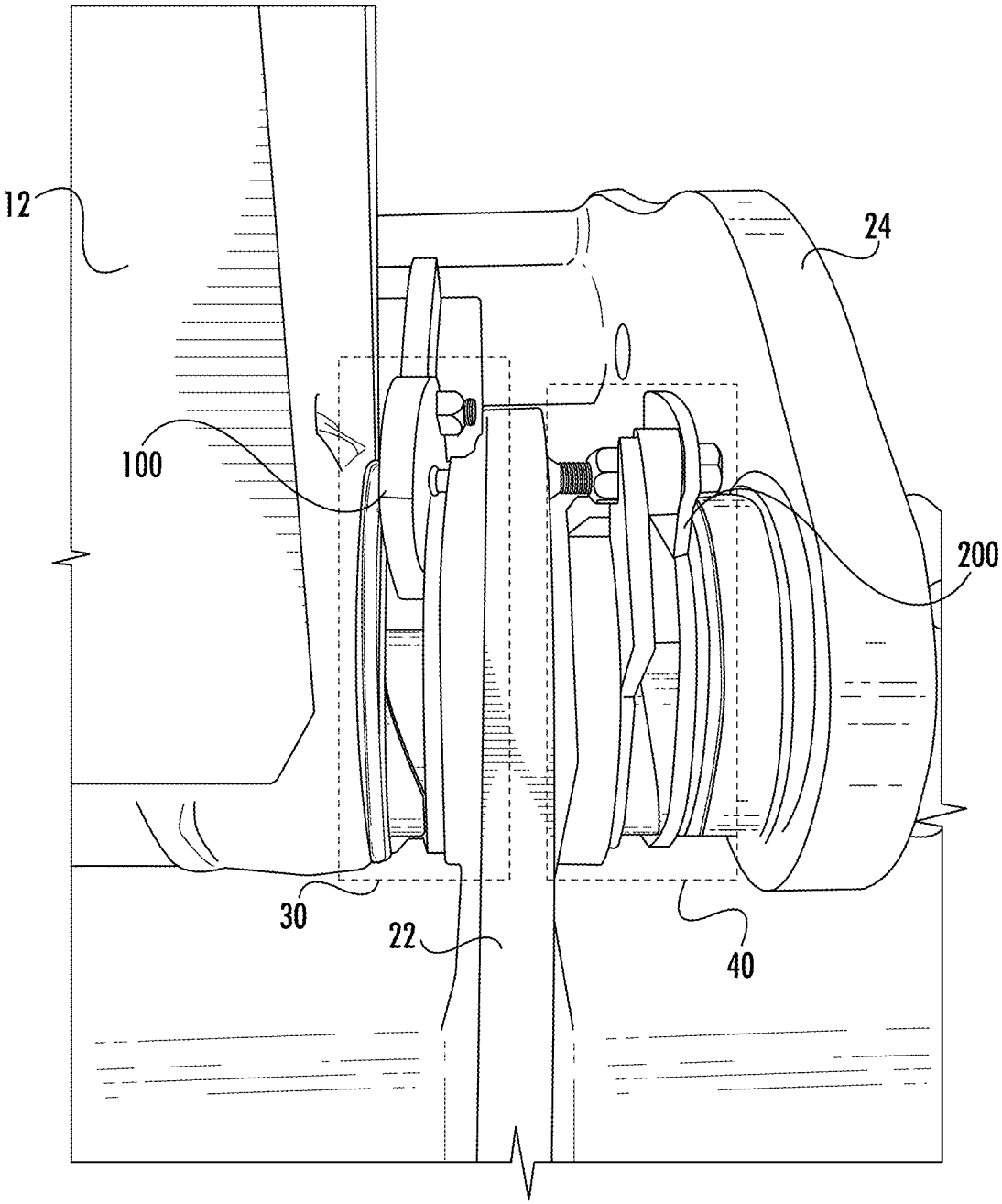
FIG. 10 is an illustration depicting two different embodiments of example expandable shims in accordance with the present disclosure installed on an excavator.

As illustrated in FIGS. 10 and 11, shim 100 can be installed in various locations on equipment, such as at the interface of an excavator stick and bucket or thumb. Location 30 is between an excavator stick 12 and bucket connection 22. Location 40 is between bucket connection 22 and thumb 24. Both FIGS. 10 and 11 illustrate installation of two different embodiments of an expandable shim, shim 100 and shim 200. Shim 200 is described in greater detail below.

More specifically, one of the wedges can include a protruding portion extending beyond the outer edges of the plates. For example, as shown in FIGS. 1-4 and 7, wedges 111, 113 can include a protruding portion 110, 112. Each protruding portion 110, 112 can include a plurality of holes 114 A-E, 116 A-E. Holes 114, 116 can be configured to receive a bolt, the bolt extending through both plates 102, 104 and fixing the rotational orientation of the plates 102, 104 with respect to one another. Alignment of one of holes 114A-E with one of holes 116A-E and securing a bolt through both holes will lock the shim 100 in a particular orientation corresponding to a particular thickness. The thicknesses at which the shim 100 is capable of being locked at will depend on the pitch of the wedges 106, 108, thickness of plates 102, 104, size of holes 114, 116 (and thus the size of the corresponding bolt), and the number and location of the holes 114, 116. For example, steeper wedges 106, 108 will result in a greater maximum thickness of shim 100. As another example, use of relatively smaller holes 114, 116 (and thus a smaller bolt) can permit more discrete lock points for shim 100, but the smaller bolt may limit the amount of compressive load the shim is able to withstand.

Figure 32:
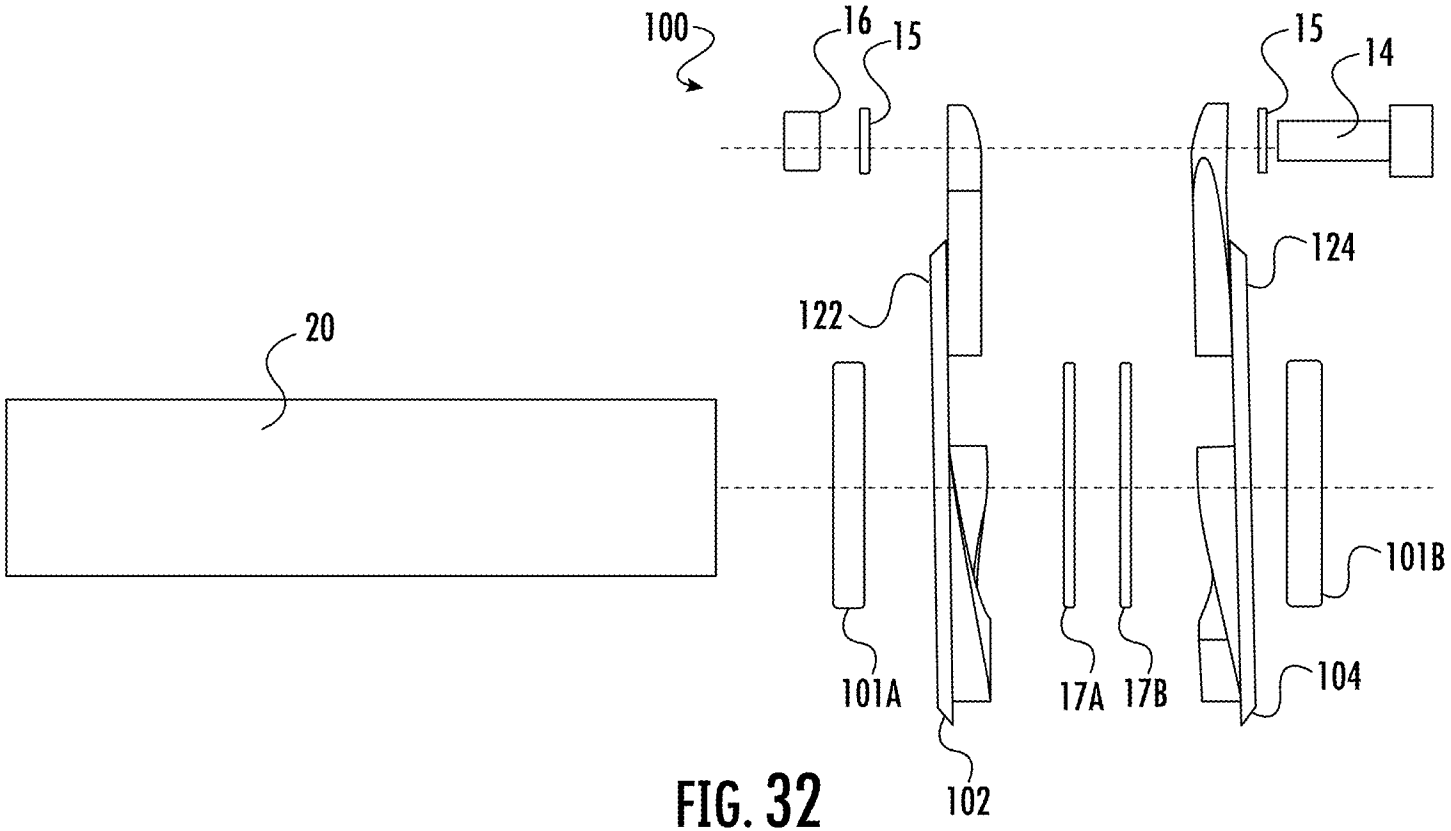
FIG. 32 is an exploded side view of the adjustable shim of the first embodiment in combination with an excavator pin.
Figure 43:
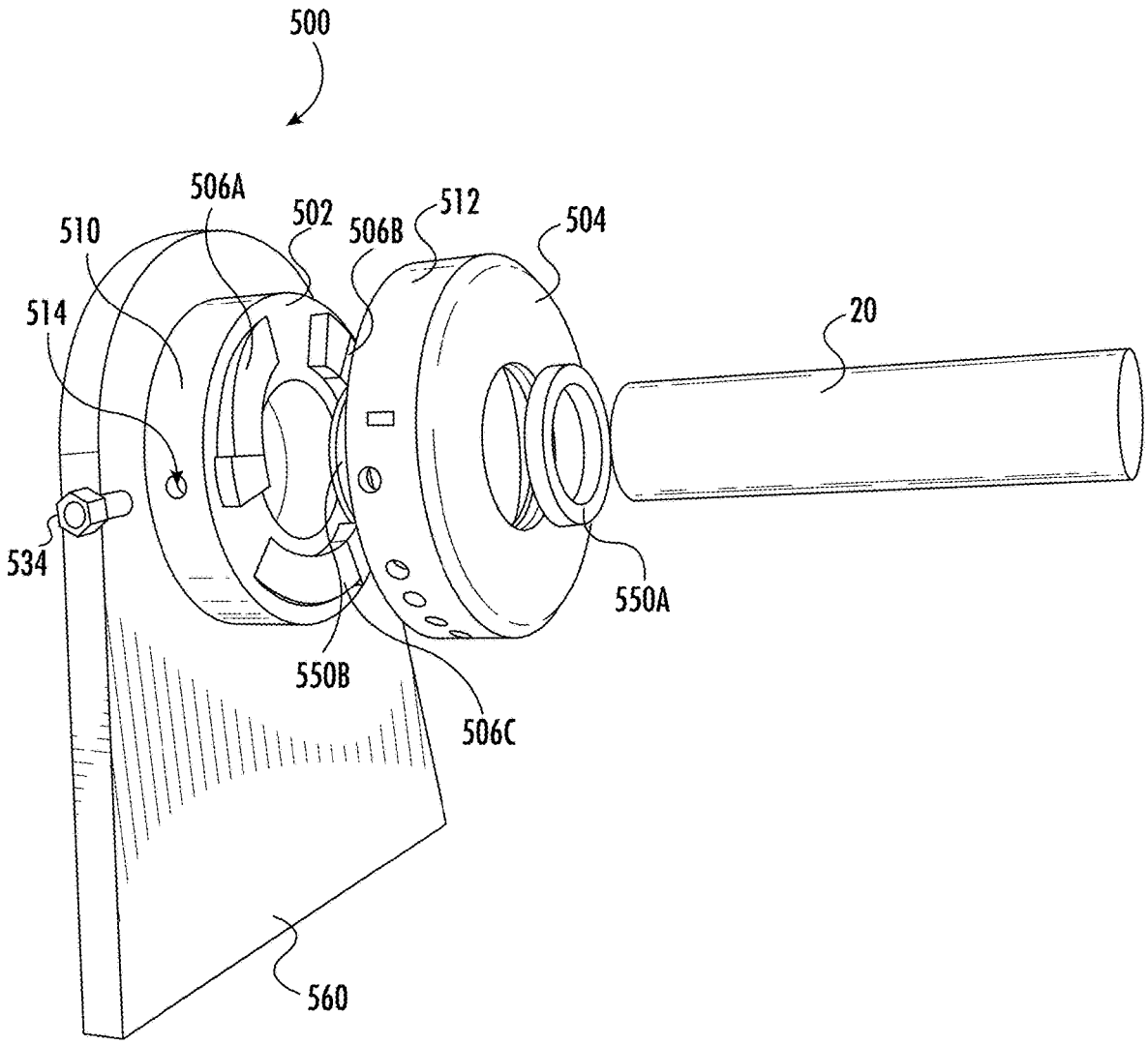
FIG. 43 is an exploded view of a sixth embodiment of an expandable shim.

FIGS. 32, 37A-G, 38A-B, 39A-B, 40A-B, 41A-B, and 42 illustrate a similar alternative embodiment incorporating a center bushing. FIG. 32 is an exploded view of a shim 100 using a center bushings 101A, 101B installed on an excavator pin 20. Bushings 101A, 101B can permit shim 100 to be installed on pins of varying sizes or shapes. For example, pin 20 may have a smaller diameter than aperture 118. Accordingly, bushings 101A, 101B can have inside diameters corresponding to pin 20 (and smaller than aperture 118). As another example, pin 20 could have a different cross-sectional shape than apertures 118, such as a smaller square. Bushings 101A, 101B could have internal aperture 119A, 119B in the shape of a square to match pin 20, while apertures 118 could remain circular. As illustrated in FIGS. 32, 43A, and 43, bushings 101A, 101B can be secured in plates 102, 104 using snap rings 17A, 17B or other retention methods. Snap rings 17A, 17B can engage with recessed 121A, 121B of bushings 101A, 101B to secure the bushings to their respective plate of the shim 100. As described above, shim 100 can be adjusted and secured in a particular position with bolt 14 and nut 16. Washers 15 can be placed between shim plates 102, 104, nut 16, and bolt 14.

FIGS. 12A-K, 13A-B, 14A-B, 15A-B, 16A-B, 17A-B, and 18 illustrate another example adjustable shim 200. Adjustable shim 200 includes a first plate 202 and a second plate 204. As shown in the figures, plates 202, 204 can have a circular or semi-circular shape. Each plate includes an aperture 218. Aperture 218 can be configured to receive a pin, for example, a pin of excavator stick. Aperture 218 permits shim 200 to be installed on a machine. As described in greater detail below, shim 200 can be used with one or more bushings to facilitate installation on pins having a different size or shape than aperture 218. For example, a bushing could be used to permit shim 200 to be installed on a pin having a diameter smaller than the diameter of aperture 218. Each plate 202, 204 has an outside surface 222, 224 and an inside surface 203, 205. The inside surfaces include at least one wedge 206, 208. When the adjustable shim is in use, the inside surfaces 203, 205 will face each other and wedge 206 will contact corresponding wedge 208. The relative positioning of wedges (i.e., the relative rotational positioning of the plates 202, 204) will control the thickness of shim 200. The thickness of shim 200 can be the distance from outer surface 222 of plate 202 to outer surface 224 of plate 204. Put differently, the plurality of wedges of the first plate and the plurality of wedges of the second plate can be sized and positioned such that relative rotation between the first plate and the second plate changes the distance between the outside surface of the first plate and the outside surface of the second plate.

Each plate 202, 204 can include a plurality of wedges. For example, as shown in FIGS. 13A-B and 16A-B, plates can include three wedges 206A-C and 208A-C. Of course, while the figures depict plates with three wedges, plates with one, two, four, or more wedges could be constructed. When plates include a plurality of wedges, the wedges can be equally sized and equally spaced radially on the plate. For example, as shown in the figures with plates having three wedges, the starting and ending edges of the wedges can be spaced 120 degrees apart from each other. As another example, plates could include two wedges spaced 180 degrees apart or four wedges spaced 90 degrees apart. The symmetry and equal sizing of the wedges facilitates even load distribution throughout the shim and ensures that the outer surfaces 222, 224 remain parallel to each other when the shim 200 is in use.

The inclined planes of the opposing wedges contact each other. Using the orientation depicted in FIG. 18, as the top plate (plate 202) is rotated clockwise, the shim will expand. Put differently, the thicket parts of both wedges will be contacting each other as plate 202 moves clockwise with respect to plate 204. The opposite is also true: as plate 202 moves counterclockwise with respect to plate 204 the thickness of shim 100 will decrease. The shim will reach its maximum expansion point (maximum thickness) when flat wedge surfaces 207, 209 of plates 202, 204 are in contact with one another. The shim will be at its minimum thickness when flat wedge surface 209 of plate 204 contacts inside surface 203 of plate 202 (and opposing flat wedge surface 207 of plate 202 contacts inside surface 205 of plate 204). Flat wedge surfaces 207, 209 at the end of the wedges provide robust bearing support when the adjustable shim 200 is fully expanded or fully contracted. This design ensures a stable and even distribution of forces, enhancing the shim's durability under operational stresses.

As illustrated in, for example, FIGS. 10 and 11, shim 200 can be installed on an excavator 10. As described above with respect to shim 100, shim 200 can be positioned to take up space on the pin 20 between, for example, stick 12 and a bucket, thumb, or other attachment. Shim 200 can also be positioned, for example, between attachments.

Shim 200 can further include a bolt 234. The bolt can engage the first plate 202 and second plate 204 at flat plate protrusions 210, 212. Flat plate protrusions 210, 212 can extend from plates 202, 204 and each contain a plurality of holes. The holes can receive bolt 234 to limit relative rotation between the two plates and fix them together. The relative rotation between the plates can set the thickness of shim 200. A nut 236 can be used to secure bolt 234. The multiple holes in the plates permit the bolt to be moved to facilitate adjustment of the shim and change its thickness depending on the user's application. A spacer 201 can be disposed between inner surfaces of flat plate protrusions 210, 212 to provide support to the flat plate protrusions 210, 212. Additional or different sized spacers 201 can be used to provide support to the flat plate protrusions when the shim is adjusted to different thicknesses. For example, when the shim is adjusted to a slightly thicker position, a second relatively thin spacer may be used together with illustrated spacer 201 to adequately fill the space between flat plate protrusions 210, 212.

The thicknesses at which the shim 200 is capable of being locked at will depend on the pitch of the wedges 206, 208, thickness of plates 202, 204, size of holes 214, 216 (and thus the size of the corresponding bolt), and the number and location of the holes 214, 216. For example, steeper wedges 206, 208 will result in a greater maximum thickness of shim 200. As another example, use of relatively smaller holes 214, 216 (and thus a smaller bolt) can permit more discrete lock points for shim 200, but the smaller bolt may limit the amount of compressive load the shim is able to withstand. This type of design with flat plate protrusions and a spacer can be potentially more simple and cheaper to manufacture than for example, shim 100 with extended wedges. Additionally, this embodiment can have further advantages in that the smaller wedges will result in a lighter and more compact shim.

Figure 31:
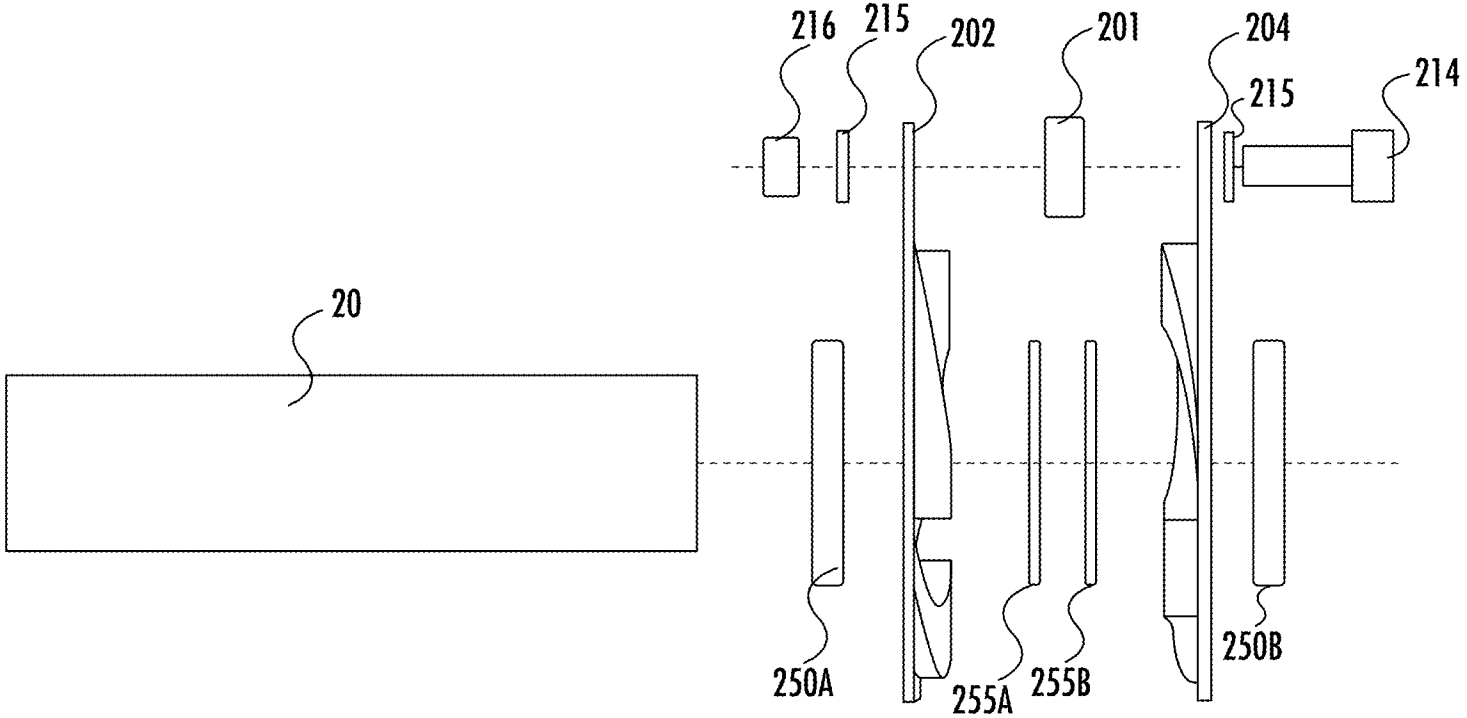
FIG. 31 is an exploded side view of the shim set, shim system, or adjustable shim, of the second embodiment in combination with an excavator pin.

FIG. 31 illustrates a similar alternative embodiment incorporating a center bushing. FIG. 31 is an exploded view of a shim 200 using a center bushings 250A, 250B installed on an excavator pin 20. Bushings 250A, 250B can permit shim 200 to be installed on pins of varying sizes or shapes. For example, pin 20 may have a smaller diameter than aperture 218. Accordingly, bushings 250A, 250B can have inside diameters corresponding to pin 20 (and smaller than aperture 218). As another example, pin 20 could have a different cross-sectional shape than apertures 218, such as a smaller square. Bushings 250A, 250B could have internal apertures in the shape of a square to match pin 20, while apertures 218 could remain circular. Bushings 250A, 250B can be secured in plates 202, 204 using snap rings 255A, 255B or other retention methods. Snap rings 255A, 255B can engage with recesses in bushings 250A, 250B to secure the bushings to their respective plate of the shim 200. As described above, shim 200 can be adjusted and secured in a particular position with bolt 234 and nut 236. Washers 215 can be placed between shim plates 202, 204, nut 236, and bolt 234.

FIGS. 19A-G, 20A-B, 21A-B, 22, 23A-B, 24A-B, and 33 illustrate another example adjustable shim 300. Adjustable shim 300 includes a first plate 302 and a second plate 304. As shown in the figures, plates 302, 304 can have a circular or semi-circular shape. Each plate includes an aperture 318. Aperture 318 can be configured to receive a pin, for example, a pin of excavator stick. Aperture 318 permits shim 300 to be installed on a machine. As described in greater detail below, shim 300 can be used with one or more bushings to facilitate installation on pins having a different size or shape than aperture 318. For example, a bushing could be used to permit shim 300 to be installed on a pin having a diameter smaller than the diameter of aperture 318. Each plate 302, 304 has an outside surface 322, 324 and an inside surface 303, 305. Plate 302 has a side wall 310, and plate 304 has a side wall 312. Side walls 310, 312 can be cylindrical side walls that form a cavity. Inside surfaces 303, 305 include at least one wedge 306, 308. Side wall 312 can act as a protective outer ring to prevent dirt and debris from entering the shim and effecting the contact points between the plate wedges. Wedges 306, 308 can be disposed within the cavity formed by sidewalls 310, 312. When the adjustable shim is in use, the inside surfaces 303, 305 will face each other and wedge 306 will contact corresponding wedge 308. The relative positioning of wedges (i.e., the relative rotational positioning of the plates 302, 304) will control the thickness of shim 300. The thickness of shim 300 can be the distance from outer surface 322 of plate 302 to outer surface 324 of plate 304. Stated differently, the plurality of wedges of the first plate and the plurality of wedges of the second plate can be sized and positioned such that relative rotation between the first plate and the second plate changes the distance between the outside surface of the first plate and the outside surface of the second plate.

Each plate 302, 304 can include a plurality of wedges. For example, as shown in FIGS. 21A-B and 22A-B, plates can include three wedges 306A-C and 308A-C. Of course, while the figures depict plates with three wedges, plates with one, two, four, or more wedges could be constructed. When plates include a plurality of wedges, the wedges can be equally sized and equally spaced radially on the plate. For example, as shown in the figures with plates having three wedges, the starting and ending edges of the wedges can be spaced 120 degrees apart from each other. As another example, plates could include two wedges spaced 180 degrees apart or four wedges spaced 90 degrees apart. The symmetry and equal sizing of the wedges facilitates even load distribution throughout the shim and ensures that the outer surfaces 322, 324 remain parallel to each other when the shim 300 is in use.

The inclined planes of the opposing wedges contact each other. Using the orientation depicted in FIG. 22, as the top plate (plate 302) is rotated clockwise, the shim will expand. Stated differently, the thicket parts of both wedges will be contacting each other as plate 302 moves clockwise with respect to plate 304. The opposite is also true: as plate 302 moves counterclockwise with respect to plate 304 the thickness of shim 300 will decrease. The shim will reach its maximum expansion point (maximum thickness) when flat wedge surfaces 307, 309 of plates 302, 304 are in contact with one another. The shim will be at its minimum thickness when flat wedge surface 309 of plate 304 contacts inside surface 303 of plate 302 (and opposing flat wedge surface 307 of plate 302 contacts inside surface 305 of plate 304). Flat wedge surfaces 307, 309 at the end of the wedges provide robust bearing support when the adjustable shim 300 is fully expanded or fully contracted. This design ensures a stable and even distribution of forces, enhancing the shim's durability under operational stresses.

Figure 34:
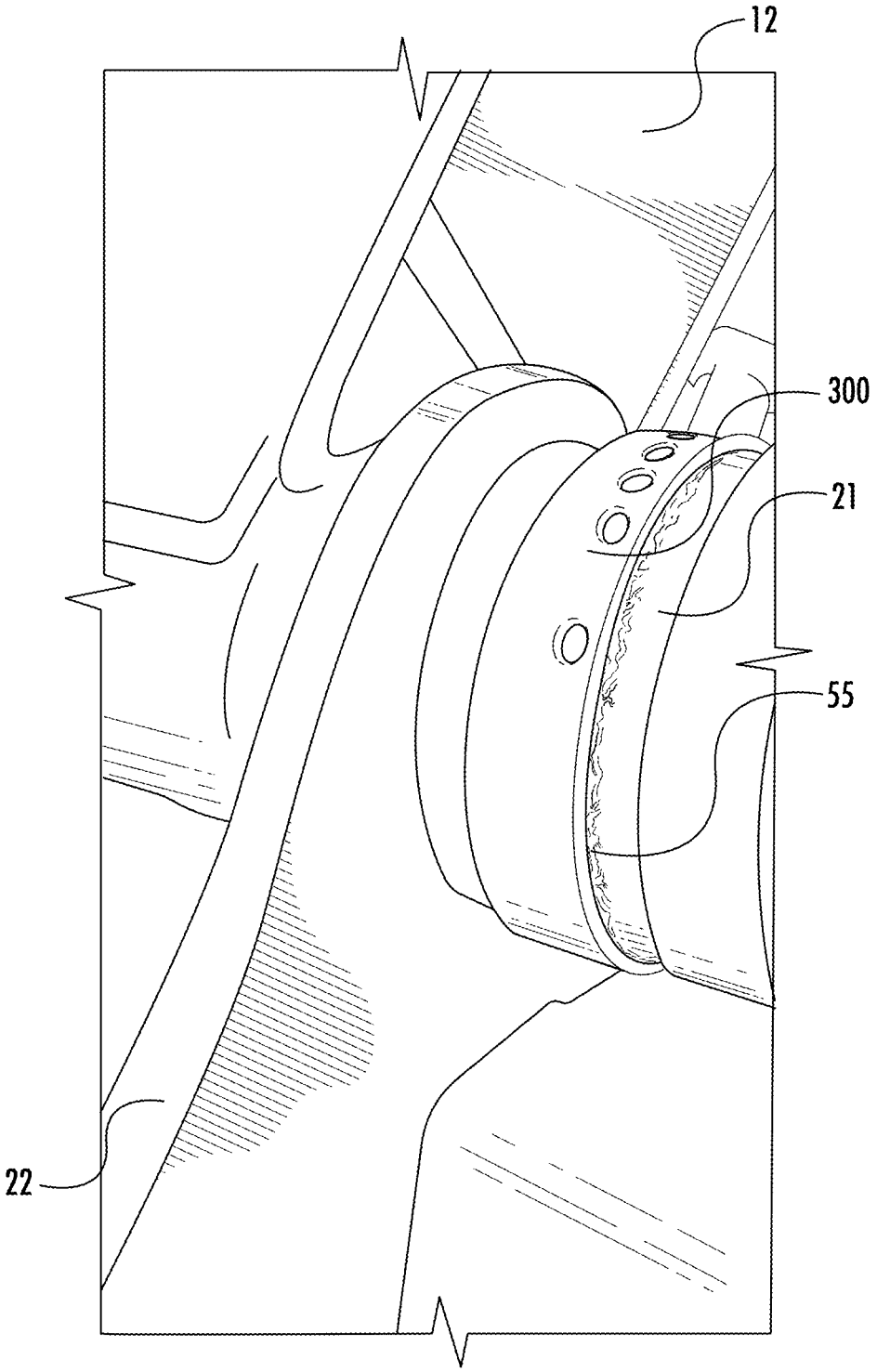
FIGS. 34-36 are illustrations of the adjustable shim of the third embodiment installed on an excavator.
Figure 35:
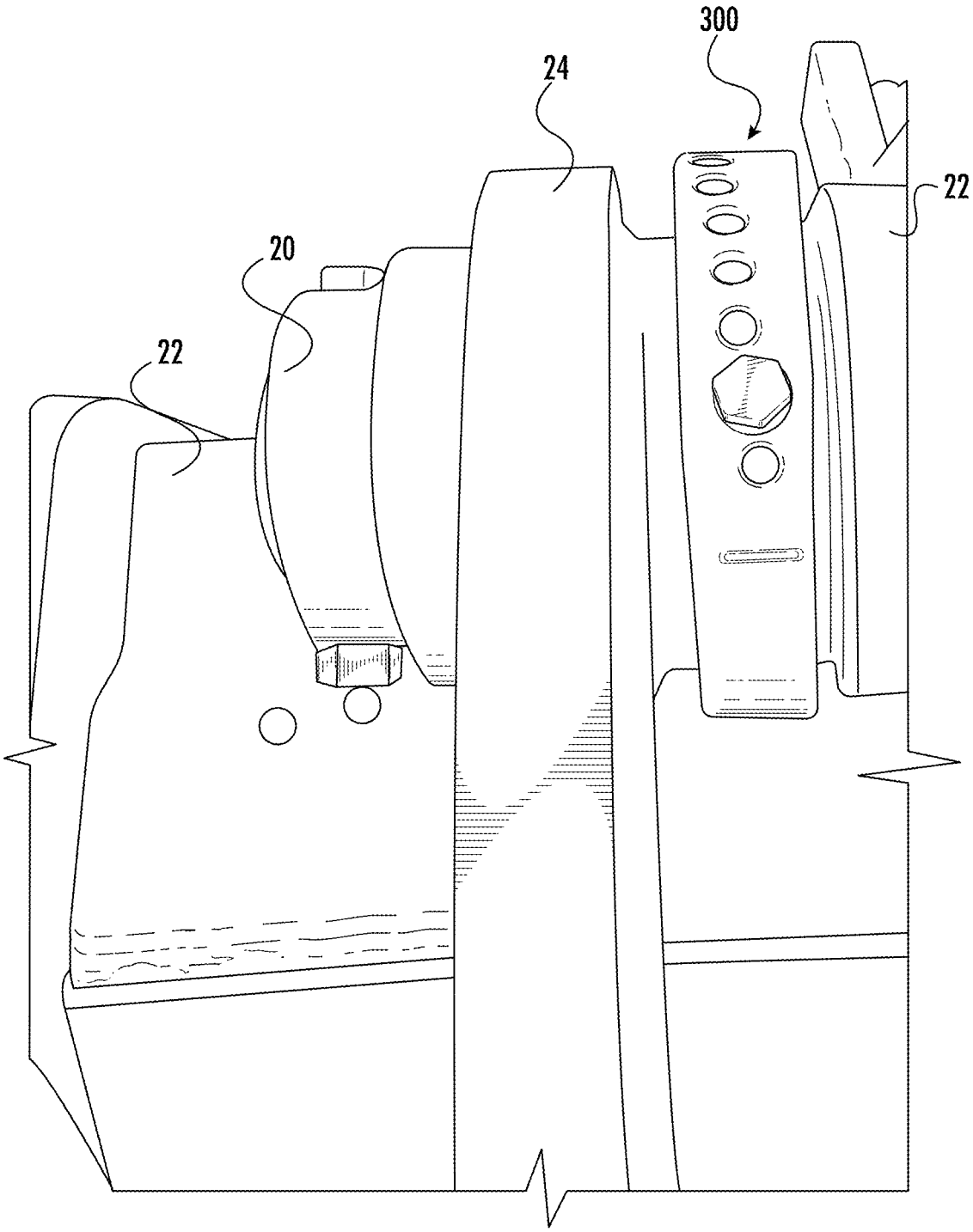
Figure 36:
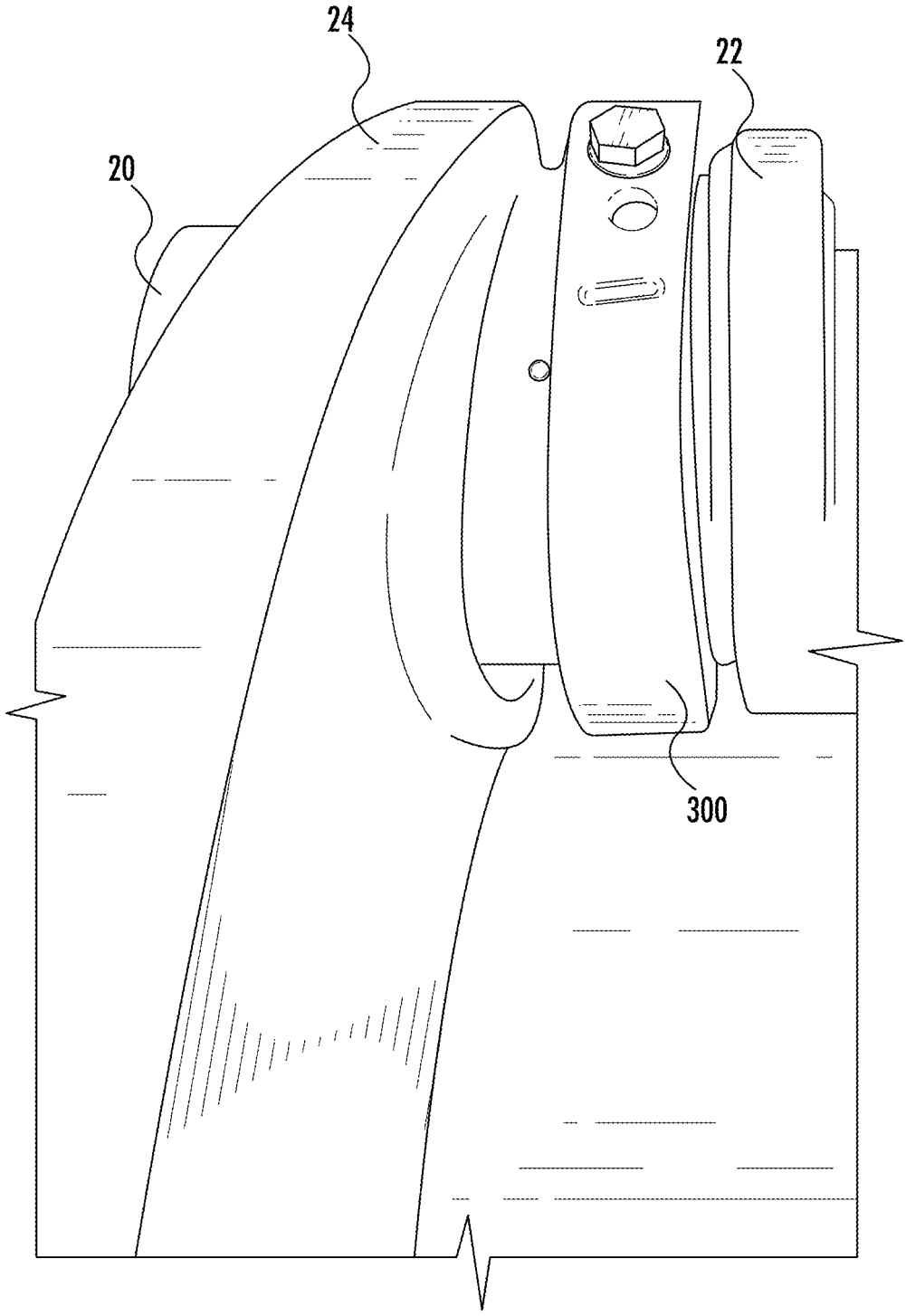
Figure 38B:
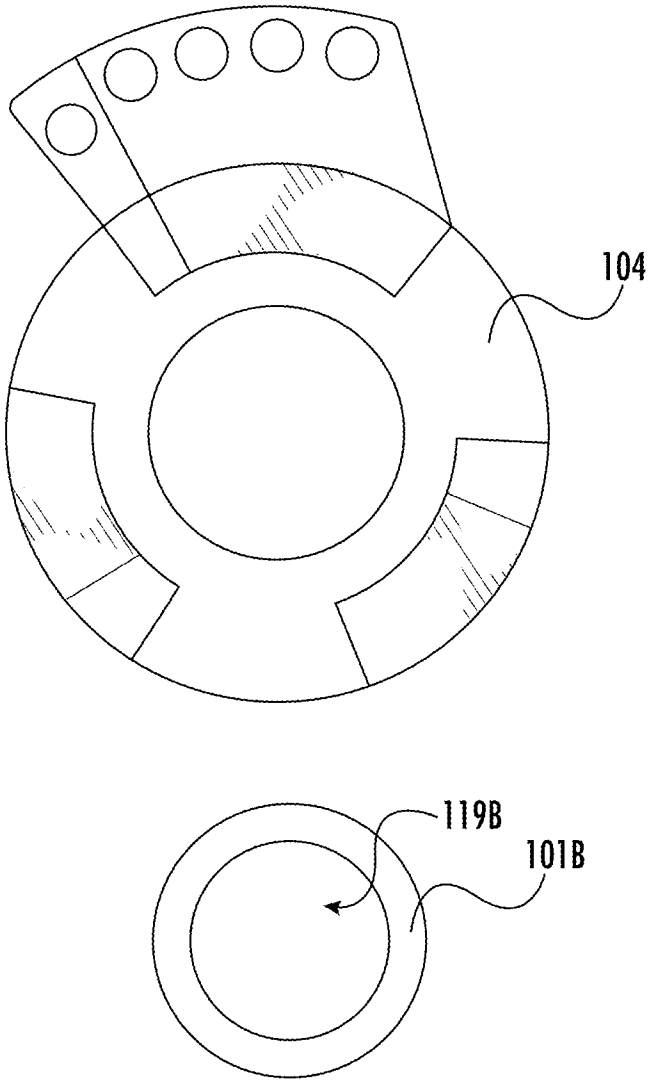
FIG. 38B is an enlarged version of FIG. 39B.
Figure 38A:
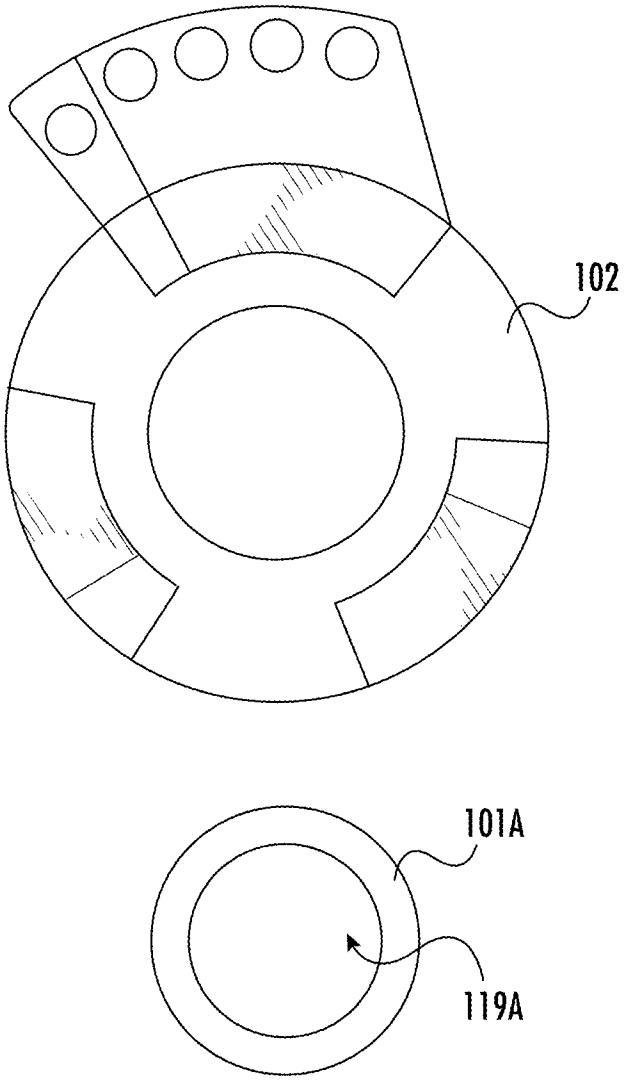
FIG. 38A is an enlarged version of FIG. 39A.
Figure 39B:
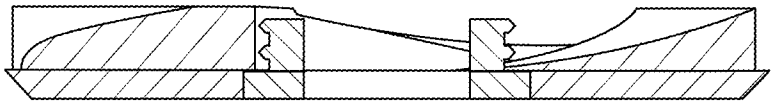
FIG. 39B is an enlarged version of FIG. 39F.
Figure 39A:
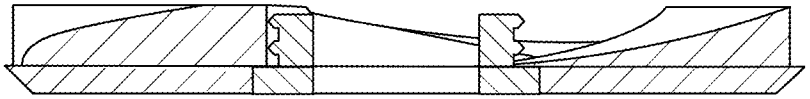
FIG. 39A is an enlarged version of FIG. 39E.
Figure 40B:
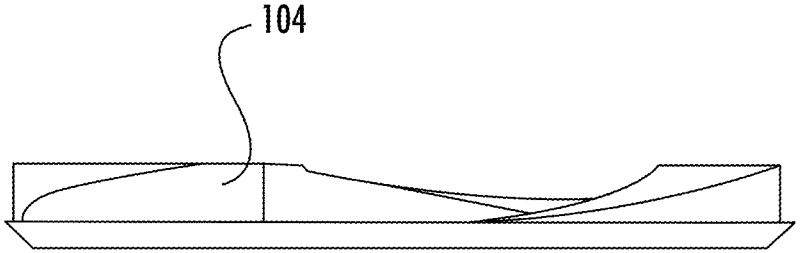
FIG. 40B is an enlarged version of FIG. 39I.
Figure 40A:
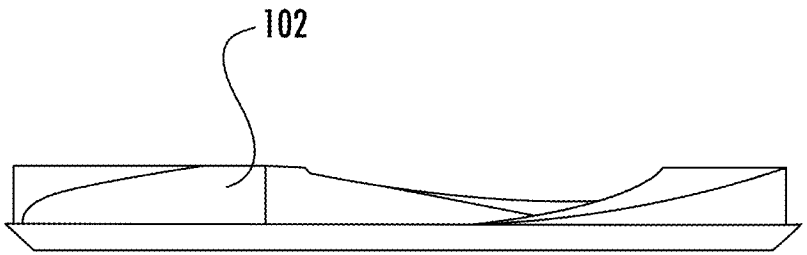
FIG. 40A is an enlarged version of FIG. 39H.
Figure 41B:
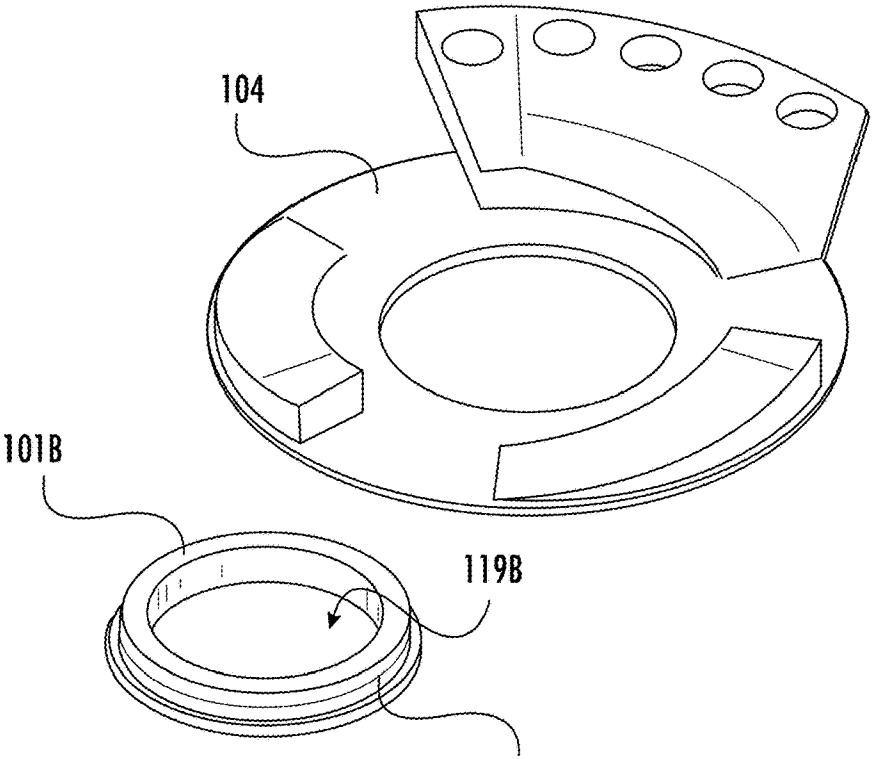
FIG. 41B is an enlarged version of FIG. 25D.
Figure 41A:
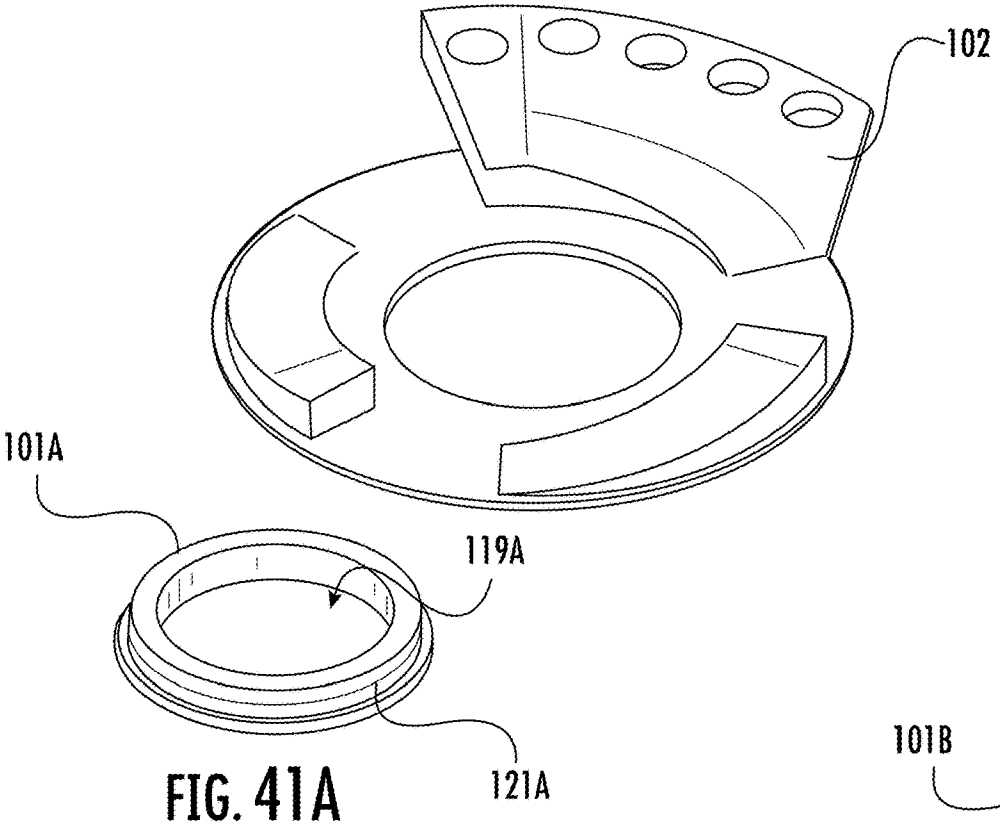
FIG. 41A is an enlarged version of FIG. 25C.
Figure 42:
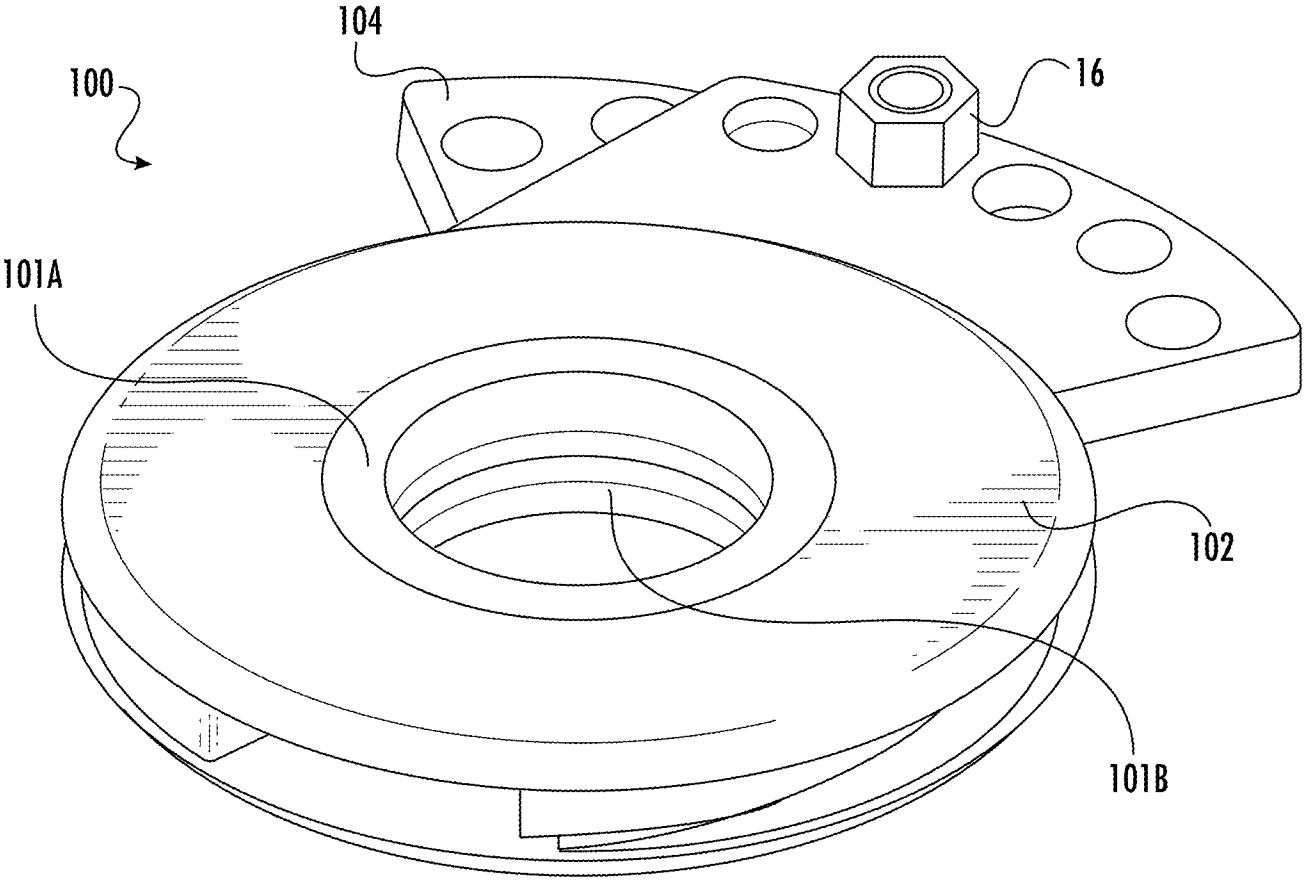
FIG. 42 is an enlarged version of FIG. 39G.

As illustrated in, for example, FIGS. 34-36, shim 300 can be installed on an excavator bucket/thumb pin. As described above with respect to shims 100, 200, shim 300 can be positioned to take up space on the pin 20 between, for example, stick 12 and a bucket 22, thumb 24, or other attachment. Shim 300 can also be positioned, for example, between attachments. More specifically, FIGS. 34-36 illustrate shim 300 installed between bucket 22 and thumb 24. FIG. 34 illustrates a weld bead 55 placed on the outside of plate 302, which secures plate 302 to the thumb 24. Specifically, plate 302 can be welded to the thumb boss 21. In the specific view of FIG. 34, the excavator pin is not visible, as it extends through thumb boss 21, shim 300, portion of bucket 22, and stick 12. In other embodiments, plate 302 could potentially be welded or otherwise attached to other components, such as bucket 22. However, both plates of shim 300 would not be rigidly attached to two different components at the same time because the attachment would cause relative rotation between the shim plates when the machine is operated, which would either bind the machine or break the shim 300 (for example, by shearing the bolt).

Shim 300 can further include a bolt 334. The bolt 334 can engage the first plate 302 and second plate 304. Hole 314 of plate 302 can be threaded to receive bolt 334, thereby limiting relative rotation between the two plates 302, 304 and fix them together. The relative rotation between the plates can set the thickness of shim 300. The multiple holes in the plates permit the bolt to be moved to facilitate adjustment of the shim and change its thickness depending on the user's application. The enclosed design of shim 300 provides a more compact shim package while also providing additional protection for the wedges from dirt, debris, and other potential impacts associated with use. Additionally, side wall 312 can include one or more notches 320 that can be used to orient plate 304 with respect to an excavator pin, for example by using a flat screwdriver or specially designed adjustment tool to rotate plate 304 using the notch.

Each of holes 316A-G can be configured to receive bolt 334, the bolt extending through both plates 302, 304 and fixing the rotational orientation of the plates 302, 304 with respect to one another. Alignment of holes 314 of plate 302 with one of holes 316A-G and securing a bolt through both holes will lock the shim 300 in a particular orientation corresponding to a particular thickness. The thicknesses at which the shim 300 is capable of being locked at will depend on the pitch of the wedges 306, 308, thickness of plates 302, 304, size of holes 316A-G (and thus the size of the corresponding bolt), and the number and location of the holes 316A-G. For example, steeper wedges 306, 308 will result in a greater maximum thickness of shim 300. As another example, use of relatively smaller holes 314, 316 (and thus a smaller bolt) can permit more discrete lock points for shim 300, but the smaller bolt may limit the amount of compressive load the shim is able to withstand. The positions of holes 316A-G on side wall 312 will change based on the position in which they are intended to lock shim 300. For example, holes closer to the open end of plate 304 will lock shim 300 in a thicker position than holes closer to outside surface 324. Further, in some embodiments, plate 304 can include a continuous slot rather than individual discrete holes to permit finer adjustment of the shim to fit more scenarios.

Figure 21B:
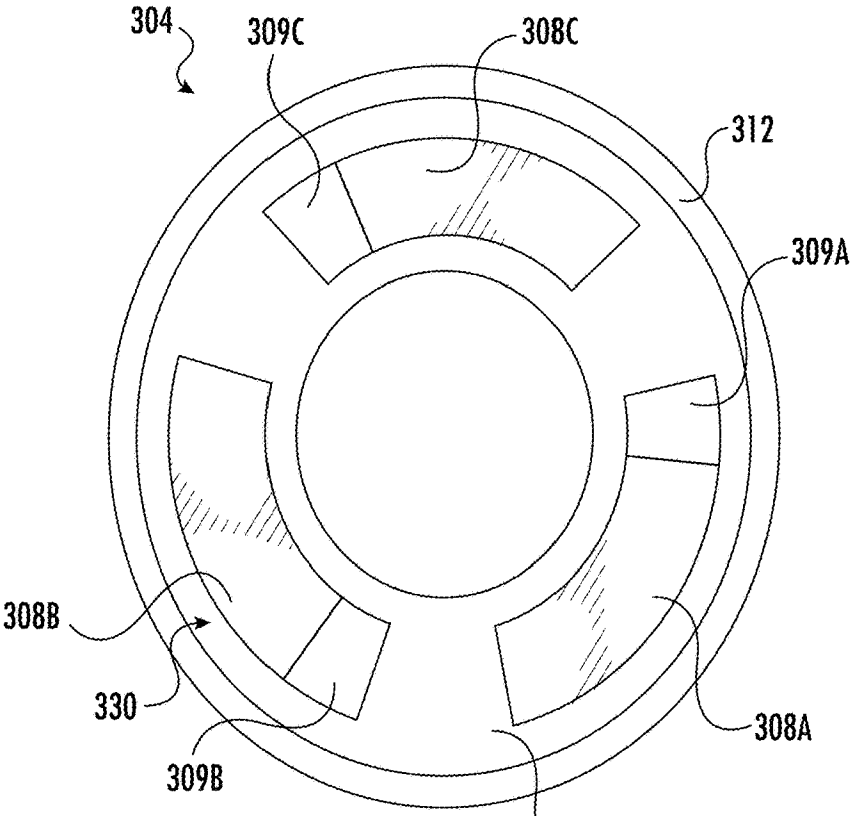
FIG. 21B is an enlarged version of FIG. 19B.
Figure 21A:
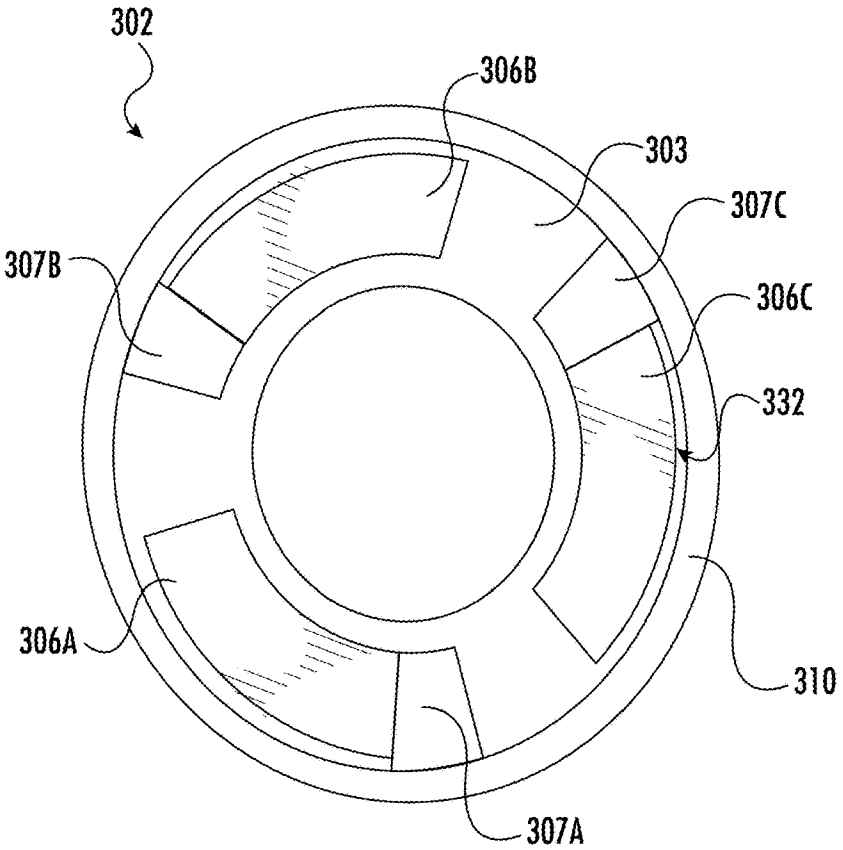
FIG. 21A is an enlarged version of FIG. 19A.
Figure 22:
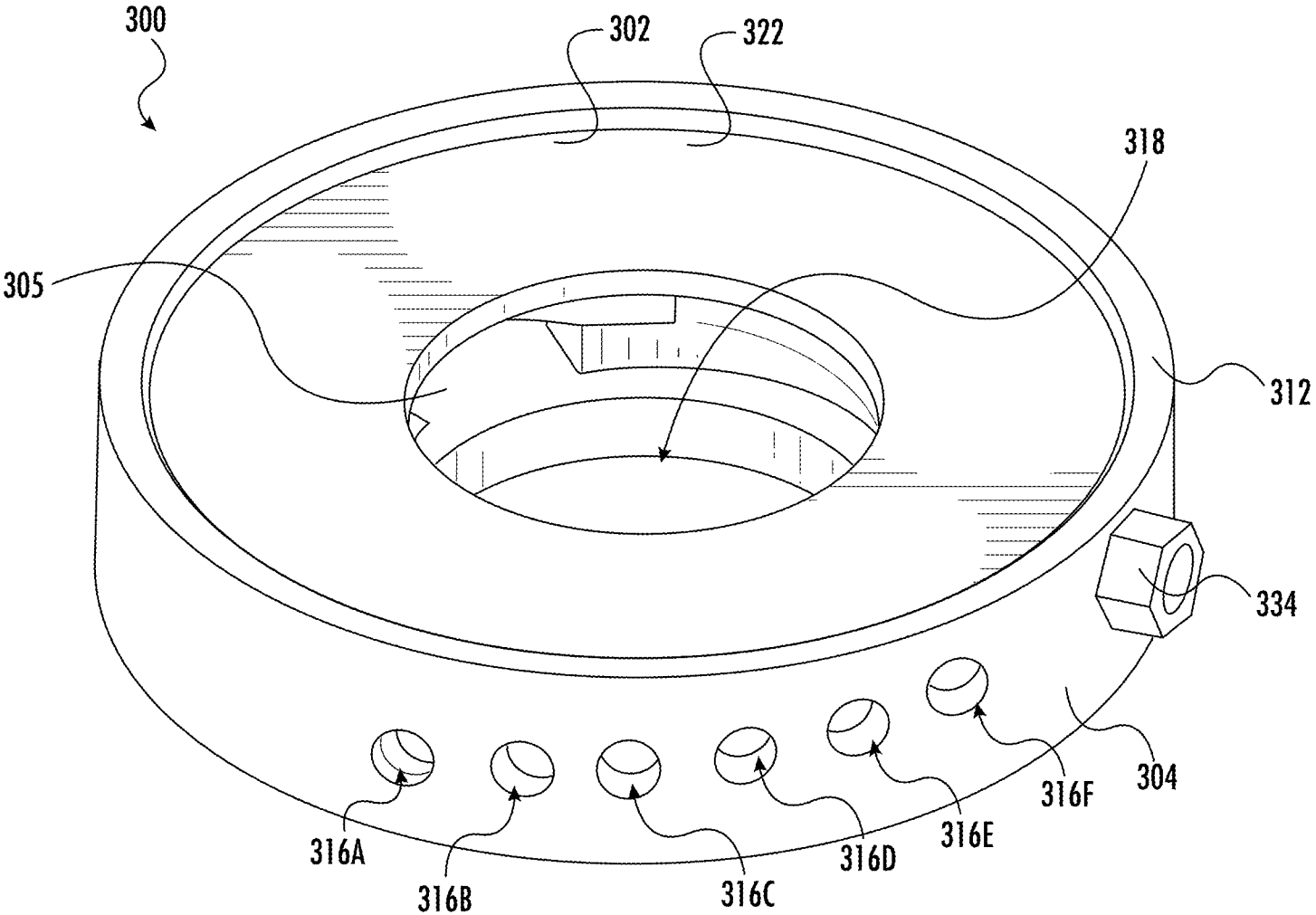
FIG. 22 is an enlarged version of FIG. 19G.
Figure 23B:
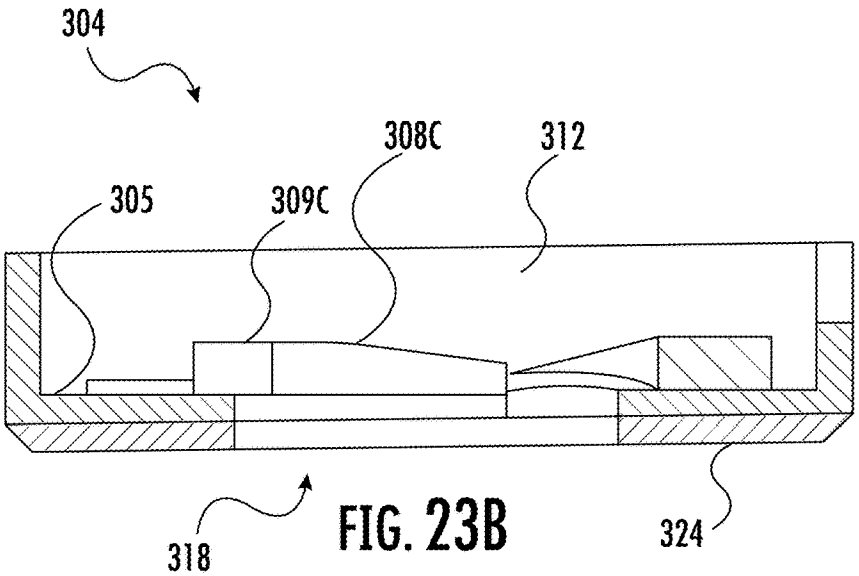
FIG. 23B is an enlarged version of FIG. 19F.
Figure 23A:
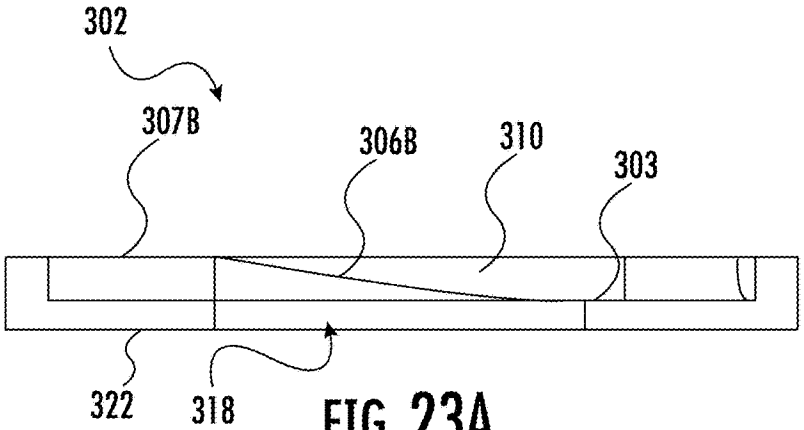
FIG. 23A is an enlarged version of FIG. 19E.
Figure 24B:
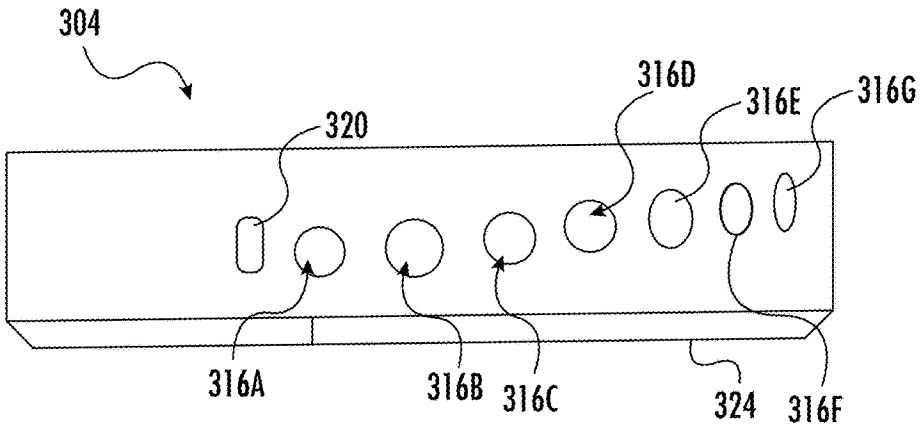
FIG. 24B is an enlarged version of FIG. 19I.
Figure 24A:
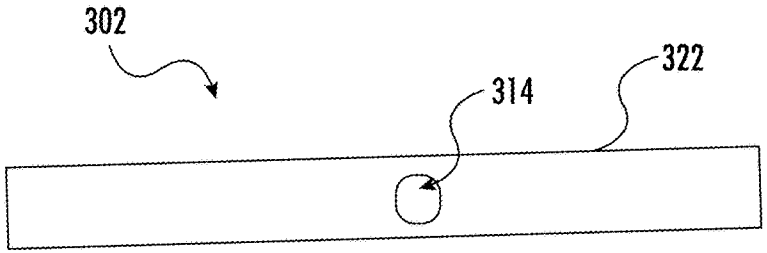
FIG. 24A is an enlarged version of FIG. 19H.
Figure 25D:
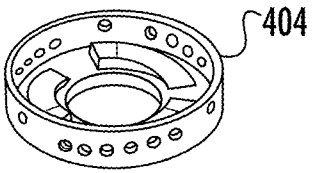
FIG. 25D is a perspective view of the second example plate of the fourth embodiment of an expandable shim of FIG. 25B.
Figure 25C:
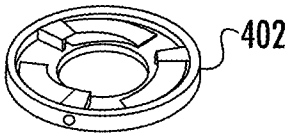
FIG. 25C is a perspective view of the example plate of the fourth embodiment of an expandable shim of FIG. 25A.
Figure 25G:
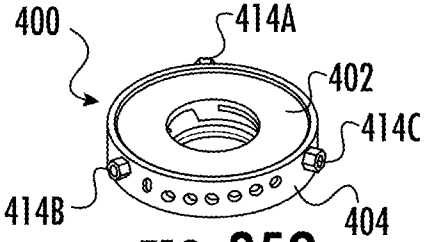
FIG. 25G is a perspective view of example assembled expandable shim according to the fourth embodiment.
Figure 25B:
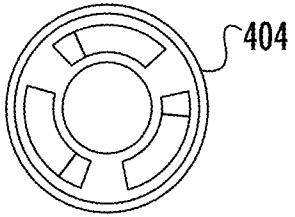
FIG. 25B is top view of second example plate of the fourth embodiment of an expandable shim.
Figure 25F:
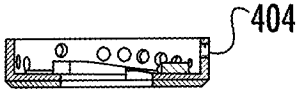
FIG. 25F is a cross-sectional side view of the second example plate of the fourth embodiment of an expandable shim of FIG. 25B.
Figure 25I:
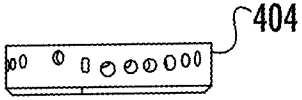
FIG. 25I is another side view of the second example plate of the fourth embodiment of an expandable shim of FIG. 25B.
Figure 25A:
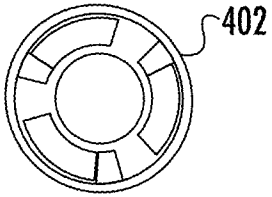
FIG. 25A is top view of another example plate of a fourth embodiment of an expandable shim.
Figure 25E:
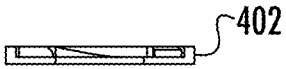
FIG. 25E is a cross-sectional side view of the example plate of the fourth embodiment of an expandable shim of FIG. 25A.
Figure 25H:
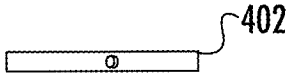
FIG. 25H is another side view of the example plate of the fourth embodiment of an expandable shim of FIG. 25A.
Figure 26B:
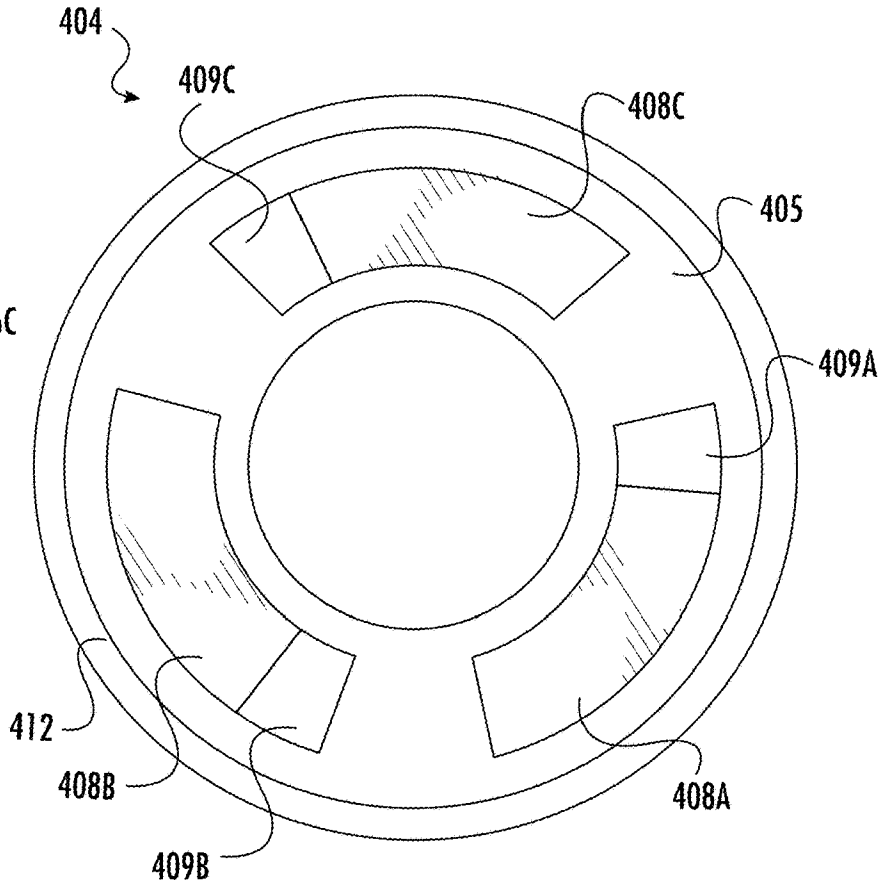
FIG. 26B is an enlarged version of FIG. 25B.
Figure 26A:
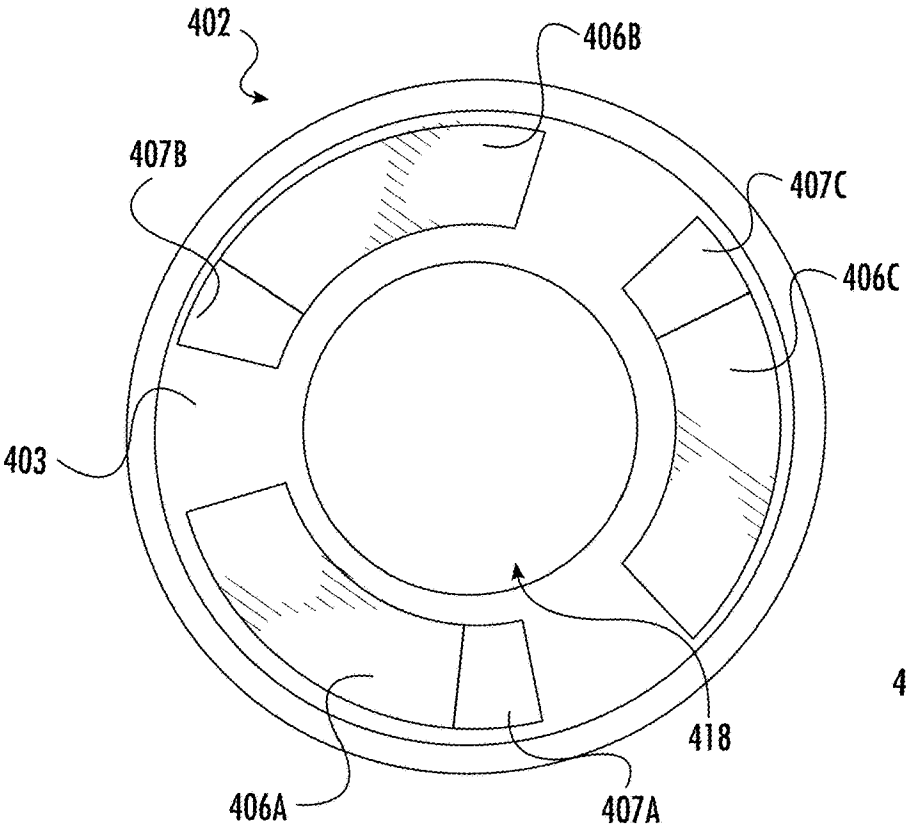
FIG. 26A is an enlarged version of FIG. 25A.
Figure 27B:
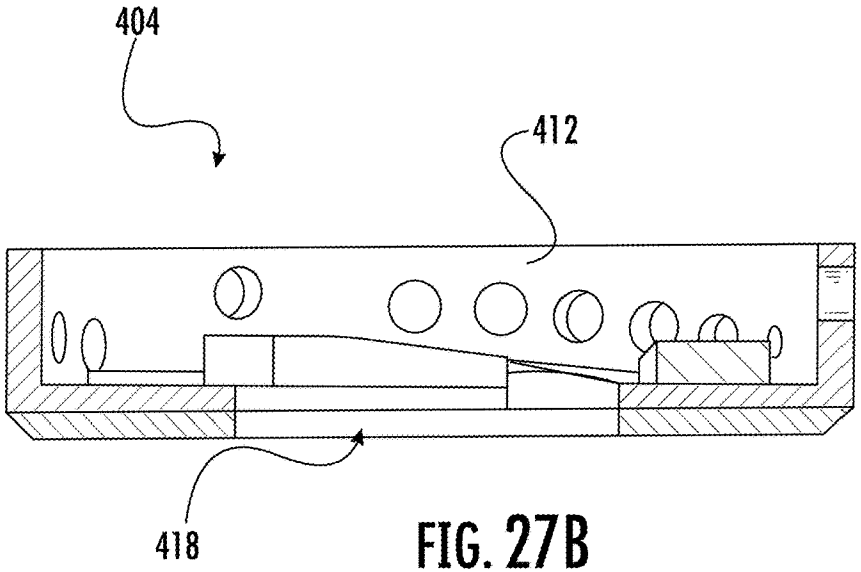
FIG. 27B is an enlarged version of FIG. 25F.
Figure 27A:
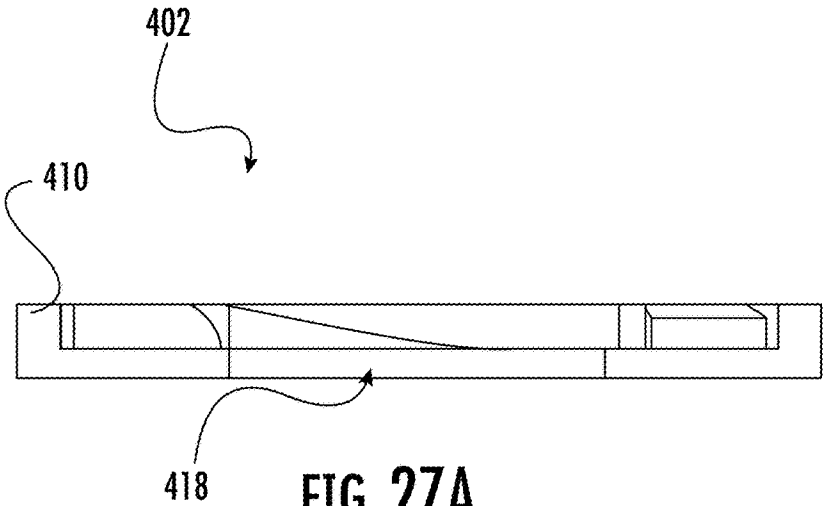
FIG. 27A is an enlarged version of FIG. 25E.
Figure 28B:
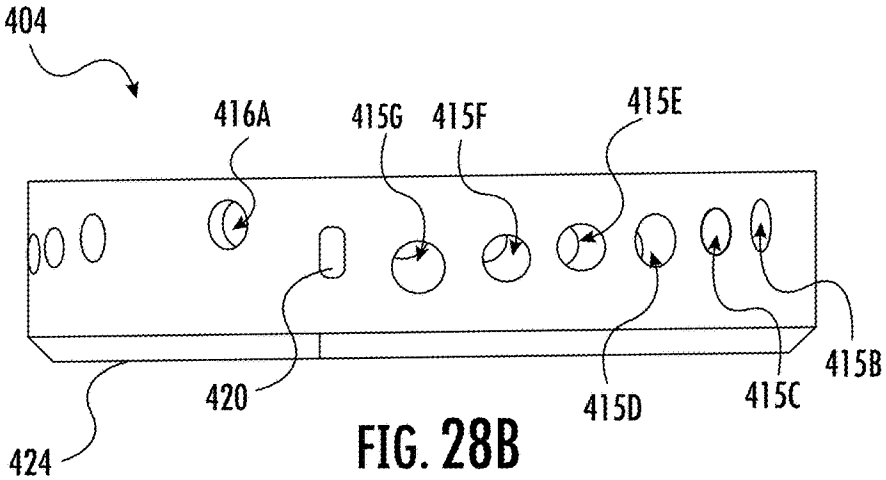
FIG. 28B is an enlarged version of FIG. 25I.
Figure 28A:
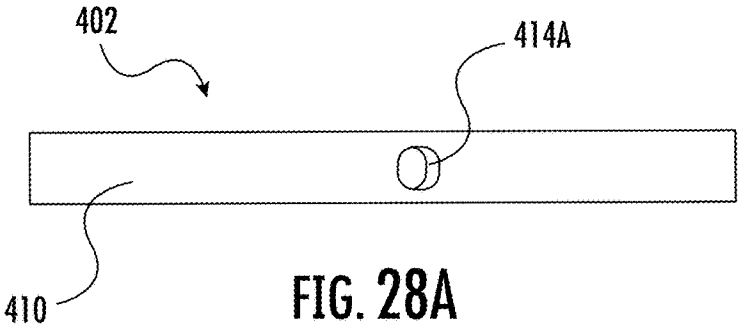
FIG. 28A is an enlarged version of FIG. 25H.
Figure 29B:
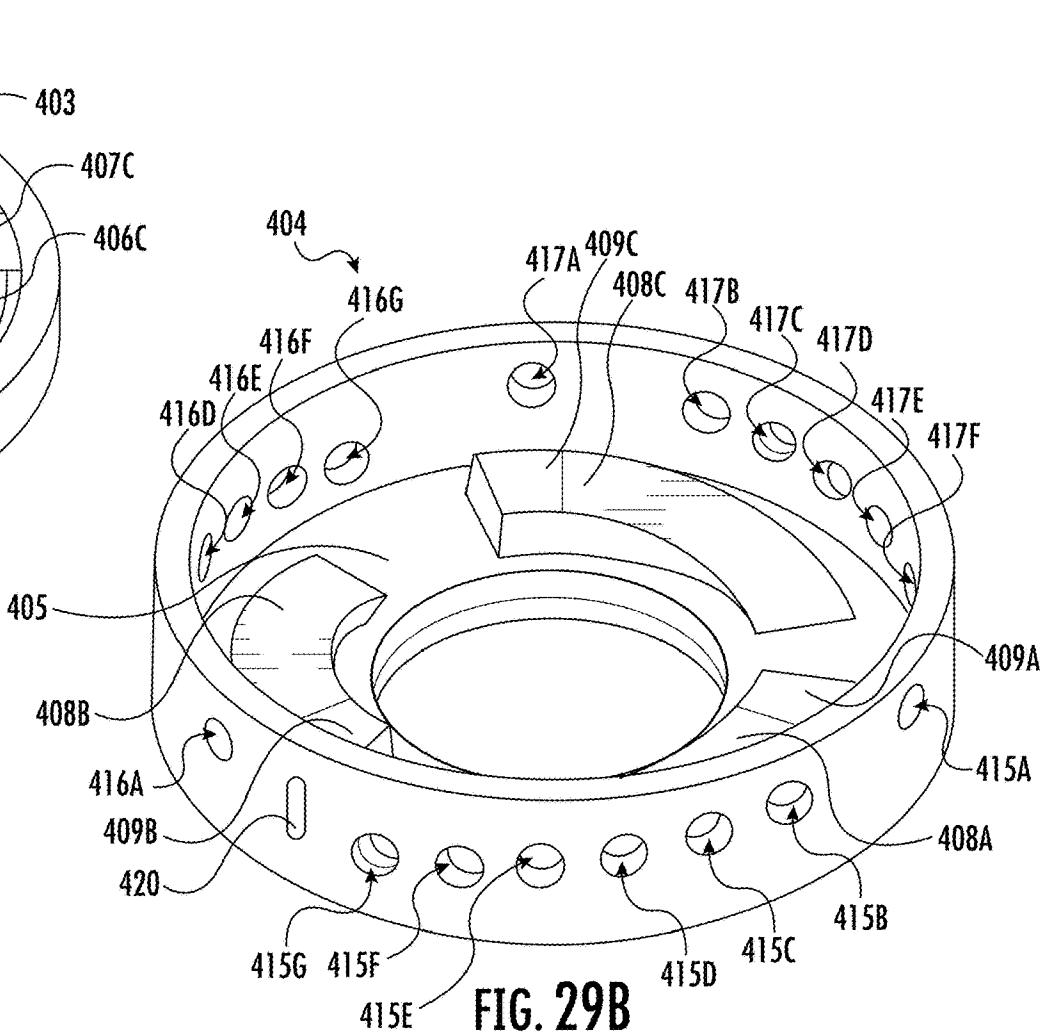
FIG. 29B is an enlarged version of FIG. 25D.
Figure 29A:
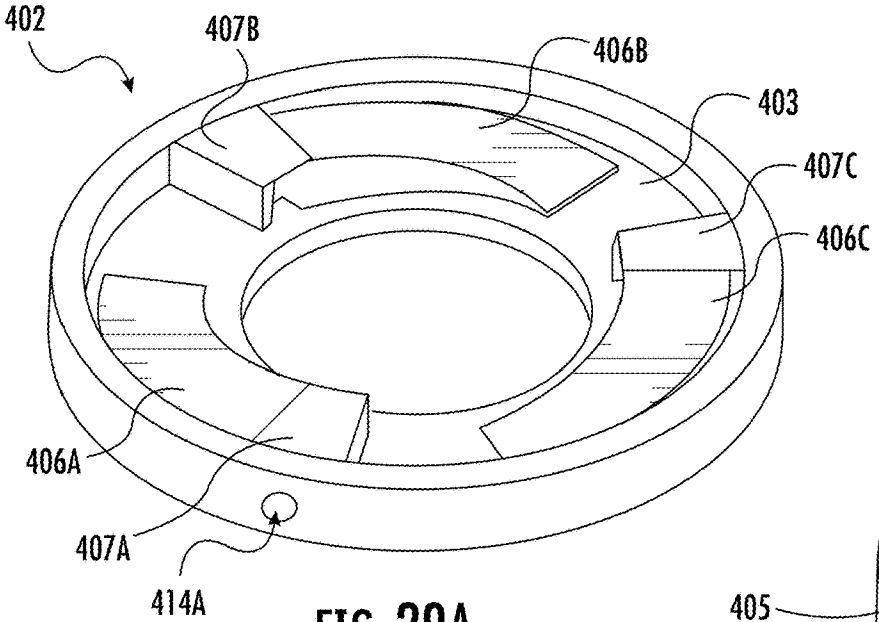
FIG. 29A is an enlarged version of FIG. 25C.
Figure 30:
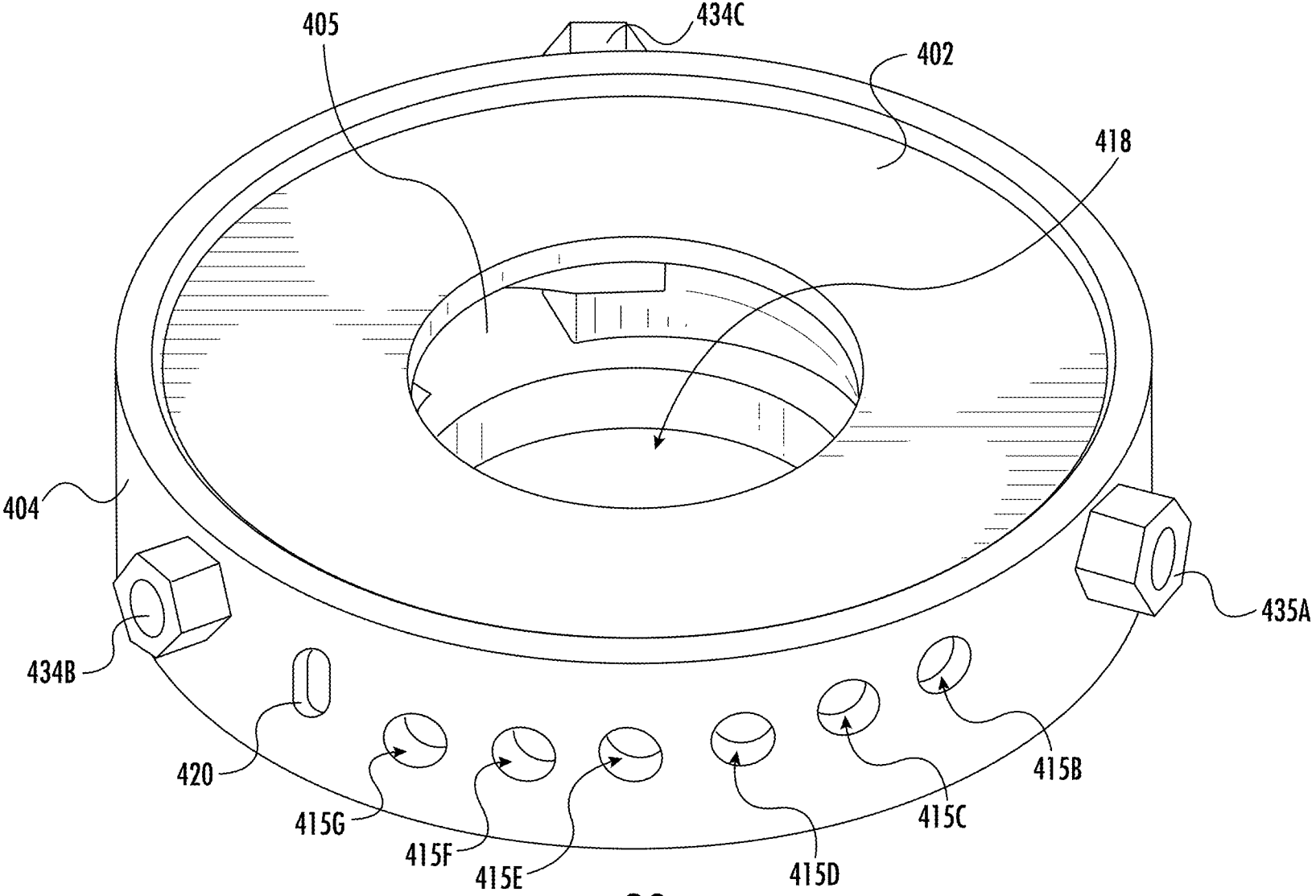
FIG. 30 is an enlarged version of FIG. 25G.

In some embodiments, a gap 332 can exist between side wall 310 and wedges 306A-C. A gap may not be present (as illustrated in FIG. 21A) between one or more of flat portions 307A-C of the wedges, which permits hole 314 to have additional threads extending directly through wall 310 and into flat portion 307A. This would increase the strength of plate 302 and ultimately the durability of shim 300. Similarly, plate 304 can include a gap 330 between side wall 312 and wedges 308A-C so that wedges 308A-C can align with wedges 306A-C. Gap 330 also permits sidewall 310 of plate 302 to extend into the cavity formed by sidewall 312 to ensure proper contact of the wedges during use of the shim 300.

Figure 33:
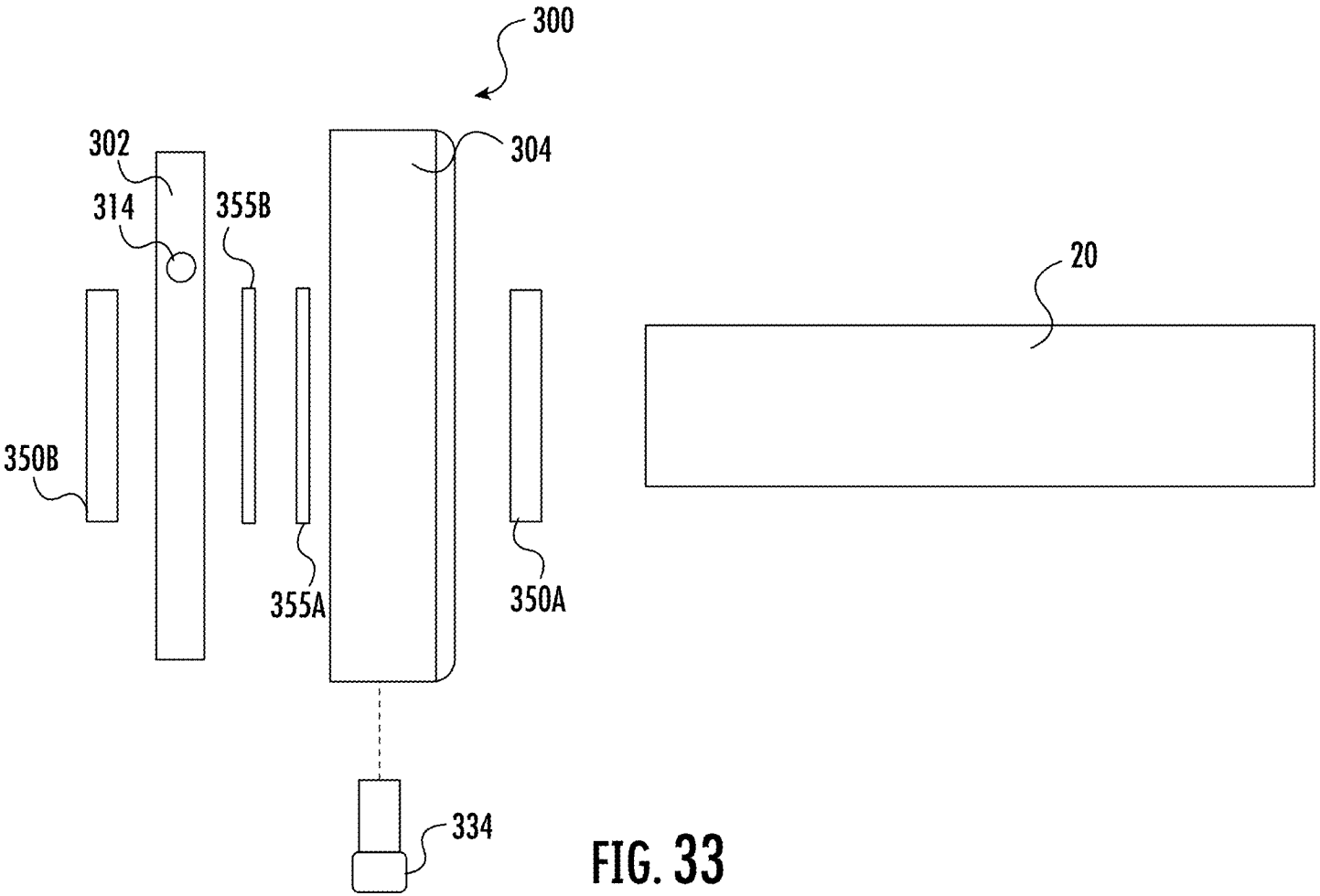
FIG. 33 is an exploded side view of the adjustable shim of the third embodiment in combination with an excavator pin.

FIG. 33 illustrates a similar alternative embodiment incorporating a center bushing. FIG. 33 is an exploded view of a shim 300 using a center bushings 350A, 350B installed on an excavator pin 20. Bushings 350A, 350B can permit shim 300 to be installed on pins of varying sizes or shapes. For example, pin 20 may have a smaller diameter than aperture 318. Accordingly, bushings 350A, 350B can have inside diameters corresponding to pin 20 (and smaller than aperture 318). As another example, pin 20 could have a different cross-sectional shape than apertures 318, such as a smaller square. Bushings 350A, 350B could have internal aperture in the shape of a square to match pin 20, while apertures 318 could remain circular. Bushings 350A, 350B can be secured in plates 302, 304 using snap rings 355A, 355B or other retention methods. Snap rings 355A, 355B can engage with recesses in bushings 350A, 350B to secure the bushings to their respective plate of the shim 300. As described above, shim 300 can be adjusted and secured in a particular position with bolt 334 threading through plate 304 and into hole 314 of plate 302.

FIGS. 25A-G, 26A-B, 27A-B, 28A-B, 29A-B, and 30 illustrate a similar alternative embodiment to shim 300, that incorporates additional holes for additional security. Shim 400 is identical in structure to shim 300, except for the hole pattern. Shim 400 includes a plate 402 and 404. Plate 402 differs from plate 302 of shim 300 in that plate 402 includes three equally spaced threaded holes 414A-C, while plate 302 includes a single hole 314 for receiving a bolt. Similarly, plate 404 includes three sets of holes 415A-G, 416A-G, and 417A-G (which could all be clearance holes) for receiving and aligning a bolt with one of holes 414A-C, while plate 304 of shim 300 only includes one set of holes 316A-G. Equal spacing of the hole sets ensures equal distribution of load forces across the shim 400 and through bolts 434A-C. Using multiple locking bolts distributes the locking force more evenly across the shim, reducing the risk of slippage or misalignment under load. This design ensures that the shim maintains its position more effectively, even in demanding operational conditions. Of course, while shim 400 illustrates three equally spaced sets of holes, more or fewer sets of holes are possible (such as two sets of holes, four sets of holes, etc.).

Figure 44:
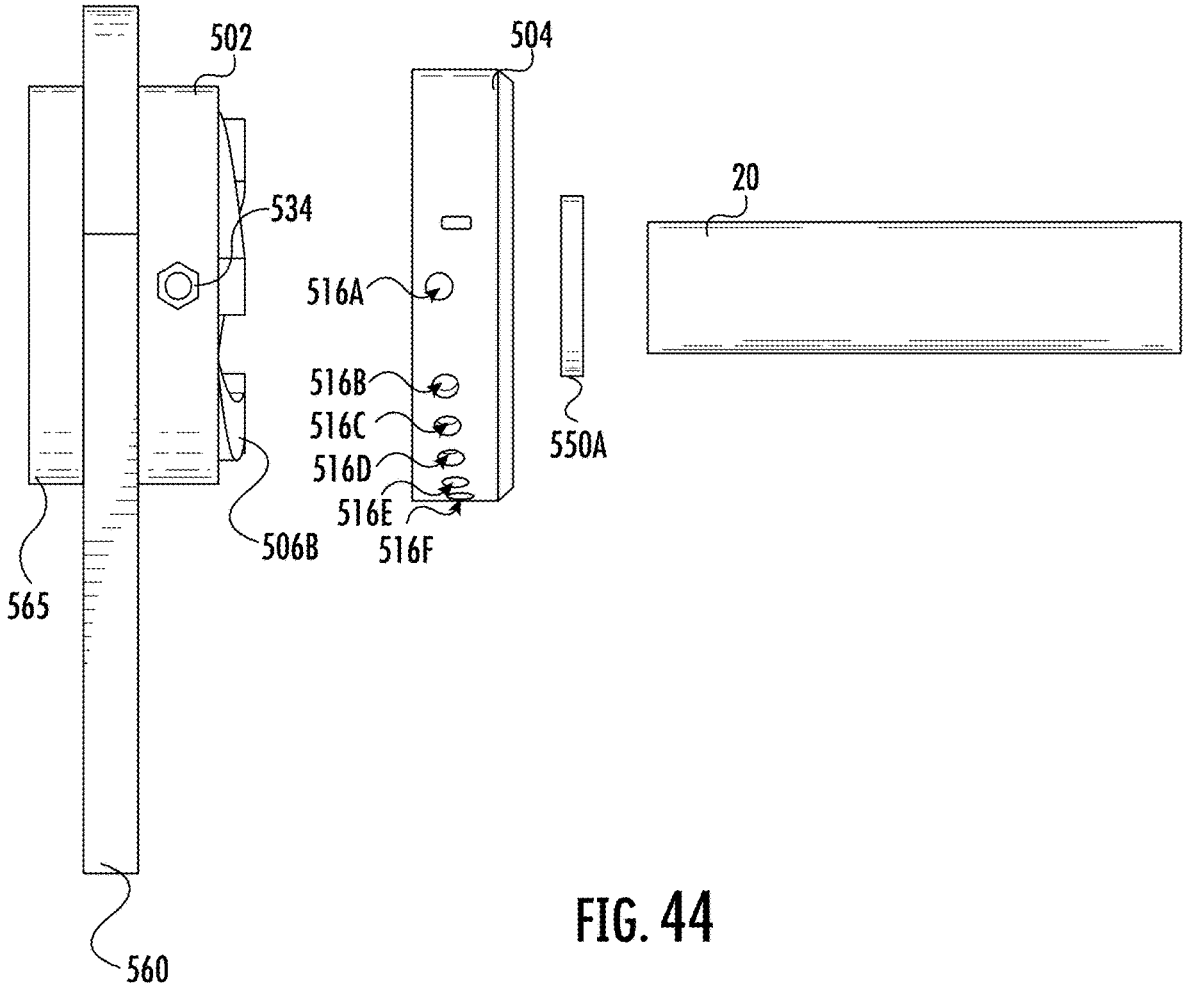
FIG. 44 is an alternative exploded view of the sixth embodiment of an expandable shim of FIG. 43.

FIGS. 43 and 44 are exploded view illustrating another alternative embodiment of a shim 500. Shim 500 can include a first plate 502 and a second plate 504. Plate 504 can be identical to plate 304 or 404 described above and can include a plurality of wedges, a cylindrical side wall 512 and a plurality of holes 516A-F. Plate 502 can include a base plate 510 from which a plurality of wedges 506A-C extend. Base plate 510 can include a hole 514 for receiving bolt 534. Bolt 534 can extend through one of holes 516A-F in plate 504 and thread into hole 514, thereby restricting the rotational orientation of plate 504 relative to plate 502. As described above with respect to other embodiments, the wedges 506A-C can contact corresponding wedges within plate 504 (hidden by side wall 512 in the figures) and control the thickness of shim 500. Base plate 510 can be sized to fit inside cylindrical side wall 512 of plate 504 such that the wedges of plate 504 are able to interface with wedges 506A-C.

Plate 502 can be further connected to or be formed integrally with equipment plate 560. Plate 502 and equipment plate 560 can be connected using various suitable methods including but not limited to welding or fasteners (such as bolts or rivets). Plate 560 can be a portion of an excavator attachment or other piece of equipment. For example, plate 560 could be a connection arm for an excavator bucket. Integrating the shim into pieces of equipment improves ease of use of the shim and efficiency of installation by reducing the number of unique separate components involved in the attachment of the equipment.

Figure 45:
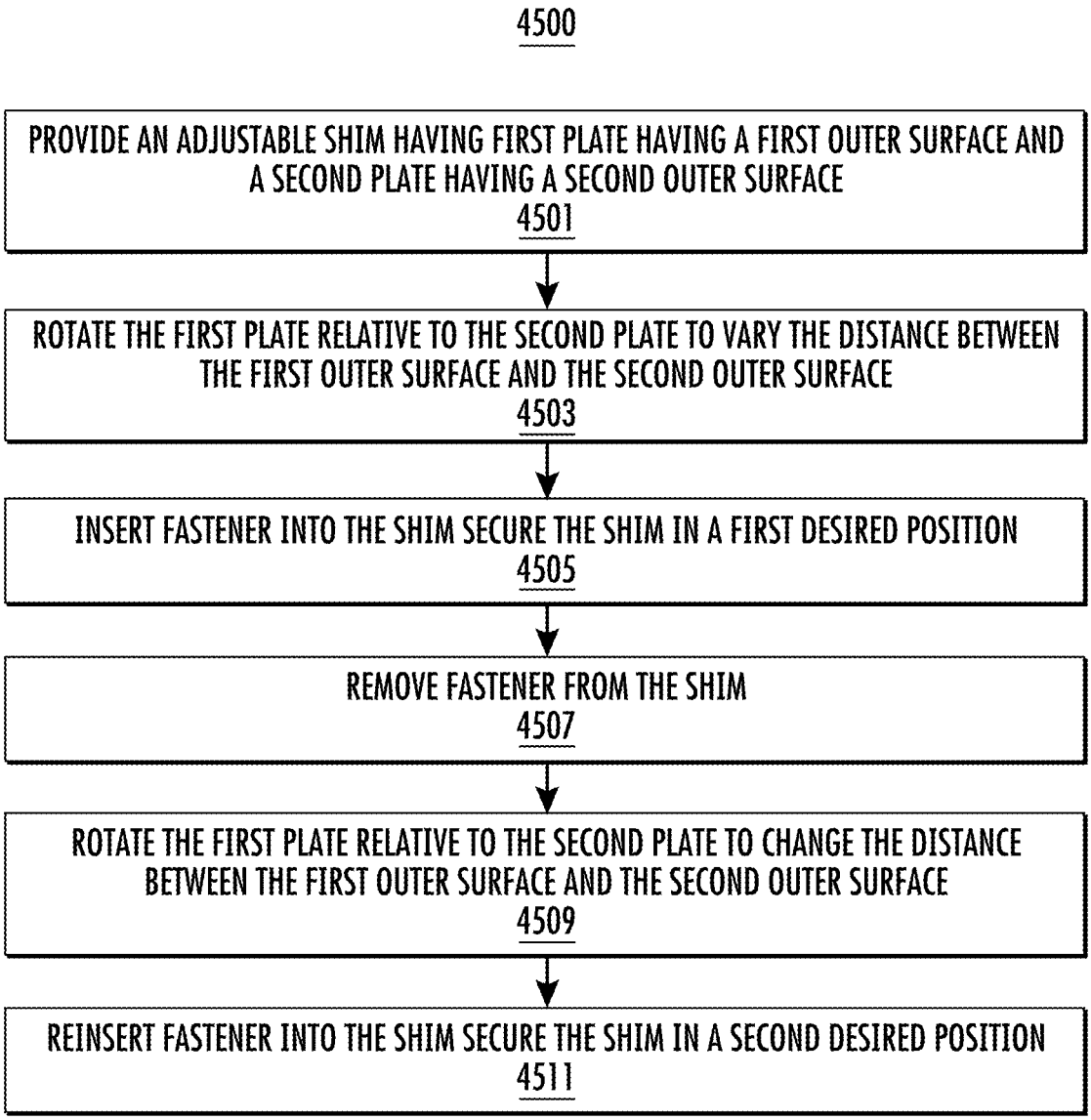
FIG. 45 is a flowchart illustrating an example method for adjusting an excavator bucket attachment.

FIG. 45 is a flowchart illustrating an example method 4500 for adjusting an excavator bucket attachment. The method can be performed, for example, by using an adjustable shim to tighten or otherwise adjust the connection between an excavator bucket or thumb and an excavator arm. At step 4501, method 4500 can include providing an adjustable shim having a first plate having a first outer surface and a second plate having a second outer surface. The adjustable shim can be any of the adjustable shims described herein, for example, one of adjustable shims 100, 200, 300, 400, or 500. At step 4503, method 4500 can include rotating the first plate relative to the second plate to vary the distance between the first outer surface and the second outer surface. As an example, a user may hold the first plate and rotate the second plate to expand the shim. In some embodiments, method 4500 may further include obtaining a shim adjustment tool. The user may then use the shim adjustment tool to rotate the first or second plate. For example, a user may use a shim adjustment tool to rotate plate 304 of shim 300 by interfacing the tool with notch 320.

At step 4505, method 4500 can further include inserting a fastener into the shim to secure the shim in a first desired position. For example, the user may insert a pin or bolt into the shim. As a more specific example, step 4505 may include the user inserting a bolt through one of holes 316A-G on plate 304 of shim 300 and threading the bolt into hole 314 of plate 302. As another example, step 4505 could include the user inserting a pin or bolt through one of holes 214 and one of holes 216 of shim 200 and securing the pin with another pin or the bolt with a nut.

At step 4507, method 4500 can further include removing the fastener from the shim. Removing the fastener from the shim can permit relative rotation between the first plate and second plate. This permits the thickness of the shim to be adjusted, for example, for different applications such as shimming a different bucket attachment to an excavator arm. At step 4509, method 4500 can include rotating first plate relative to the second plate to change the distance between the first outer surface and the second outer surface. At step 4511, method 4500 can include reinserting the fastener into the shim to secure the shim in a second desired position. Step 4511 can include inserting the fastener into the shim through one or more different holes than the user extended the fastener through in step 4505.

Figure 46:
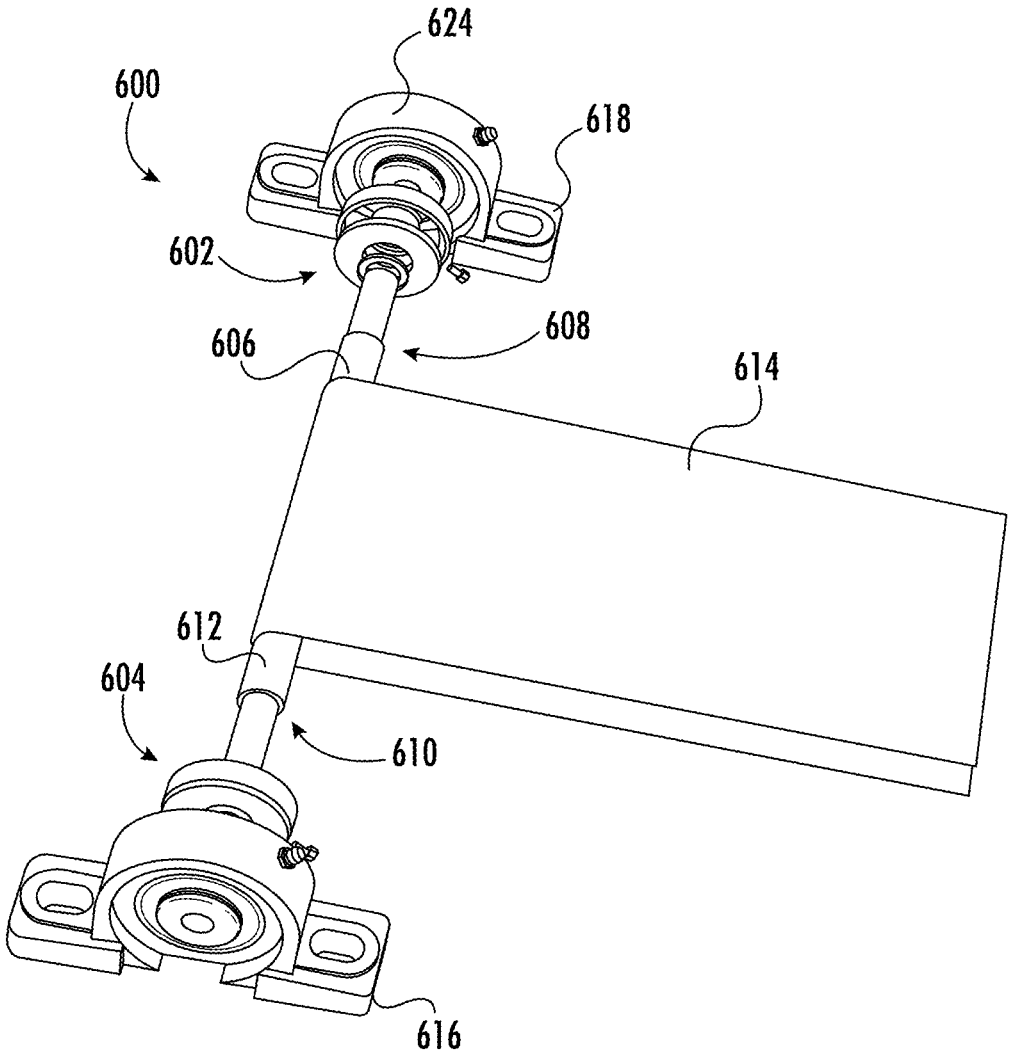
FIG. 46 is a perspective view, partially exploded, of two example expandable shims installed on a conveyor belt system.
Figure 47:
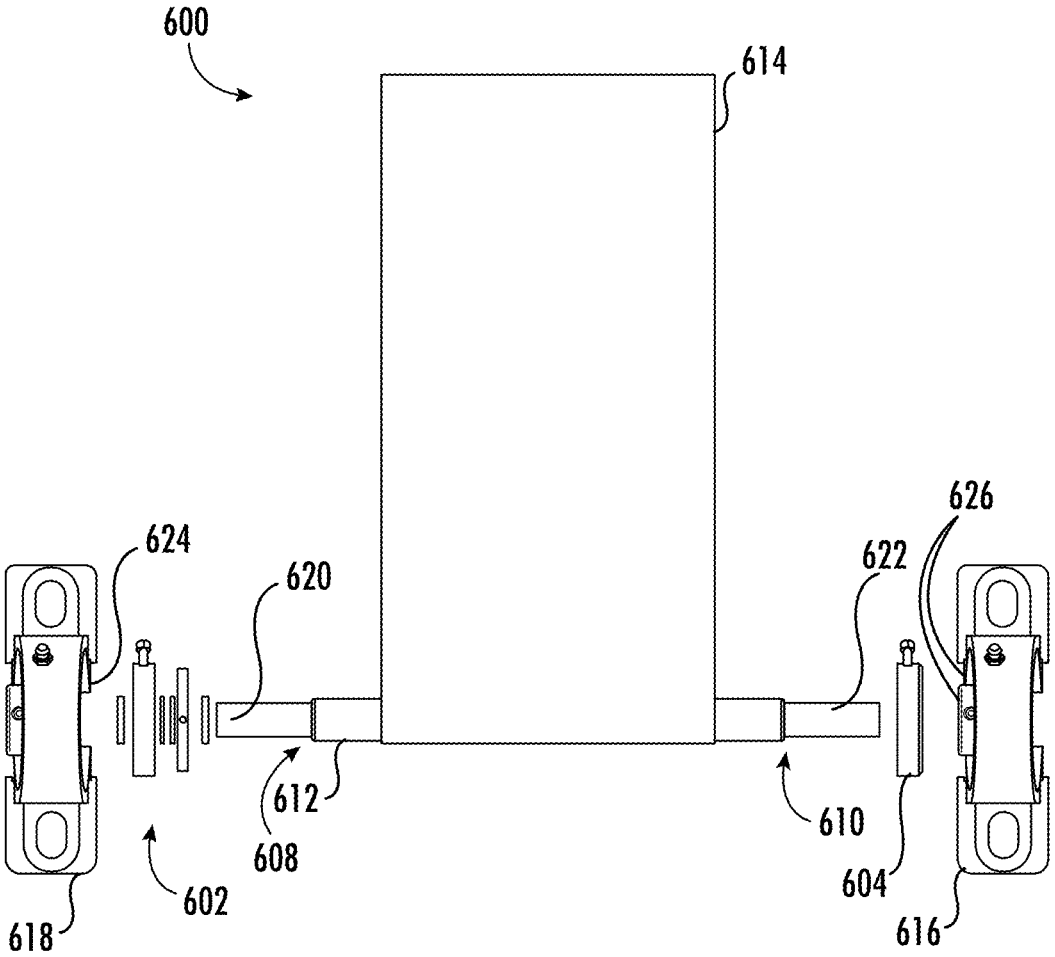
FIG. 47 is a top plan view, partially exploded, of the example expandable shims installed on the conveyor belt system of FIG. 46.
Figure 48:
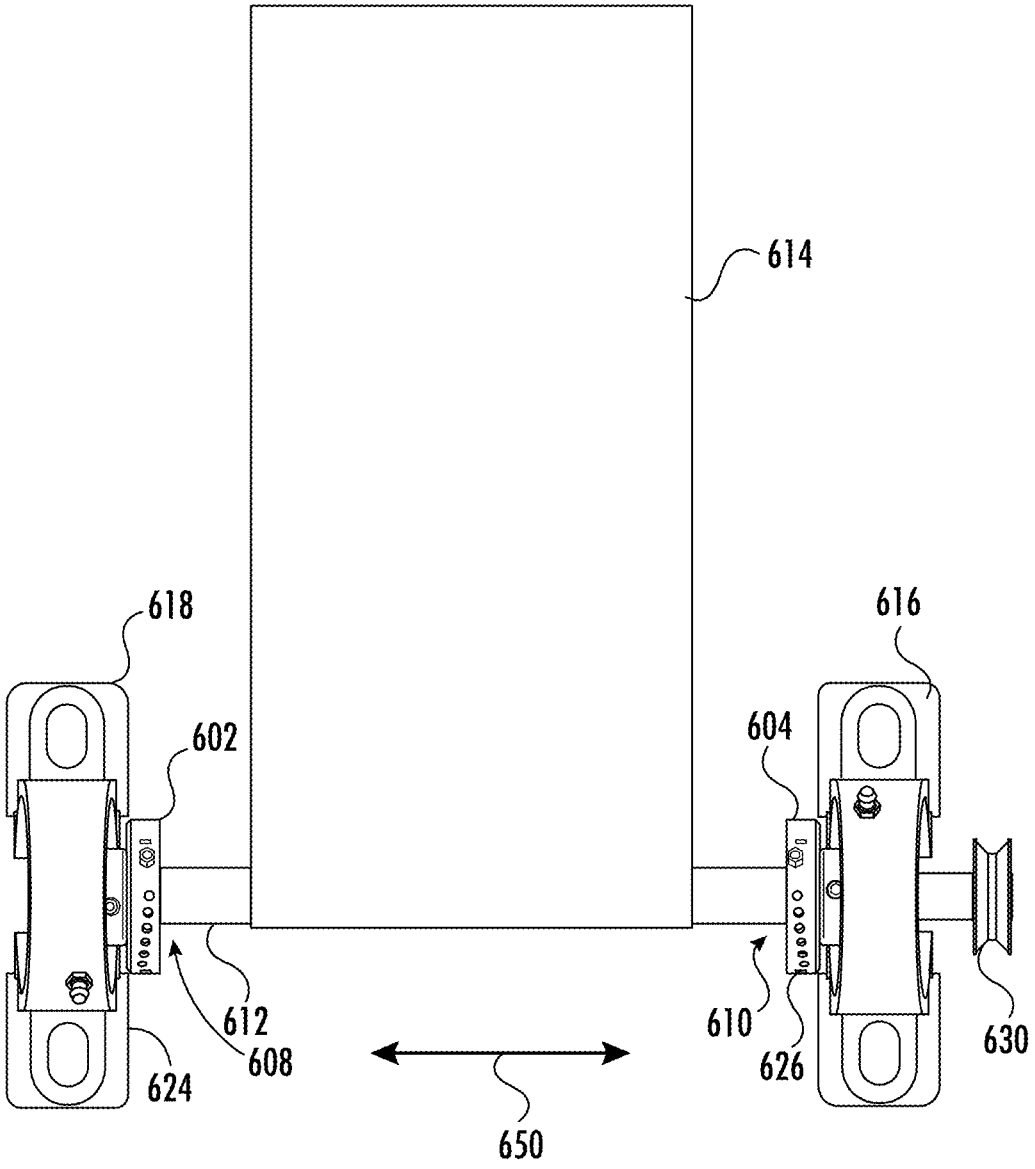
FIG. 48 is an assembled top view of the example expandable shims installed on the conveyor belt system of FIG. 46.

FIGS. 46 and 47 are perspective and top partially exploded views illustrating two example expandable shims 602, 604 installed on a conveyor belt system 600. FIG. 48 is an assembled top view of the example expandable shims 602, 604 installed on conveyor belt system 600. Conveyor belt system 600 includes shaft 606. Shaft 606 has a center portion 612. On either side of center portion 612, shaft 606 can have shoulders 608, 610. A conveyor belt 614 can be installed on center portion 612. In some embodiments, center portion 612 can include cleats or other engagement features to engage belt 614. Each end of shaft 606, can be mounted in a pillow block bearing (or other similar bearing) 616, 618. As illustrated in FIG. 48, a motion transmission member 630 (such as a gear, pulley, or sprocket) can be attached to an end of shaft 606. Motion transmission member 630 can be used to drive shaft 606 to advance conveyor belt 614. In installation, shims 602, 604 can contact shoulders 608, 610 respectively and shim the shaft against bearings 618, 616. For example, one outer surface of shim 602 can contact shoulder 608 and the other outer surface of shim 602 can contact bearing shoulder 624. Similarly, one outer surface of shim 606 can contact shoulder 610 and the other outer surface of shim 604 can contact bearing shoulder 626. In some embodiments, a thrust bearing could be installed, for example, between shim 602 (or 604) and bearing shoulder 624 (or 626) to prevent binding or excessive wearing on the outer surfaces of the shims, shaft shoulders, or bearing shoulders.

In use, shims 602, 604 can be used to laterally shift shaft 606. For example, when shims 602, 604 are set at the same thickness, the center portion 612 of shaft 606 may be centered between bearings 616, 618. However, a user may wish to change the position of belt 614 (for example, to keep belt 614 aligned with another component of an assembly line). The user may change the thicknesses of shims 602, 604 (as described with respect to the various embodiments disclosed above) to move center portion 612 along direction 650 (illustrated in FIG. 48). For example, a user could make shim 602 thicker and shim 604 thinner to shift center portion 612 to the right.

Figure 49:
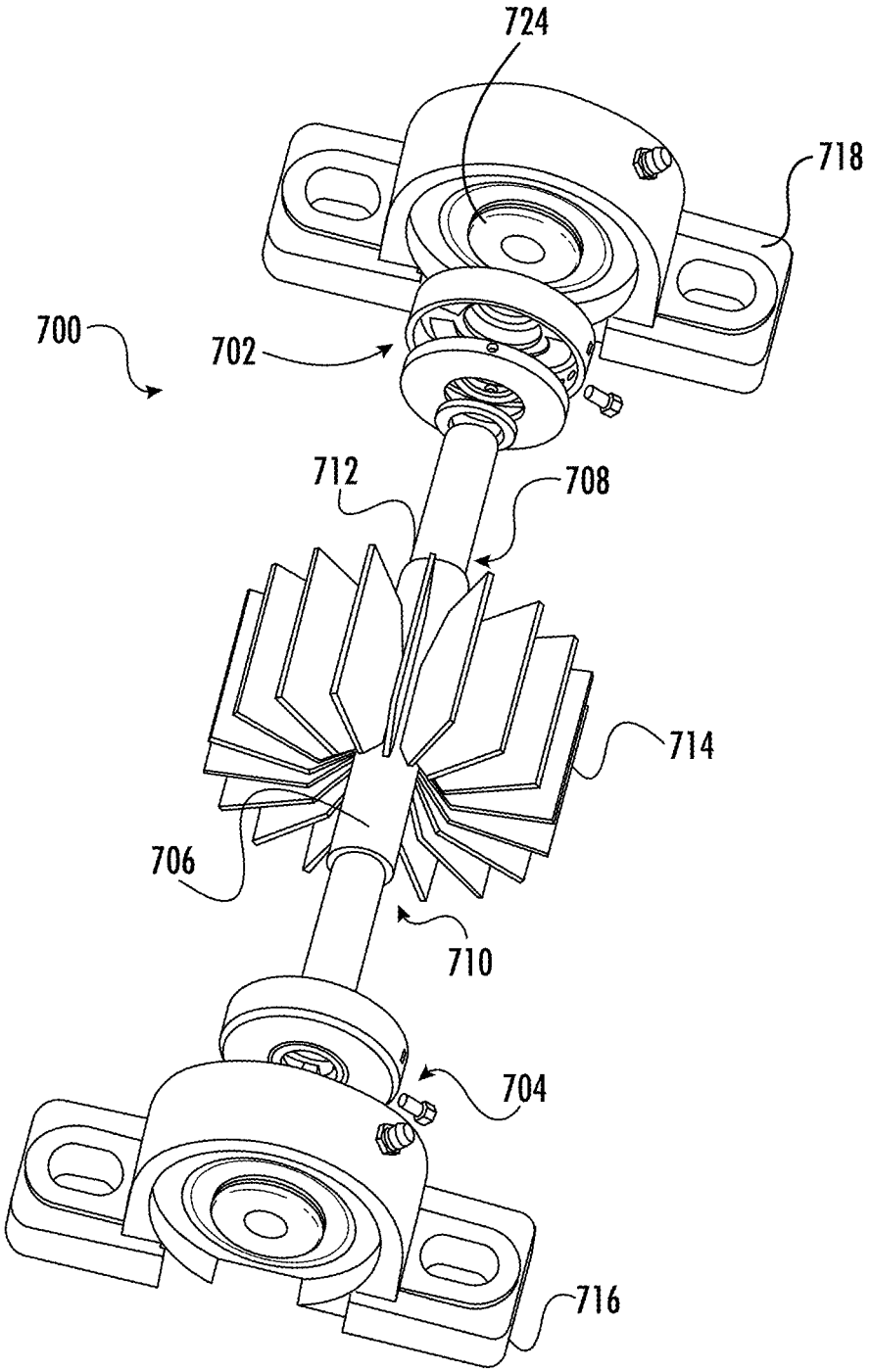
FIG. 49 is a perspective view, partially exploded, of two example expandable shims installed on a fan blade system.
Figure 50:
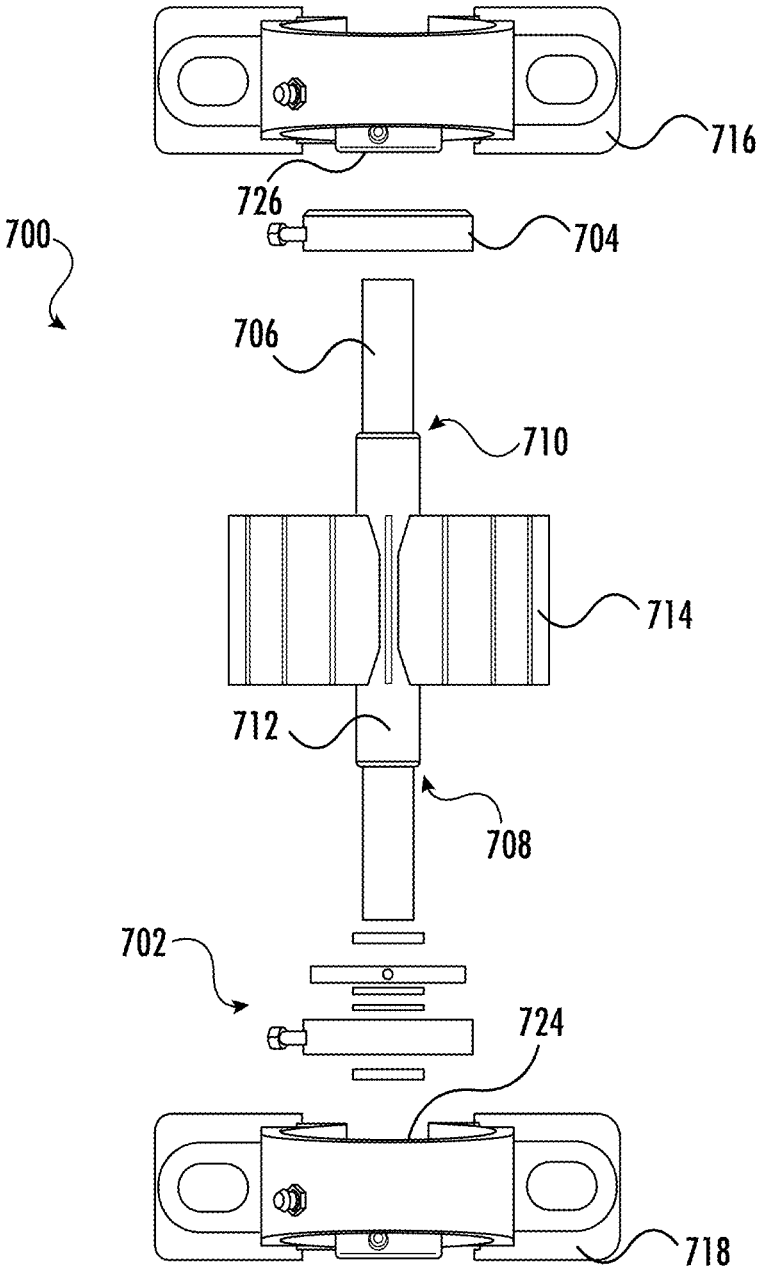
FIG. 50 is a top plan view, partially exploded, of the example expandable shims installed on the fan blade system of FIG. 49.
Figure 51:
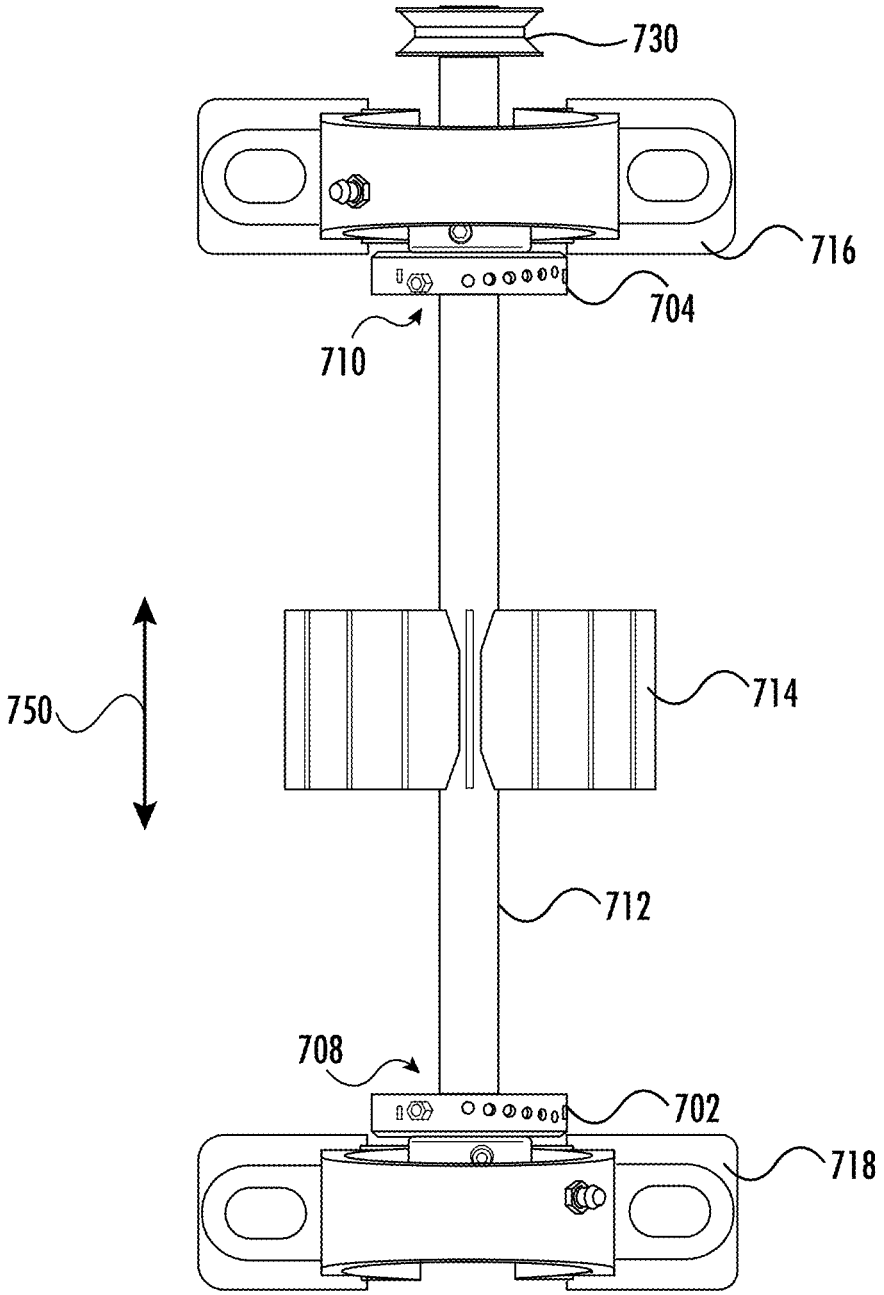
FIG. 51 is a top view of the example expandable shims installed on the fan blade system of FIG. 49

FIGS. 49 and 50 are perspective and top partially exploded views illustrating two example expandable shims 702, 704 installed on a fan blade system 700. FIG. 51 is an assembled top view of the example expandable shims 702, 704 installed on fan blade system 700. Fan blade system 700 can include fan blades 714, which may be driven to create a flow of a fluid in a particular direction or through another component of the system. For example, fan blade system 700 could be used as an impeller for a pump. Fan blade system 700 includes shaft 706. Shaft 706 has a center portion 712. On either side of center portion 712, shaft 706 can have shoulders 708, 710. Fan blades 714 can be installed on center portion 712. In other embodiments, instead of fan blades 714, a gear, sprocket, wheel, pulley, cutting tool, or other rotational implement could be installed on shaft 706.

Each end of shaft 706, can be mounted in a pillow block bearing (or other similar bearing) 716, 718. As illustrated in FIG. 51, a motion transmission member 730 (such as a gear, pulley, or sprocket) can be attached to an end of shaft 706. Motion transmission member 730 can be used to drive shaft 706 to cause rotation of fan blades 714. In installation, shims 702, 704 can contact shoulders 708, 710 respectively and shim the shaft against bearings 718, 716. For example, one outer surface of shim 702 can contact shoulder 708 and the other outer surface of shim 702 can contact bearing shoulder 724. Similarly, one outer surface of shim 706 can contact shoulder 710 and the other outer surface of shim 704 can contact bearing shoulder 726. In some embodiments, a thrust bearing could be installed, for example, between shim 702 (or 704) and bearing shoulder 724 (or 726) to prevent binding or excessive wearing on the outer surfaces of the shims, shaft shoulders, or bearing shoulders.

In use, shims 702, 704 can be used to shift shaft 706 with respect to bearings 716, 718. For example, when shims 702, 704 are set at the same thickness, the center portion 712 of shaft 706 may be centered between bearings 716, 718. However, a user may wish to change the position of fan blades 714 (for example, to keep fan blades 714 aligned with another component of the system or to reduce vibration or wear). The user may change the thicknesses of shims 702, 704 (as described with respect to the various embodiments disclosed above) to move center portion 712 along direction 750 (illustrated in FIG. 51). For example, a user could make shim 702 thicker and shim 704 thinner to shift center portion 7612 upwards as oriented in FIG. 51.

Figure 52:
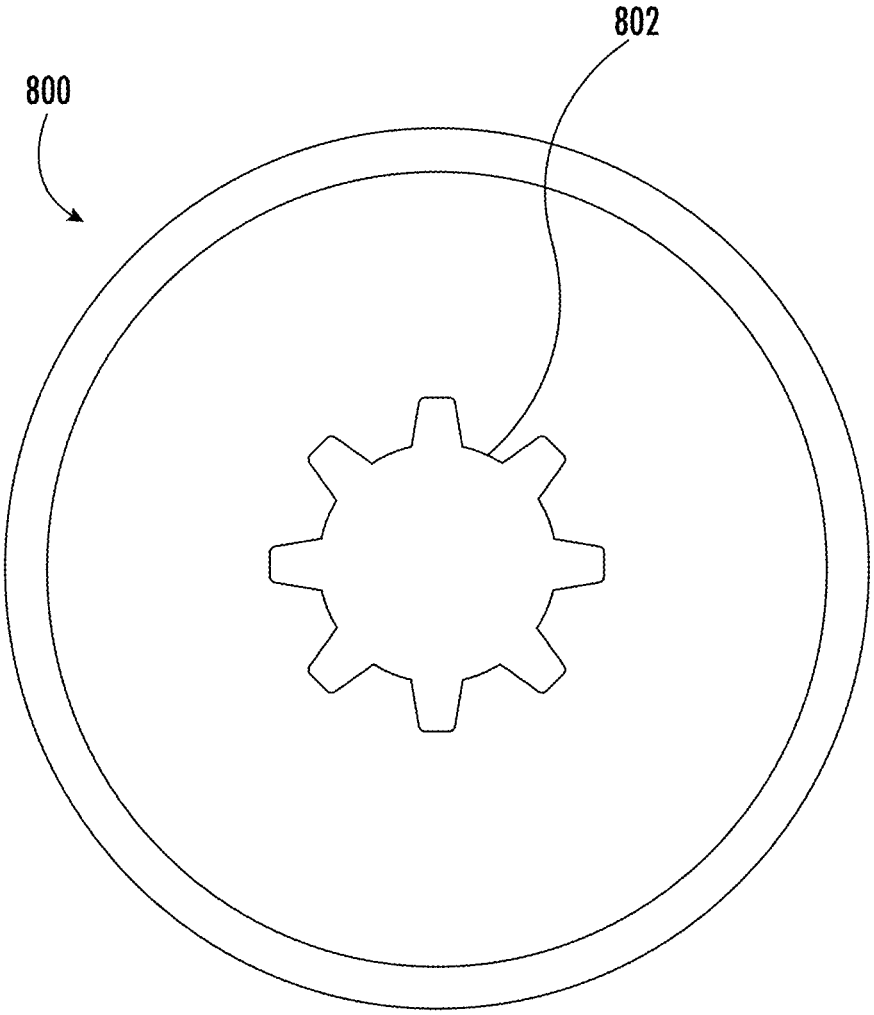
FIG. 52 is a schematic illustration of an example splined shim plate.

FIG. 52 is an illustration of an example splined shim plate 800. A splined shim plate may be used to attach a shim to a shaft (for example, shim 602 to shaft 606 or shim 702 to shaft 706). The shaft can include splines that mate with the corresponding spline openings 802 on the interior opening of the shim plate. In some embodiments, just one plate of a particular shim may include the splines. In other embodiments, both plates may include splines, with the splines and wedges of the shim plates being particularly sized and shaped such that one of the plates can be removed from the shaft and rotated to a different spline position to control the thickness of the shim. Other similar methods of attachment of a shim to a shaft are also possible, such as a keyed attachment.

Figure 53:
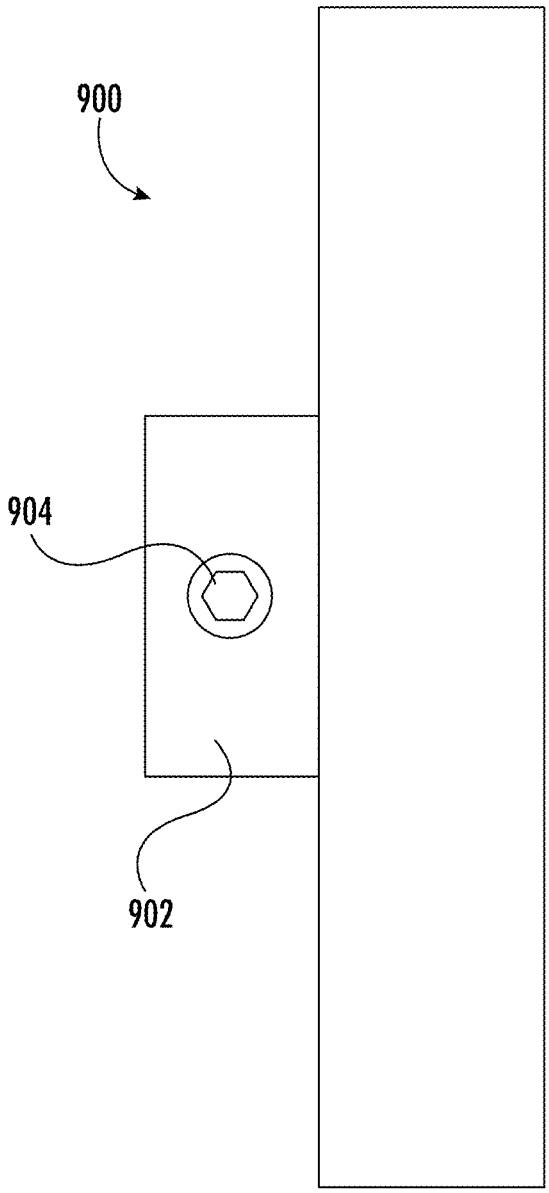
FIG. 53 is a schematic illustration of an example shim plate having a collar and set screw attachment.

FIG. 53 is an illustration of an example shim plate 900 having a collar 902 and set screw attachment. The collar 902 can be integrally formed with the shim plate 900 include a threaded hole for receiving a set screw 904. When placed on a shaft, set screw 904 can be tightened to secure shim plate 900 to the shaft.

The foregoing merely illustrates the principles of the disclosure. Any examples set forth in this specification are not intended to be limiting and merely set forth some of the many possible embodiments for the appended claims. Those skilled in the art will readily recognize various modifications and changes that may be made without following the example embodiments and applications illustrated and described herein, and without departing from the true spirit and scope of the following claims.

All references cited and/or discussed in this specification are incorporated herein by reference in their entireties and to the same extent as if each reference was individually incorporated by reference.

What is claimed is:

1. A shim system configured to engage with at least one of a bucket, finger, or attachment on a shaft extending from an arm of an earth working machine, the shim system comprising:

a first member defining an opening for receiving the shaft;

the first member having a first side defining an outside surface and a second side opposite the first side and at least one wedge extending from the second side;

a second member having a first side defining an outside surface and a second side opposite the first side and at least one wedge extending from the second side;

a fastener engaged with the first member and the second member, the fastener being configured to selectively fix the outside surface of the first member relative to the outside surface of the second member;

wherein:

the at least one wedge of the first member contacts the at least one wedge of the second member;

the outside surface of the first member is configured to selectively contact the arm of the earth working machine and the outside surface of the second member is configured to selectively contact the at least one of a bucket, finger, or attachment;

the at least one wedge of the first member and the at least one wedge of the second member are configured such that relative rotation between the first member and the second member about the shaft in a first direction increases the distance between the outside surface of the first member and the outside surface of the second member and increases the distance between the arm of the earth working machine and the at least one of a bucket, finger, or attachment, and the at least one wedge of the first member and the at least one wedge of the second member are configured such that relative rotation between the first member and the second member about the shaft in a direction opposite first direction decreases the distance between the outside surface of the first member and the outside surface of the second member and decreases the distance between the arm of the earth working machine and the at least one of a bucket, finger, or attachment;

the first member further comprises a first cylindrical side wall;

the first cylindrical side wall forms a cavity; and the at least one wedge of the first member is disposed within the cavity.

2. The shim system of claim 1, wherein:

the first cylindrical side wall further comprises a plurality of holes; and the fastener extends through a first of the plurality of holes.

3. The shim system of claim 2, wherein the plurality of holes includes at least three holes and one of the at least three holes is radially offset from the other of the least three holes.

4. The shim system of claim 1, wherein:

the second member further comprises a second cylindrical side wall;

the second cylindrical side wall comprises a second aperture; and the fastener engages the second aperture.

5. The shim system of claim 4, wherein the second aperture extends into the at least one wedge of the second member.

6. The shim system of claim 1, wherein the first cylindrical side wall comprises a slot and the fastener extends through the slot.

7. The shim system of claim 1, wherein the at least one wedge of the first member is curved around the opening of the first member.

8. The shim system of claim 1, wherein the first member comprises a plurality of wedges and the plurality of wedges are spaced about the second side of the first member.

9. The shim system of claim 1, wherein the at least one wedge of the first member and the at least one wedge of the second member each comprise a helical taper.

10. The shim system of claim 1, wherein an outer edge of first member is beveled and configured to receive an O-ring.

11. A shim system configured to engage with at least one of a bucket, finger, or attachment on a shaft extending from an arm of an earth working machine, the shim system comprising:

a first member defining an opening for receiving the shaft;

the first member having a first side defining an outside surface and a second side opposite the first side and at least one wedge extending from the second side;

a second member having a first side defining an outside surface and a second side opposite the first side and at least one wedge extending from the second side; and a fastener engaged with the first member and the second member, the fastener being configured to selectively fix the outside surface of the first member relative to the outside surface of the second member;

wherein:

the at least one wedge of the first member contacts the at least one wedge of the second member;

the outside surface of the first member is configured to selectively contact the arm of the earth working machine and the outside surface of the second member is configured to selectively contact the at least one of a bucket, finger, or attachment;

the at least one wedge of the first member and the at least one wedge of the second member are configured such that relative rotation between the first member and the second member about the shaft in a first direction increases the distance between the outside surface of the first member and the outside surface of the second member and increases the distance between the arm of the earth working machine and the at least one of a bucket, finger, or attachment, and the at least one wedge of the first member and the at least one wedge of the second member are configured such that relative rotation between the first member and the second member about the shaft in a direction opposite the first direction decreases the distance between the outside surface of the first member and the outside surface of the second member and decreases the distance between the arm of the earth working machine and the at least one of a bucket, finger, or attachment;

the first member comprises a first circular plate;

the second member comprises a second circulate plate;

the at least one wedge of the first member comprises a first protruding wedge that extends beyond an outer periphery of the first circular plate; and the at least one wedge of the second member comprises a second protruding wedge that extends beyond an outer periphery of the second circular plate.

12. The shim system of claim 11, wherein:

the first protruding wedge comprises a first aperture;

the second protruding wedge comprises a second aperture; and the fastener extends through the first aperture and second aperture.

13. The shim system of claim 11, wherein the at least one wedge of the first member is curved around the opening of the first member.

14. The shim system of claim 11, wherein the first member comprises a plurality of wedges and the plurality of wedges are spaced about the second side of the first member.

15. The shim system of claim 11, wherein the at least one wedge of the first member and the at least one wedge of the second member each comprise a helical taper.

16. The shim system of claim 11, wherein an outer edge of first member is beveled and configured to receive an O-ring.

17. A shim system configured for receipt of a shaft, the shim system comprising:

a first member defining an opening for receiving the shaft; the first member having a first side defining an outside surface and a second side opposite the first side and at least one wedge extending from the second side;

a second member having a first side defining an outside surface and a second side opposite the first side and at least one wedge extending from the second side; and a fastener engaged with the first member and the second member, the fastener being configured to selectively fix the outside surface of the first member relative to the outside surface of the second member;

wherein:

the at least one wedge of the first member contacts the at least one wedge of the second member; and the at least one wedge of the first member and the at least one wedge of the second member are configured such that relative rotation between the first member and the second member about the shaft in a first direction increases the distance between the outside surface of the first member and the outside surface of the second member, and at least one wedge of the first member and the at least one wedge of the second member are configured such that relative rotation between the first member and the second member about the shaft in a direction opposite first direction decreases the distance between the outside surface of the first member and the outside surface of the second member;

the first member further comprises a first cylindrical side wall;

the first cylindrical side wall forms a cavity; and the at least one wedge of the first member is disposed within the cavity.

18. The shim system of claim 17, wherein:

the first cylindrical side wall further comprises a plurality of holes; and the fastener extends through a first of the plurality of holes.

19. The shim system of claim 18, wherein the plurality of holes includes at least three holes and one of the at least three holes is radially offset from the other of the at least three holes.

20. The shim system of claim 17, wherein:

the second member further comprises a second cylindrical side wall;

the second cylindrical side wall comprising a second aperture; and the fastener engages the second aperture.

21. The shim system of claim 20, wherein the second aperture extends into the at least one wedge of the second member.

22. The shim system of claim 17, wherein:

the first member comprises a plurality of wedges and the plurality of wedges of the first member are spaced about the second side of the first member; and the second member comprises a plurality of wedges and the plurality of wedges of the second member are spaced about the second side of the second member.

23. The shim system of claim 22, wherein the plurality of wedges of each of the first member and second member are curved around the center aperture.

24. The shim system of claim 22, wherein the plurality of wedges of the first member oppose the plurality of wedges of the second member.

25. The shim system of claim 22, wherein the plurality of wedges of the first and second members comprise a helical taper.

26. The shim system of claim 17, wherein the first cylindrical side wall comprises a slot and the fastener extends through the slot.

27. The shim system of claim 17, wherein each of the first member and second member is circular.

28. A shim system configured for receipt of a shaft, the shim system comprising:

a first member defining an opening for receiving the shaft;

the first member having a first side defining an outside surface and a second side opposite the first side and at least one wedge extending from the second side;

a second member having a first side defining an outside surface and a second side opposite the first side and at least one wedge extending from the second side; and a fastener engaged with the first member and the second member, the fastener being configured to selectively fix the outside surface of the first member relative to the outside surface of the second member;

wherein:

the at least one wedge of the first member contacts the at least one wedge of the second member;

the at least one wedge of the first member and the at least one wedge of the second member are configured such that relative rotation between the first member and the second member about the shaft in a first direction increases the distance between the outside surface of the first member and the outside surface of the second member, and at least one wedge of the first member and the at least one wedge of the second member are configured such that relative rotation between the first member and the second member about the shaft in a direction opposite the first direction decreases the distance between the outside surface of the first member and the outside surface of the second member;

the first member comprises a first circular plate;

the second member comprises a second circular plate;

the at least one wedge of the first member comprises a first protruding wedge that extends beyond an outer periphery of the first circular plate; and the at least one wedge of the second member comprises a second protruding wedge that extends beyond an outer periphery of the second circular plate.

29. The shim system of claim 28, wherein:

the first protruding wedge comprises a plurality of apertures;

the second protruding wedge comprises a plurality of apertures; and the fastener extends through an first aperture of the plurality apertures of the first protruding wedge and a second aperture of the plurality of apertures of the second protruding wedge.

30. The shim system of claim 28, wherein:

the first member comprises a plurality of wedges and the plurality of wedges of the first member are spaced about the second side of the first member; and the second member comprises a plurality of wedges and the plurality of wedges of the second member are spaced about the second side of the second member.

* * * * *